US010648139B2

(12) United States Patent
Knapp

(10) Patent No.: US 10,648,139 B2
(45) Date of Patent: May 12, 2020

(54) CARRIAGE SUSPENDED CONCRETE DRILL GANG ASSEMBLY

(71) Applicant: Ronald A. Knapp, Bonita Springs, FL (US)

(72) Inventor: Ronald A. Knapp, Bonita Springs, FL (US)

( * ) Notice: Subject to any disclaimer, the term of this patent is extended or adjusted under 35 U.S.C. 154(b) by 351 days.

(21) Appl. No.: 15/856,604

(22) Filed: Dec. 28, 2017

(65) Prior Publication Data

US 2018/0142430 A1 May 24, 2018

Related U.S. Application Data

(63) Continuation-in-part of application No. 14/180,081, filed on Feb. 13, 2014, now Pat. No. 9,873,992.

(51) Int. Cl.

| | |
|---|---|
| ***E01C 23/04*** | (2006.01) |
| ***E21B 7/04*** | (2006.01) |
| ***E21B 7/02*** | (2006.01) |
| ***E01C 7/14*** | (2006.01) |

(52) U.S. Cl.

CPC ..... *E01C 23/04* (2013.01); *E01C 7/147* (2013.01); *E21B 7/027* (2013.01); *E21B 7/046* (2013.01); *E01C 2301/50* (2013.01)

(58) Field of Classification Search

CPC . E21B 7/02; E21B 7/023; E21B 7/027; E21B 7/046; E21B 7/002; E21B 7/025; E21B 7/021; E21B 7/003; E21B 15/04; E21B 15/045; E21B 3/045; E21B 31/005; E21B 28/00; E01C 7/147; E01C 23/00; E01C 23/10; E01C 23/04; E01C 2301/50; B23B 39/02; B23B 39/14

USPC .... 173/213, 46, 47, 1, 4, 27, 28, 34, 35, 36, 173/37, 186, 187, 188, 189, 20, 21, 184, 173/90, 91, 185, 216, 218; 175/202, 203, 175/62; 280/638

See application file for complete search history.

(56) References Cited

U.S. PATENT DOCUMENTS

| | | | | |
|---|---|---|---|---|
| 2,117,084 A * | 5/1938 | Elmes | ..... | E21B 1/02 254/390 |
| 2,761,395 A * | 9/1956 | Peck | ..... | B23K 9/287 104/246 |
| 2,969,844 A * | 1/1961 | Wellington | ..... | E21B 3/02 173/46 |

(Continued)

FOREIGN PATENT DOCUMENTS

EP 1284323 A1 2/2003

*Primary Examiner* — Dariush Seif

(74) *Attorney, Agent, or Firm* — Erickson Kernell IP, LLC; Kent R. Erickson

(57) ABSTRACT

A drilling machine for boring holes in a slab having a hole formed therein includes a main frame to which a drill gang assembly is rotatably and telescopingly mounted. The drill gang assembly includes a drill support frame supporting a plurality of drills in parallel spaced alignment. The drill gang assembly is mounted on a mast which may be rotated three hundred and sixty degrees relative to the main frame about a vertical axis up to at least one hundred and eighty degrees. The mast slides laterally relative to the main frame and the wheels supporting the main frame telescope laterally so the wheels can be supported on an adjacent lane or shoulder when the drill gang assembly is supported over a hole extending the width of a lane of a road forming by the slab.

20 Claims, 36 Drawing Sheets

(56) References Cited

U.S. PATENT DOCUMENTS 3,809,344 A * 5/1974 Kolderup ..... E21B 7/024 173/185
3,828,874 A * 8/1974 Council ..... B62D 55/0842 180/9.6
4,347,692 A * 9/1982 Culver ..... E04H 12/34 173/195
4,417,628 A * 11/1983 Gessner ..... E02F 3/962 173/159
4,589,499 A * 5/1986 Behrens ..... E21B 7/002 173/184
4,809,788 A * 3/1989 Nelson ..... E21B 7/02 173/28
4,812,088 A * 3/1989 Hake ..... B25H 1/0078 173/152
4,889,193 A * 12/1989 Shy ..... E21B 3/02 175/62
5,125,460 A * 6/1992 Behrens ..... E21B 7/046 173/184
5,318,377 A * 6/1994 Swisher, Jr. ..... E01C 23/04 404/100
5,385,213 A * 1/1995 Hake ..... B62D 3/02 180/210
5,505,565 A * 4/1996 Canales ..... B23P 19/061 166/77.51
5,540,292 A * 7/1996 Behrens ..... E21B 7/02 173/184
5,695,017 A * 12/1997 Gessner ..... E02F 3/962 173/184
5,799,738 A * 9/1998 Kromray, Jr. ..... E21B 7/028 173/184
5,954,143 A * 9/1999 McCabe ..... E21B 7/025 173/171
5,993,108 A * 11/1999 Buhman ..... E01C 23/04 249/2
6,082,469 A * 7/2000 Kromray, Jr. ..... E21B 7/028 173/184
6,199,656 B1 * 3/2001 Vento ..... E21B 7/025 173/219
6,257,349 B1 * 7/2001 Bardwell ..... E21B 7/022 173/147
6,481,507 B1 * 11/2002 Kromray, Jr. ..... E01C 23/04 173/184
7,387,464 B2 * 6/2008 Hall ..... B28D 1/18 299/41.1
8,356,955 B2 * 1/2013 Nadler ..... E01C 11/14 404/73
8,459,897 B1 * 6/2013 Knapp ..... E01C 23/06 254/264
8,591,143 B1 * 11/2013 Knapp ..... E01C 23/06 254/2 R
8,662,198 B2 * 3/2014 Linley ..... E21B 15/003 173/164
9,028,168 B1 * 5/2015 Knapp ..... E01C 19/29 404/103
9,315,955 B2 * 4/2016 Knapp ..... E01C 23/0933
9,382,674 B1 7/2016 Knapp
9,476,169 B1 * 10/2016 Knapp ..... E01C 19/41
9,527,140 B2 * 12/2016 Kern ..... B23B 39/14
2006/0127179 A1 * 6/2006 Nadler ..... E01C 11/14 404/47
2008/0142270 A1 * 6/2008 Haglund ..... E21B 7/025 175/162
2009/0060655 A1 * 3/2009 Nadler ..... E01C 11/14 404/52
2010/0215449 A1 * 8/2010 Kern ..... B23B 39/14 408/1 R
2012/0160476 A1 * 6/2012 Bakken ..... E21B 31/005 166/177.6
2013/0269268 A1 * 10/2013 Thiessen ..... E21B 15/00 52/118
2014/0083774 A1 * 3/2014 Hoult ..... E21B 15/003 175/52
2017/0165763 A1 * 6/2017 Kern ..... B23B 39/14

* cited by examiner

CARRIAGE SUSPENDED CONCRETE DRILL GANG ASSEMBLY

CROSS-REFERENCE TO RELATED APPLICATIONS

This application is a continuation in part of U.S. patent application Ser. No. 14/180,081, filed Feb. 13, 2014, the disclosure of which is hereby incorporated herein in its entirety by reference.

BACKGROUND OF THE INVENTION

Field of the Invention

The present invention is directed to a machine for drilling doweling holes into the side of a concrete slab for joining freshly poured concrete to an edge of an existing concrete slab.

Background of the Invention

With reference to the section of road 1 as shown in FIG. 1, a common practice for repairing damaged sections of concrete slabs 2 forming the lanes 3 of a road is to cut out and remove a damaged section and pour and finish a concrete patch in the remaining hole. The area around lateral control joints 5 formed in the slabs 2 which have degraded over time are areas that are commonly in need of repair. The concrete slab 2 forming a road is typically poured as a generally continuous slab. The slab may be approximately nine to twelve inches thick or thicker. Slabs forming airport runways may be approximately two feet thick. Saw cuts are then cut into the slab 2, commonly about one third of the thickness of the pavement, to provide an area of weakness at which cracks will naturally form in the slab 2. Longitudinal joints 6 are formed longitudinally along the slab 2 to separate adjacent lanes 3 and the lanes from the shoulder 7. Lanes 3 that are typically twelve feet wide. Lateral control joints 5 are formed laterally across the slab 2 typically approximately fifteen feet apart.

Damage at the lateral control joints 5, typically starts with chipping and spawling of the edges of the joint 5, forming a small depression which then grows as tires continuously pound against the defect and water seeps into the cracks therein and freezes further expanding the defects. Over time cracks will also form extending outward from the joint 5. In addition, cracks may form across the slab between control joints 5 which is more common when the spacing between control joints 5 is increased, such as for example thirty foot spacings.

A typical procedure for repairing a slab having a degraded control joint 5 is to cut out and remove a specified amount of the concrete slab 2 on either side of the degraded joint 5. The width of the slab to be removed may vary depending on specifications established by the jurisdiction in charge of the road repair. Typically, the jurisdiction or owner will specify removing at least two to three feet of the concrete slab 2 on either side of the joint 5 and in some cases up to approximately five feet on either side of the joint 5.

In repairs, two parallel, lateral cuts 11 are made through the concrete slab outward from the crack on opposite sides the distance specified. Parallel, longitudinal cuts 12 are also made between the lane 3 in which the slab section to be removed is located and the adjacent lane 3 and between it and the shoulder 7. A typical lane width is twelve feet and therefore the parallel longitudinal cuts 12 are typically made approximately twelve feet apart. Holes 14 are then drilled in the fragmented section to be removed. Expansion pins are then inserted into the holes and expanded to lock the pins in the holes. The pins are connected together by a harness that is then lifted with an excavator or the like to lift the pins and the fragmented section connected thereto from the rest of the concrete roadway or slab 2 to leave a hole 15, or repair hole, in the roadway to be filled with a patch (not shown). The hole 15 will typically span the entire width of a lane 3, which as discussed previously is typically 12 feet wide.

After the fragmented section is removed, concrete is poured in the resulting hole 15 to form the patch which is leveled and finished to present a relative smooth upper surface planarly aligned with the surrounding slab 2. The concrete patch is joined to the existing slab 2 by a plurality of dowels (not shown) which typically are metal. The dowels are inserted in holes 21 bored in the sides of the slab 2 surrounding the hole 15 for the patch. For a hole 15 extending the width of a lane 3, generally when repairing lateral joints 5, the dowel holes 21 are typically formed in the opposingly facing, laterally extending edges or faces 23 and 24. When repairing longitudinal joints 7, or when the hole 15 is long enough, dowel holes 21 may also be formed in longitudinally extending edges or faces 25 and 26.

The number and spacing of the dowels and therefore the dowel holes 21 is generally set by specifications established by the jurisdiction responsible for maintaining the road being repaired. For example, a jurisdiction may require the dowels to be spaced one foot apart across the length and width of the repair hole 15. Other jurisdictions may require dowels to be positioned only along the portion of the lane 3 over which the tires of vehicles traveling on the lane 3 generally traverse. In such cases, the specification may require three dowels spaced one foot apart starting one foot in from one side of the lane 3 and another three dowels spaced one foot apart starting one foot in from an opposite side of the lane 3. Spacing of the dowels other than one foot apart may be specified.

The size or diameter of the dowels may also vary depending on the specification with common diameters of 1 inch or 1½ inches. The depth of the hole 21 bored into the slab 2 may also vary per specification, and is typically nine to ten inches deep.

Devices have been developed for supporting a plurality of pneumatic drills in spaced relation and aligned so that the drill bits drill into a slab on a common plane and can be positioned to bore holes at a common height. One example of a previously disclosed drilling device is shown in U.S. Pat. No. 5,540,292 which includes a plurality of pneumatic drills mounted on one side or end of a mobile frame. The operator drives the machine along an edge or to the side of a face of a slab into which holes are to be drilled. The machine must be repositioned if the drills are to be used to drill holes into a face oriented in an opposite direction.

It is also known to mount a frame supporting a plurality of pneumatic drills on the a skid steer loader or related equipment and then move the skid steer loader to position the frame and the drills in to position to drill horizontal bores. U.S. Pat. No. 4,417,628 shows an example of such a configuration.

Road patching operations, particularly in and around cities, often must be completed between evening and morning rush hours while maintaining at least one lane in each direction open to traffic. The time required to drill the holes 21 for the dowels in the edges 23 and 24 or 25 and 26 of the slab 2 surrounding the hole 15 to be filled with concrete is a significant limiting factor as to the number of fragmented slab sections that can be repaired in the time allotted. Existing drilling equipment requires considerable time to reposition to face the in the opposite direction and is difficult to maneuver to reposition the drills in an opposite direction particularly when confined to a single lane of traffic.

There remains a need for a system for expediting the process of making the necessary dowel holes 21 in slab repair projects.

SUMMARY OF THE INVENTION

The present invention is directed to a mobile drilling machine for boring holes into vertical faces of a slab. More specifically the drilling machine is adapted for drilling dowel holes into the faces of a slab surrounding a hole from which a section of the slab has been removed. The slab may be a road, parking lot or the like typically formed from concrete or other plastic materials. The drilling machine may also be used for boring holes in other rock like material or natural stone. In one example, the drilling machine may be used to repair sections of a road degraded around lateral control joints or longitudinal joints such as those formed between slabs forming adjacent lanes of the road. The mobile drilling machine comprises a main frame which may be mounted to a truck frame with front and rear sets of wheels for supporting the main frame above the slab. A drill gang assembly is supported at a lower end of a mast which is telescopingly and rotatably mounted relative to the drilling machine main frame so that the drill gang assembly may rotate at least one hundred and eighty degrees about a vertical mast axis. The drill gang assembly includes a drill support frame supporting a plurality of drills in parallel spaced alignment therebelow. In one contemplated embodiment the drill support frame supports approximately ten drills therebelow. The number of drills mounted on the drill support frame may be varied depending upon the specifications as to the number of holes to be drilled in each face of the slab. The drill support frame is preferably pivotally mounted about a horizontal axis relative to the mast so that the drills may be oriented at an angle relative to a horizontal axis.

In one embodiment, each drill is a hammer drill or a rotary hammer drill which may be pneumatically or hydraulically actuated. It is foreseen that other types of drills could be used with drill bits adapted to bore into concrete or other material used to form slabs or paved slabs. Each drill is mounted on a carrier sleeve supported on a rail and advanceable forward and rearward by a pneumatic actuator. The drill is advanced forward by the pneumatic actuator for advancing the drill bit into a slab. If the drill bit becomes stuck, such as on reinforcing mesh or the like embedded in the concrete a pair of hydraulic actuators connected to a breaker bar may be activated to engage the carrier sleeves of all of the drills and simultaneously retract all of the drill bits from the holes they have bored under relatively large pressures. The drill gang assembly may also utilize a vibrating shaker bar positioned in closely spaced relation around the drill bits and selectively vibratable to vibrate the drill bits to aid in releasing the drill bits from the holes if they become stuck therein.

A plurality of insulating panels may be mounted on the drill support frame and flexible seals are formed around lower edges of the drill support frame to help hold down dust and reduce the noise emanating from the drills in use. In addition, a water spray assembly may be incorporated into each drill assembly to spray water around the drill bit proximate its entry into the slab.

Frame support jacks with wheels rotatably mounted at lower ends thereof are connected to the frame of the mobile drilling machine to allow the mobile drilling machine to traverse a repair hole formed in the slab while traveling longitudinally down a single lane of a road. Construction crews can thereby avoid having to close off more than one lane of traffic to bore dowel holes into the sides of the slab around the repair hole. A pair of front rolling frame support jacks are connected to the drilling machine frame in front of the rear wheels and a pair of rear rolling frame support jacks are connected to the drilling machine frame rearward of the rear wheels. In one embodiment the front jacks are mounted on the drilling machine frame between the front and rear wheels, the drill gang assembly is connected to a portion of the main frame projecting rearward from the rear wheels and the rear jacks are connected to the main frame rearward of the drill gang assembly and the rear wheels.

In use, the mobile drilling machine is advanced longitudinally along the slab in the lane in which the repair hole is formed until the front wheels of the mobile drilling machine extend proximate to a first side of the repair hole. The drill gang assembly, which is normally oriented lengthwise along the longitudinal axis of the truck, is rotated ninety degrees so as to extend transverse to the longitudinal axis of the truck. The front frame support jacks are then extended to engage the slab to support the front end of the drilling machine frame at a relatively constant height above the slab. The drilling machine is advanced longitudinally along the slab until the front wheel has passed over the repair hole in the slab. The rear frame support jacks are then extended to engage the slab to support the rear end of the drilling machine frame at a relatively constant height above the slab. The drilling machine is then advanced longitudinally along the slab until the rear wheels pass over the repair hole and further until the drill gang assembly is positioned over the repair hole.

The drill support frame and drills on the drill gang assembly are then lowered until the drills are positioned in a desired vertical spacing relative to the front or rear face of the slab surrounding the repair hole. The drills are then operated to bore dowel holes into a first of the front or rear faces of the slab. Once the holes are bored to a desired depth, the drills are removed from the bores and the drill gang assembly is raised until the drills and drill support frame are raised out of the repair hole in the slab. The drill gang assembly is then rotated approximately one hundred and eighty degrees until the drills are oriented toward a second of the front or rear faces of the slab adjacent the repair hole and then lowered until the drills are positioned at a desired vertical spacing relative to the second of the front or rear faces of the slab. The drills are then operated to bore dowel holes into the second of the front or rear faces of the slab. Once the second set of holes are bored, the drills are removed thereform and the drill gang assembly is raised the raise the drill support frame drills out of the repair hole in the slab.

The front and rear jacks help stabilize the main frame of the drilling machine and lift the main frame off of the trucks suspension so that the height of the main frame relative to the slab remains generally constant during the drilling procedure. It is to be understood, that the front and rear jacks can be raised as they are separately advanced across the repair hole so that the wheels on the jacks do not hit and damage the far edge of the repair hole as the jack is moving thereacross.

If the next repair hole around which dowel holes are to be drilled is located close to the repair hole in which dowel holes were just drilled, then the front and rear jacks may be left in the extended position as the mobile drilling machine moves to the next repair hole. If the distance between repair holes is relatively large, the front and rear jacks may be raised before moving the mobile drilling machine to the next set of holes.

In another embodiment of the drilling machine, the drilling machine frame may be self-propelled and supported on laterally telescoping wheels. When the wheels are retracted relative to the frame, the spacing between outer edges of the wheels, as well as the width of the frame are narrower than the width of a lane of a road so that the drilling machine may advance or be legally towed on the road. The wheels of the drilling machine telescope laterally and can be extended so that the spacing between inner edges of the wheels is wider than a lane of a road with a hole formed therein with the sides of the slab surrounding the hole presenting surfaces into which dowel holes are to be bored. The wheels of the drilling machine can therefore travel on adjacent lanes or on a shoulder adjacent the lane so that the wheels do not drop into the hole as the drill gang assembly is advanced over the hole.

In an alternative embodiment, the mast is telescopingly secured within a support tube and is rotatable three hundred and sixty degrees relative to the support tube. The support tube and mast are preferably mounted vertically on a slide plate that is slidably mounted on the drilling machine frame. An actuator is operable to slide the slide plate and attached mast and mast support tube laterally relative to the drilling machine frame. The drills forming the drill gang assembly can be oriented in any direction relative to the mast axis with the drill bits directed at any of the surfaces of the slab surrounding the hole, including the front, rear and side surfaces. The mast can be slid laterally relative to the drilling machine frame and the hole in the slab to position the drill bits, when properly oriented, against either of the side faces of the slab surrounding the hole.

DETAILED DESCRIPTION OF THE PREFERRED EMBODIMENTS

As required, detailed embodiments of the present invention are disclosed herein; however, it is to be understood that the disclosed embodiments are merely exemplary of the invention, which may be embodied in various forms. Therefore, specific structural and functional details disclosed herein are not to be interpreted as limiting, but merely as a basis for the claims and as a representative basis for teaching one skilled in the art to variously employ the present invention in virtually any appropriately detailed structure. The drawings constitute a part of this specification and include exemplary embodiments of the present invention and illustrate various objects and features thereof.

Figure 1:
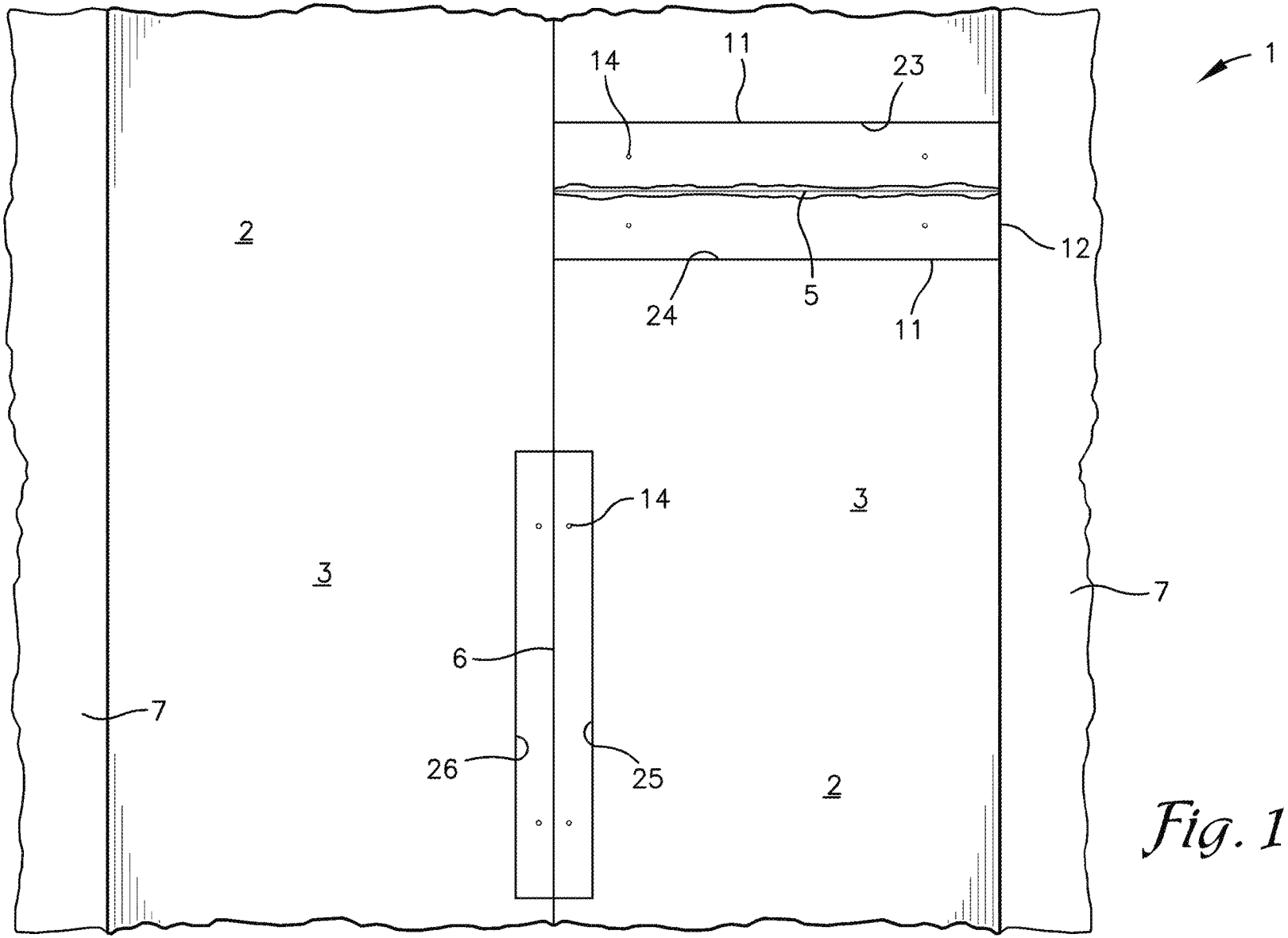
FIG. 1 is a diagrammatic top view of a section of roadway formed as a slab and divided into lanes and a shoulder and in which saw cuts and bore holes have been made.
Figure 2:
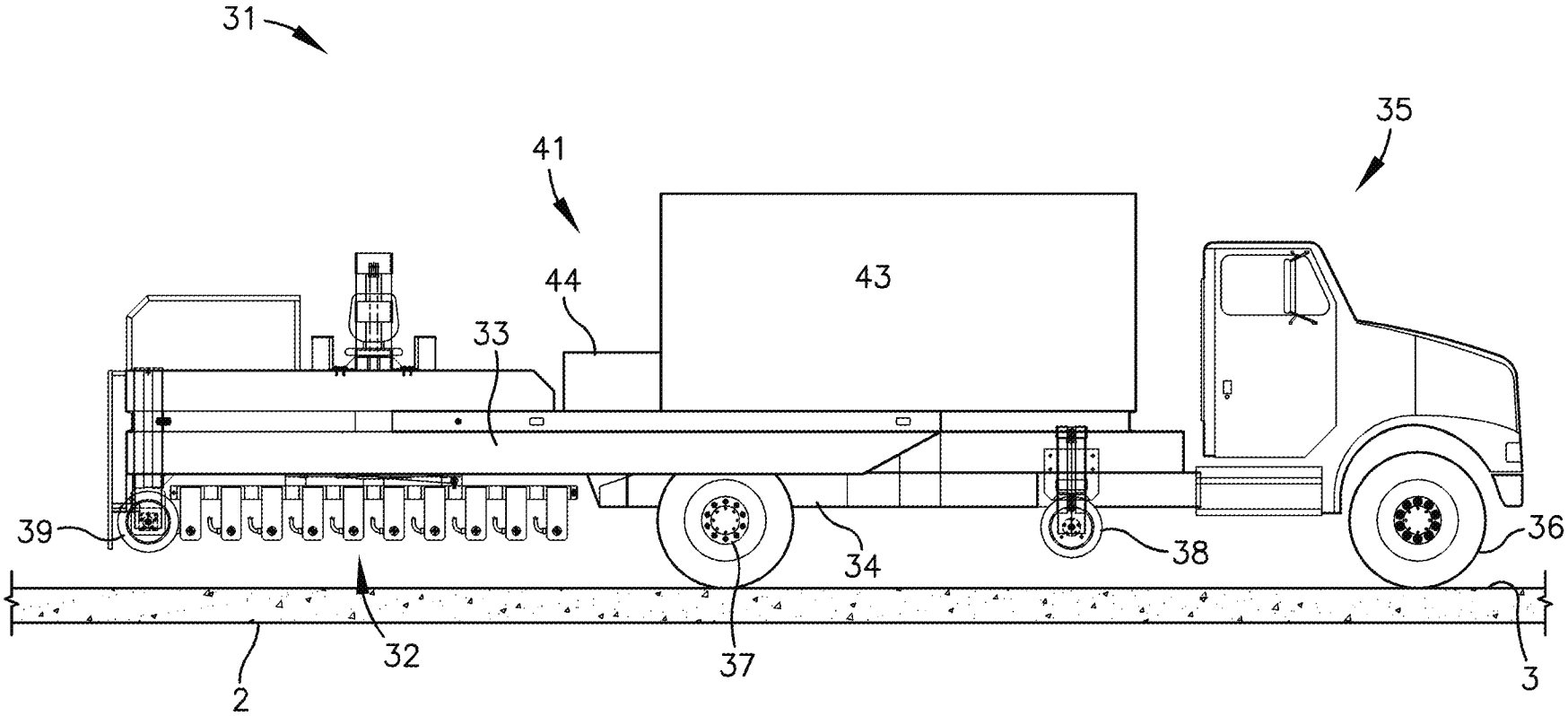
FIG. 2 is a side elevational view of a drilling machine mounted on a truck frame and adapted for drilling dowel receiving holes in the slab shown in a transport mode with a drill gang assembly shown raised and oriented sideways for traveling down the roadway.

With initial reference to FIG. 2, the reference number 31 generally designates a mobile drilling machine for boring holes into sides of a section of a slab 2 and particularly for boring holes into a second of a slab 2 from which a degraded section of concrete has been removed from a lane 3 of a road. When describing the drilling machine 31 herein, directional references are generally made with reference to the direction of travel of the mobile drilling machine 31 along a lane 3 of the road in the intended direction of traffic thereon. In addition references to "horizontal" or "vertical" structure or features is intended to refer to the general orientation of the structure when the drilling machine 31 is supported on a horizontal surface such as a slab 2 or lane 3 of a road. The drilling machine 31 includes a drill gang assembly 32 telescopingly and rotatably mounted on a main frame 33 which, in the embodiment shown, is mounted to the longitudinally extending frame 34 of a truck or tractor 35 such that the drilling machine is supported, in a cantilevered fashion, behind the truck frame 34. It is also foreseen that the drilling machine 31 could be constructed as a trailer to be towed behind a tow vehicle 35.

In the embodiment shown, the truck 35 is a conventional truck or tractor unit with a pair of front wheels 36 and a pair of rear, drive wheels 37. Drilling machine 31 includes front telescoping wheel assemblies or front wheeled jacks 38 mounted on truck frame 34, between front and rear wheels 36 and 37, and rear telescoping wheel assemblies or rear wheeled jacks 39 mounted on and at a rear end of the drilling machine main frame 33. The front and rear telescoping wheel assemblies 38 and 39 are extendable to support the drilling machine 31 and the truck 35 to permit the drilling machine 31 to traverse holes 15 in the slab 2 while traveling longitudinally along a lane 3 in which the holes 15 are formed.

A power supply assembly 41 is mounted on the drilling machine main frame 33 over the truck frame 34 and with its center of mass in front of the rear wheels 37 of the truck 35 and serve in part as a counterbalance to the weight of the drill gang assembly 32 supported behind the truck frame 34. The power supply assembly 41 includes a compressed air supply assembly 43, and a hydraulic fluid supply assembly 44. The compressed air supply assembly 43 may include an air compressor and a compressed air reservoir or tank. The hydraulic fluid supply assembly 44 may include a pump and a reservoir for hydraulic fluid. A gas or diesel engine and a fuel tank are preferably incorporated into the power supply assembly and mounted on frame 33 for driving the compressor and pump. It is foreseen that the compressor and pump could be driven by the truck engine as well or separate engines for the compressor and pump could be provided.

Figure 10:
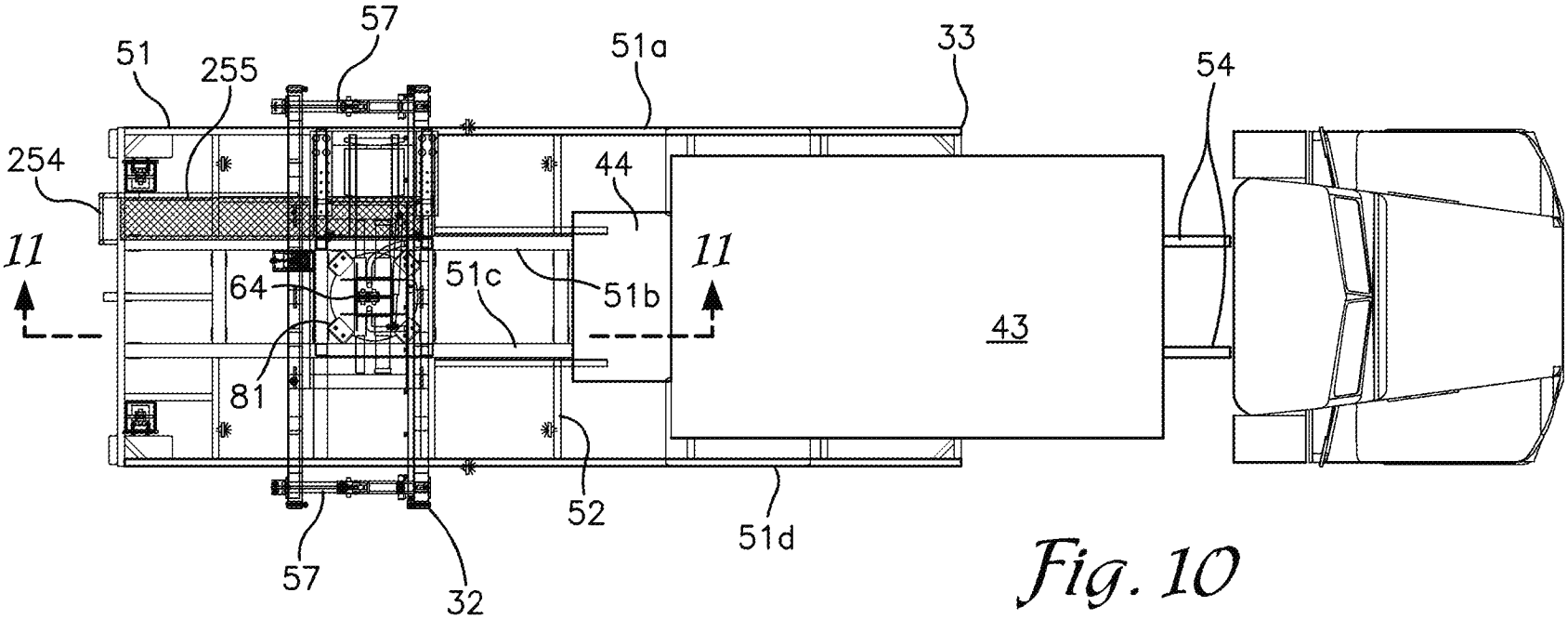
FIG. 10 is a top view of the drilling machine mounted on the truck frame showing two out of ten drill assemblies mounted on a drill support frame for purposes of clarity.
Figure 24:
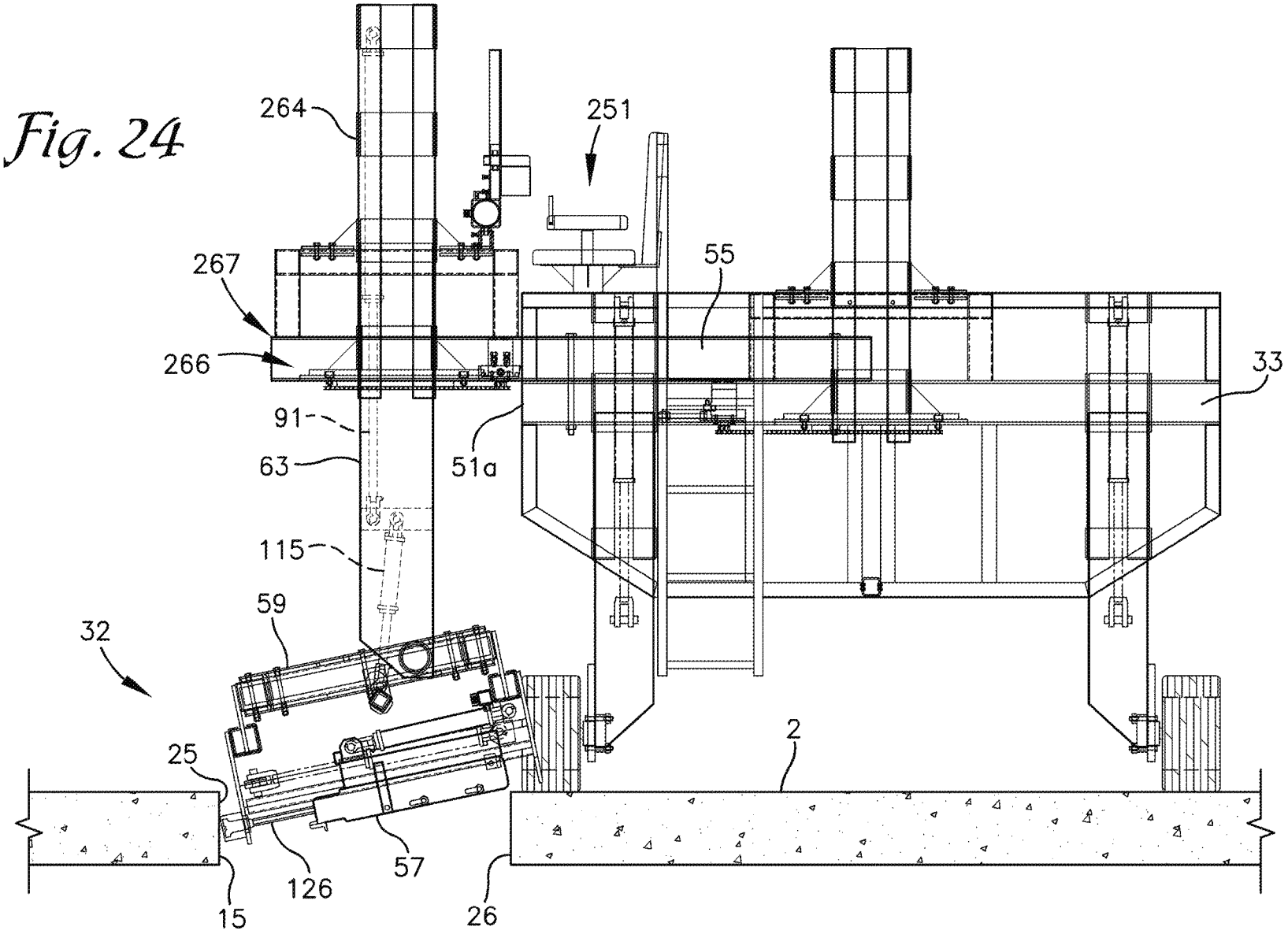
FIG. 24 is a rear view of the drilling machine showing the drill gang assembly supported on an auxiliary frame extending to the side of the main frame with the drill support frame angled relative to the mast to permit drilling at an angle relative to a hole in the slab.
Figure 25:
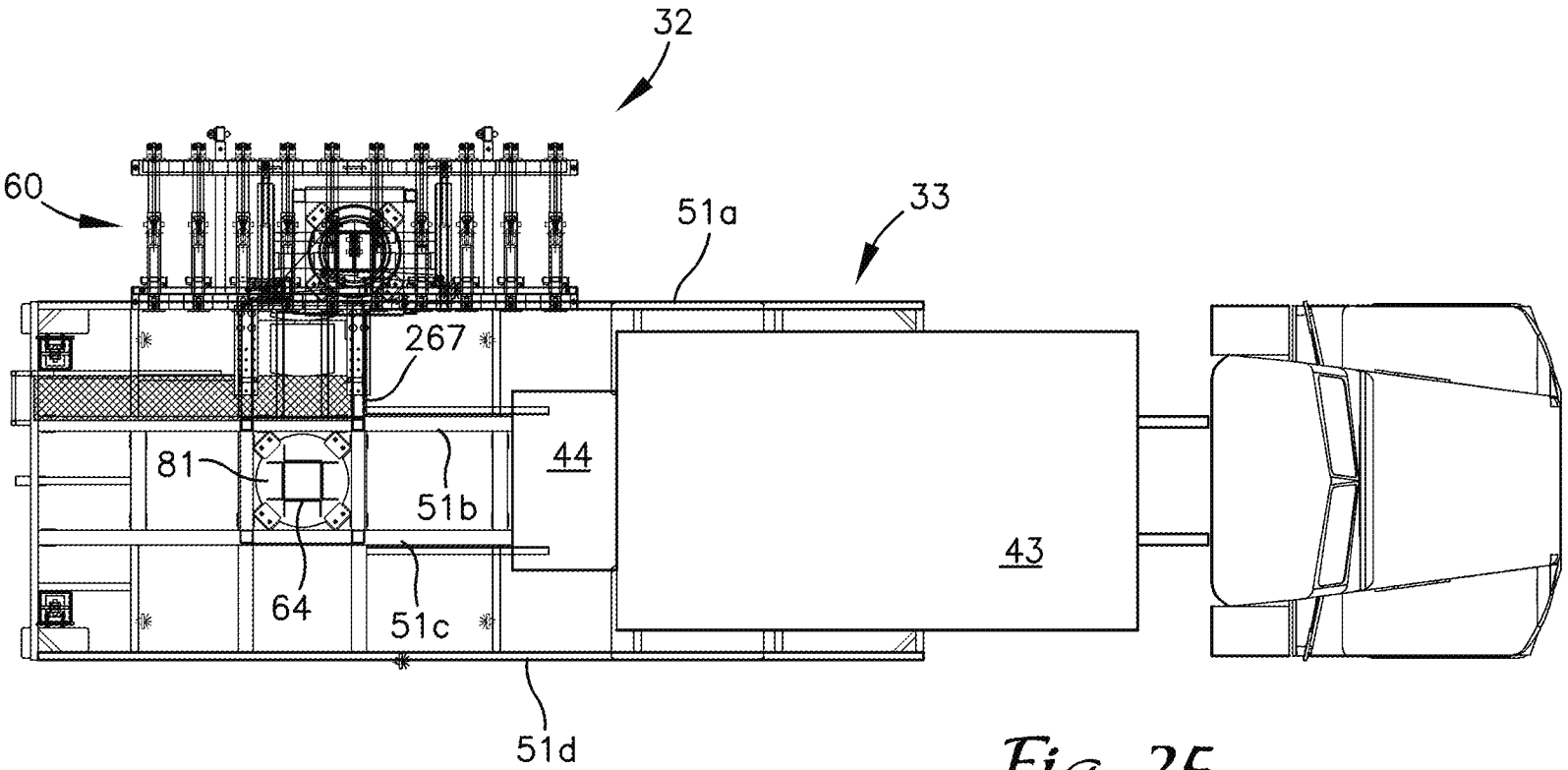
FIG. 25 is a top plan view of the drilling machine with the drill gang assembly supported on the auxiliary frame extending to the side of the main frame.

As best seen in FIG. 10, main frame 33, of the embodiment shown, is formed from four longitudinal beams 51 interconnected in parallel spaced relationship by a plurality of cross-members or beams 52 extending in parallel spaced relation along the length of the main frame 33. Inner longitudinal beams 51*b* and 51*c* are supported on and fixedly secured to the longitudinal frame members 54 of the truck frame 34. Outer longitudinal beams 51*a* and 51*d* extend along and form the outer sides of the main frame 33. The drill gang assembly 32 may be mounted to the main frame 33 centrally between inner longitudinal beams 51*b* and 51*c* and a pair of cross-members 52 behind the truck frame 34 when the drill gang assembly 32 is to be used to bore holes into laterally extending edges 23 cut in the slab 2. Alternatively, the drill gang assembly 32 may be mounted to auxiliary frame members 55, as shown in FIGS. 24 and 25, extending to one side of the main frame 33 when the drill gang assembly 32 is to be used to bore holes into longitudinally extending edges 25 and 26. A drill gang assembly 32 is shown attached to one side of main frame 33 in phantom lines in FIG. 10.

The drill gang assembly 32 comprises a plurality of drills 57 mounted on drill carriers 58 which are removably connected to a drill support frame 59. The drills 57 in the embodiment shown are pneumatically operated rotary hammer drills adapted for boring holes in concrete. It is to be understood that hydraulically operate drills could also be used or drills other than hammer type drills could be used. The combination of a drill 57 and a drill carrier 58 may be referred to as a drill assembly 60.

Figure 11:
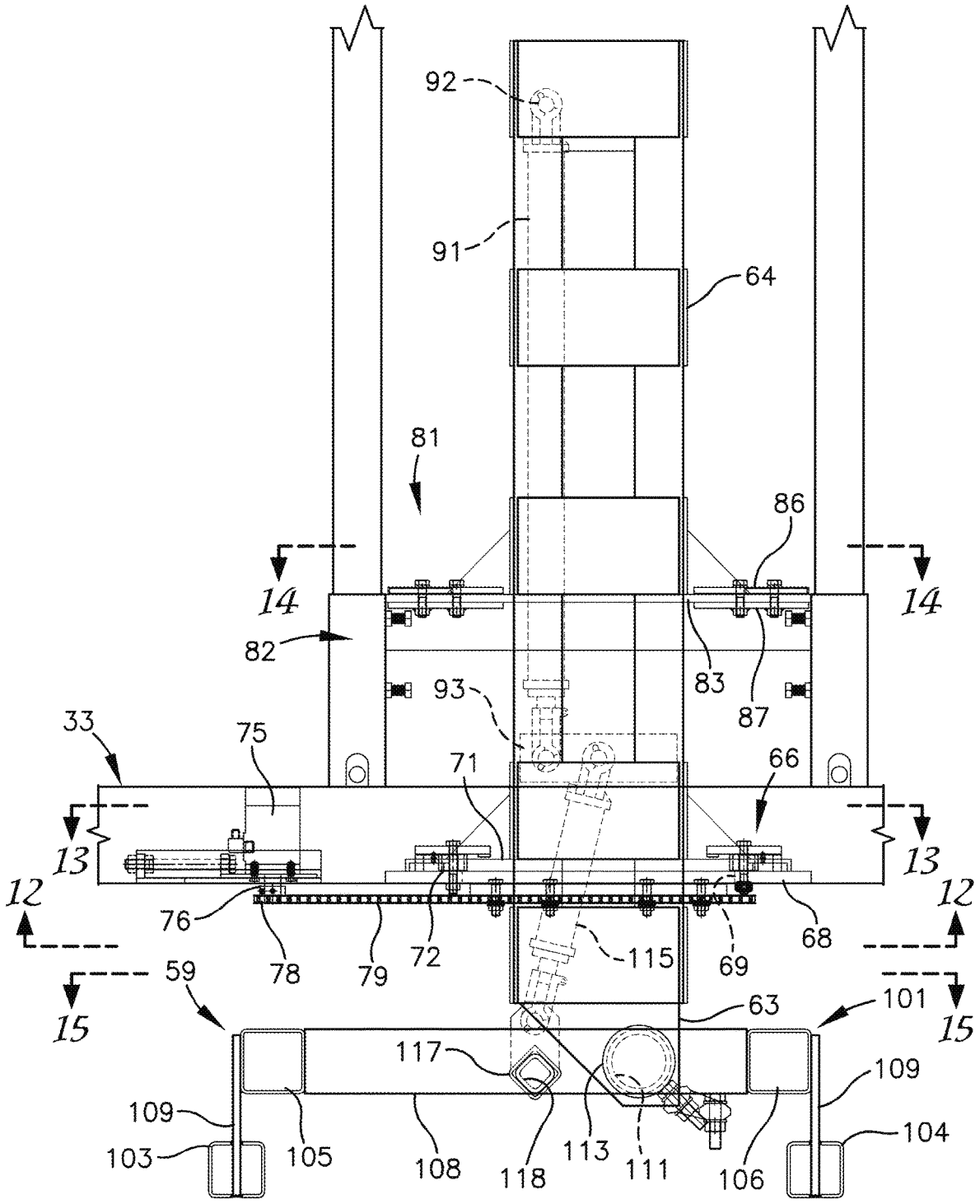
FIG. 11 is a fragmentary cross-sectional view taken generally along line 11-11 of FIG. 10 showing a drill support frame of the drill gang assembly connected to a lower end of a mast which is rotatably and telescopingly connected to the main frame of the drilling machine.
Figure 12:
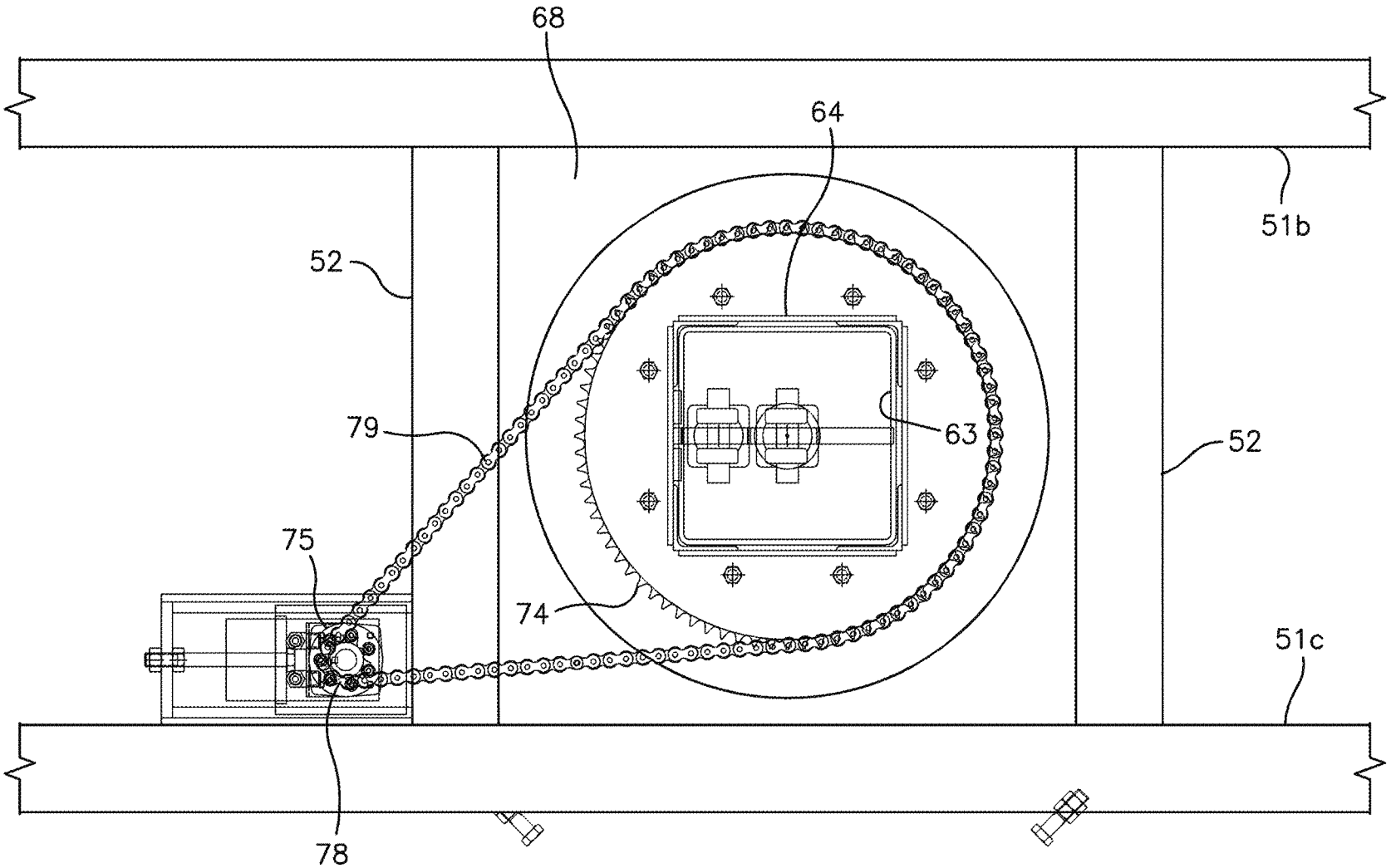
FIG. 12 is a fragmentary cross-sectional view taken generally along line 12-12 of FIG. 11.
Figure 22:
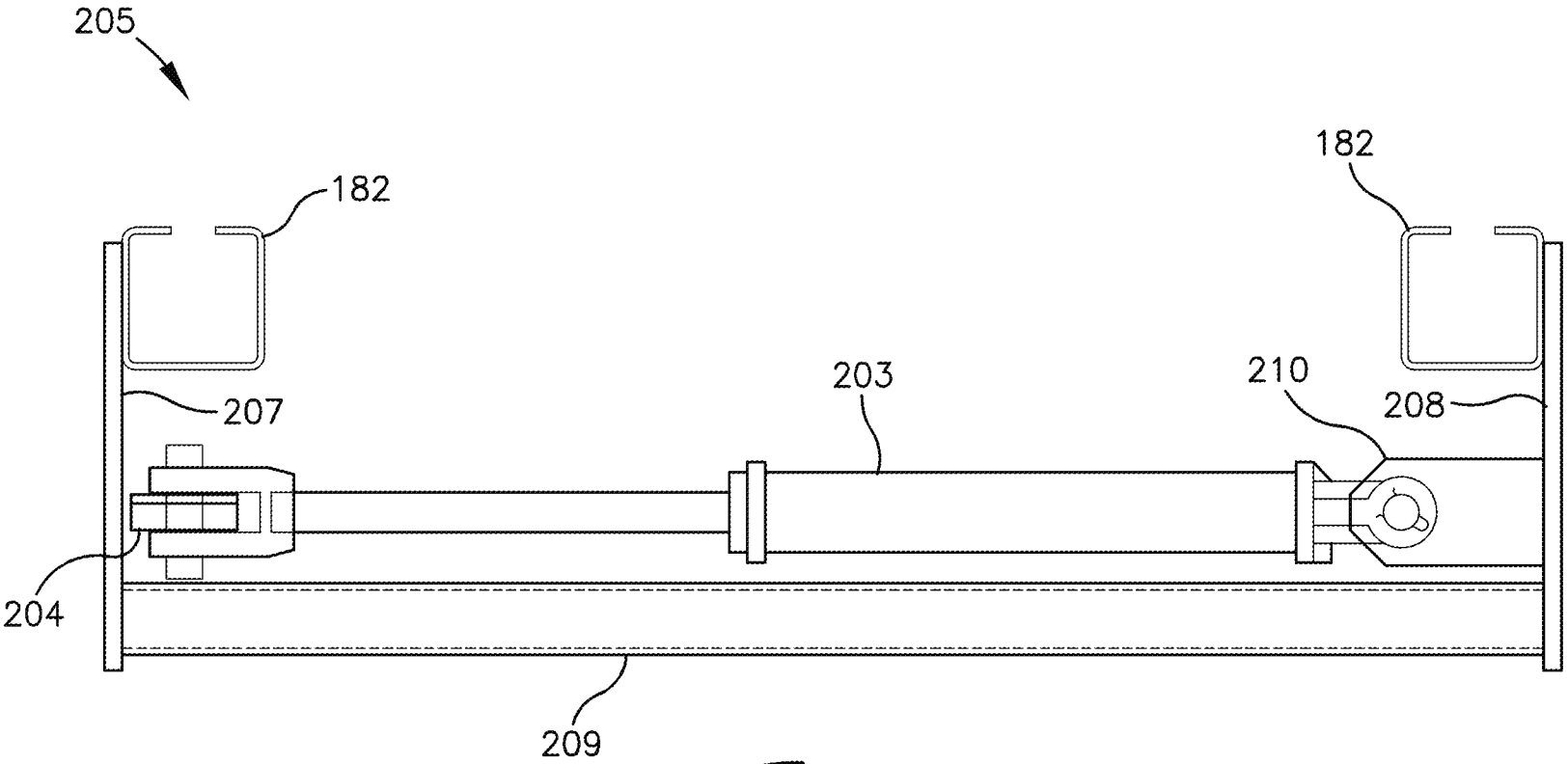
FIG. 22 is a side view of a portion of the breaker bar assembly taken generally along line 22-22 of FIG. 17.

Referring to FIGS. 11 and 22, the drill support frame 59 is pivotally connected, about a horizontal axis, to a lower end of a mast or inner, vertically telescoping tube 63. Mast 63 is telescopingly received within an outer support tube 64 which is rotatably mounted to the main frame 33 by a turntable assembly 66. In the embodiment shown, the mast 63 and outer support tube 64 are square in cross section.

Figure 13:
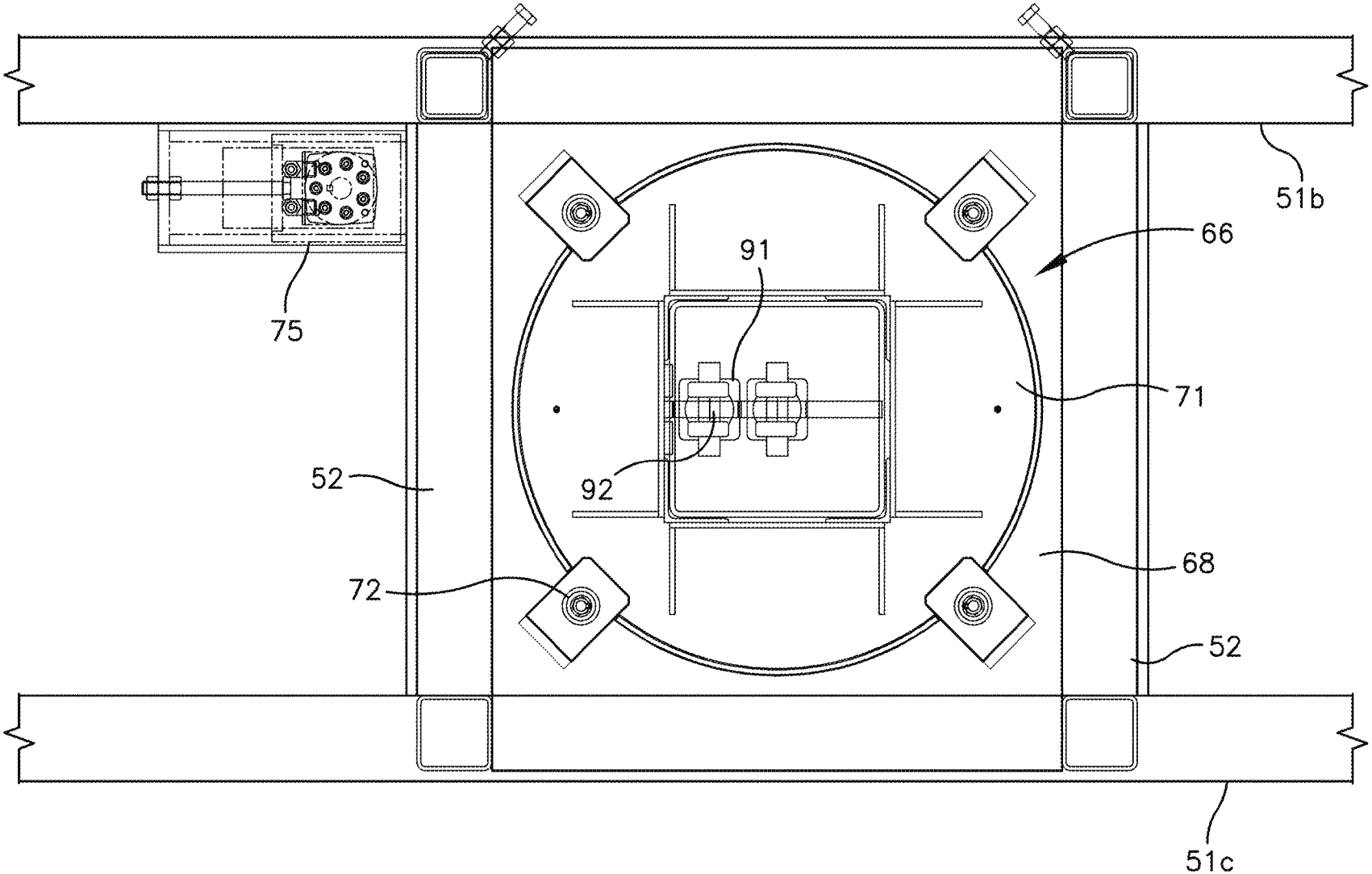
FIG. 13 is a fragmentary, cross-sectional view taken generally along line 13-13 of FIG. 11.

The outer support tube 64 and turntable assembly 66 are supported on a support plate 68 welded between inner longitudinal beams 51*b* and 51*c* and adjacent cross-members 52. As best seen in FIG. 13, a circular opening 69 is formed through the support plate 68 for extension of a lower end of the outer support tube 64 and the mast 63 therethrough. A circular support flange 71 is formed on and projects radially outward from the outer support tube 64 above support plate 68. Support flange 71 is slightly wider in diameter than opening 69 such that outer edges of circular support flange 71 are supported on support plate 68 around opening 69. Roller bearings 72 are mounted on an upper surface of the support plate 68 in spaced relation to engage the outer periphery of the circular support flange 71 to maintain the support flange 71 and the outer support tube 64 axially centered relative to the opening 69.

A sprocket or sprocket flange 74 projects radially outward from the outer support tube 64 proximate a lower end thereof which extends just below the support plate 68. A hydraulic motor 75 is mounted on one of the cross-members 52 such as the cross member 52 extending at the rear end of support plate 68. The motor 75 as shown is mounted on a side of cross member 52 opposite support plate 68 and turntable assembly 66. A drive shaft 76 of motor 75 extends below the cross-member 52 and below support plate 68 and a drive sprocket or gear 78 is mounted on a distal end of the drive shaft 76. A chain 79 connects the drive sprocket 78 to the sprocket flange 74 on outer support tube 64. Activation of motor 75 results in rotation of the outer support tube 64 and attached drill gang assembly 32 about a vertical axis and relative to support plate 68 and main frame 33. The outer support tube 64 preferably is rotatable three hundred and sixty degrees relative to the main frame to permit an operator to change the direction the drills 57 face for drilling holes in 21 in surfaces facing different directions relative to the orientation of the drilling machine 31. It is to be understood that the rotatability of the drill gang assembly 32 about the vertical axis may be limited to approximately one hundred and eighty degrees while still allowing the drills 57 to face towards opposed faces or laterally extending edges 23 and 24 or 25 and 26 of the slab 2 adjacent a hole 15 in which concrete is to be poured.

Figure 14:
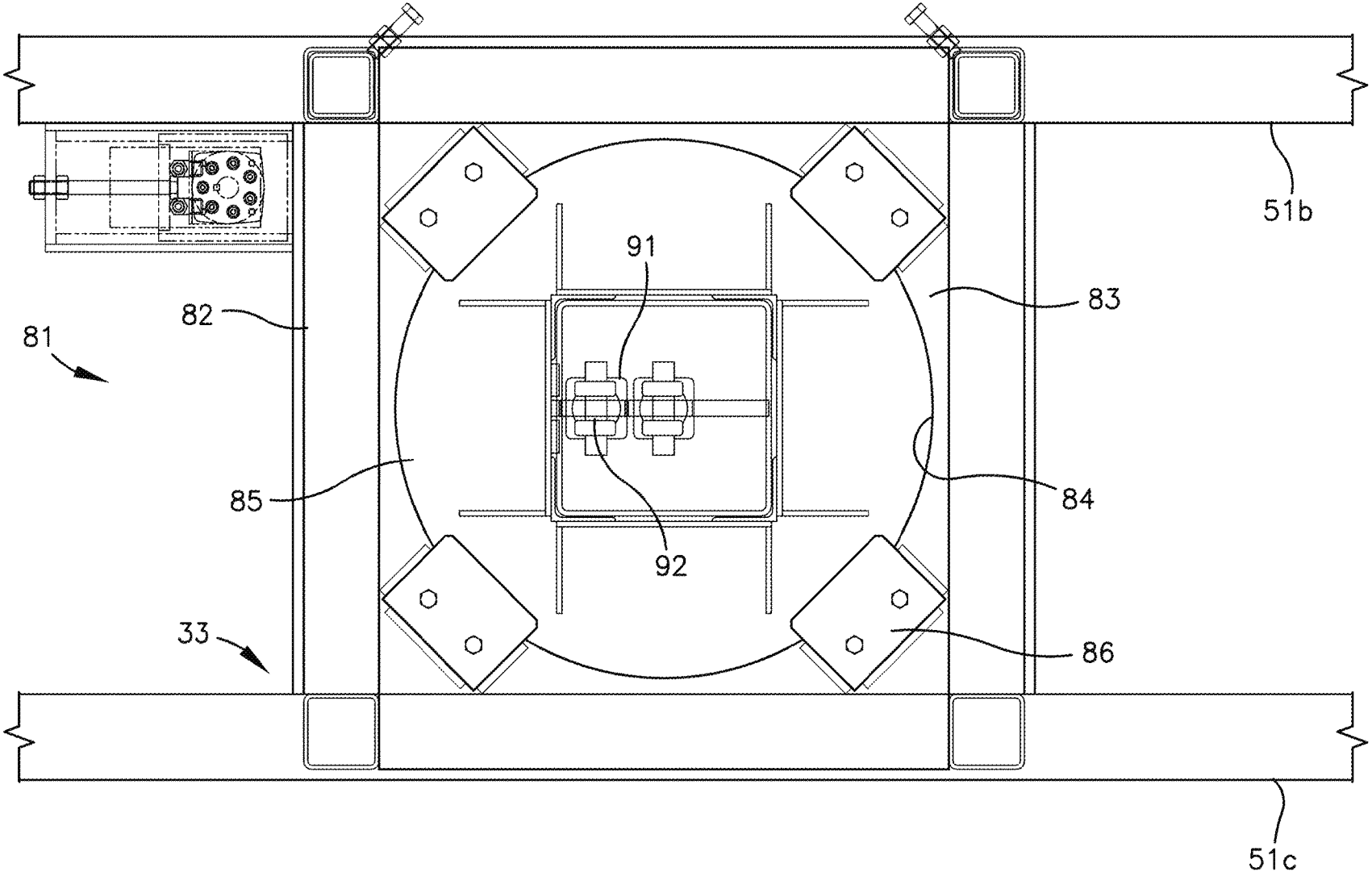
FIG. 14 is a fragmentary, cross-sectional view taken generally along line 14-14 of FIG. 11.

As best seen in FIGS. 11 and 14, a secondary support assembly 81 mounted on main frame 33 and extending above turntable assembly 66 restrains outer support tube 64 from tilting relative to support plate 68. A support frame assembly 82 is connected to and projects upward from the inner longitudinal beams 51*b* and 51*c* adjacent outer support tube 64. An upper, lateral support plate 83 is welded to the support frame assembly 82 in parallel spaced relation above the lateral support plate 68. A circular hole 84 is formed in and extends through the lateral support plate 68 and sized for extension of the outer support tube therethrough. A circular flange 85 projects radially outward from the outer support tube at the same height as the lateral support plate 83 and within the circular hole 84. The diameter of the circular flange 85 is slightly smaller than the diameter of the circular hole 84 in lateral support plate 68. Upper and lower annular restraints 86 and 87, each having an inner diameter that is smaller than the diameter of the circular flange 85 are bolted to the lateral support plate 68 around circular hole 84 and in overlapping and closely spaced relationship with the circular flange 85. The circular flange 85 is free to rotate between the upper and lower annular restraints 86 and 87 which function to restrain the circular flange 85 from tilting relative to support plate 68 and therefore restrains the outer support tube 64 from tilting relative to main frame 33.

Mast or inner tube 63 is slidably mounted within outer tube 64 and connected thereto by hydraulic cylinder or linear actuator 91 which is operable to extend and retract mast 63 relative to outer tube 64. Linear actuator 91 is connected at an upper end to a mount 92 formed on an inner surface of the outer tube 64 proximate an upper end thereof and at a lower end to a bracket 93 extending between opposed sides of mast or inner tube 63. Extension and retraction of actuator 91 lowers and raises the drill gang assembly 32 including drills 57 relative to the slab 2 on which the drilling machine 31 is positioned and relative to a hole 15 to be patched to position the drills 57 at a desired height for boring dowel holes 21 in a face of the patch hole 15.

The drill support frame 59 includes a base frame 101 pivotally connected to a lower end of mast 63 and a pair of drilling assembly support bars or beams, or front and rear drilling assembly support beams 103 and 104 suspended from base frame 101. Base frame 101 includes front and rear frame members 105 and 106 and side frame members 107 and 108 welded together in a rectangular configuration. The front and rear drilling assembly support beams 103 and 104 are formed from square tubing and are suspended below the front and rear frame members 105 and 106 in parallel spaced relation by support members or straps 109. In the embodiment shown, the support straps 109 are formed from relatively narrow metal plates oriented widthwise along a central longitudinal axis of the drilling assembly support beams 103 and 104. Slots are formed through each support beam 103 and 104 and a support strap 109 extends through the slots and the upper and lower walls of the support beam 103 and 104 are welded to the straps 109 such that the support straps 109 support the beams 103 and 104 below front and rear frame members 105 and 106 respectively. The support straps 109 are considerably narrower than the width of the support beams 103 and 104 to which they are attached to present support surfaces on the upper surface of each support beam 103 and 104 on both sides of the support straps 109.

Figure 15:
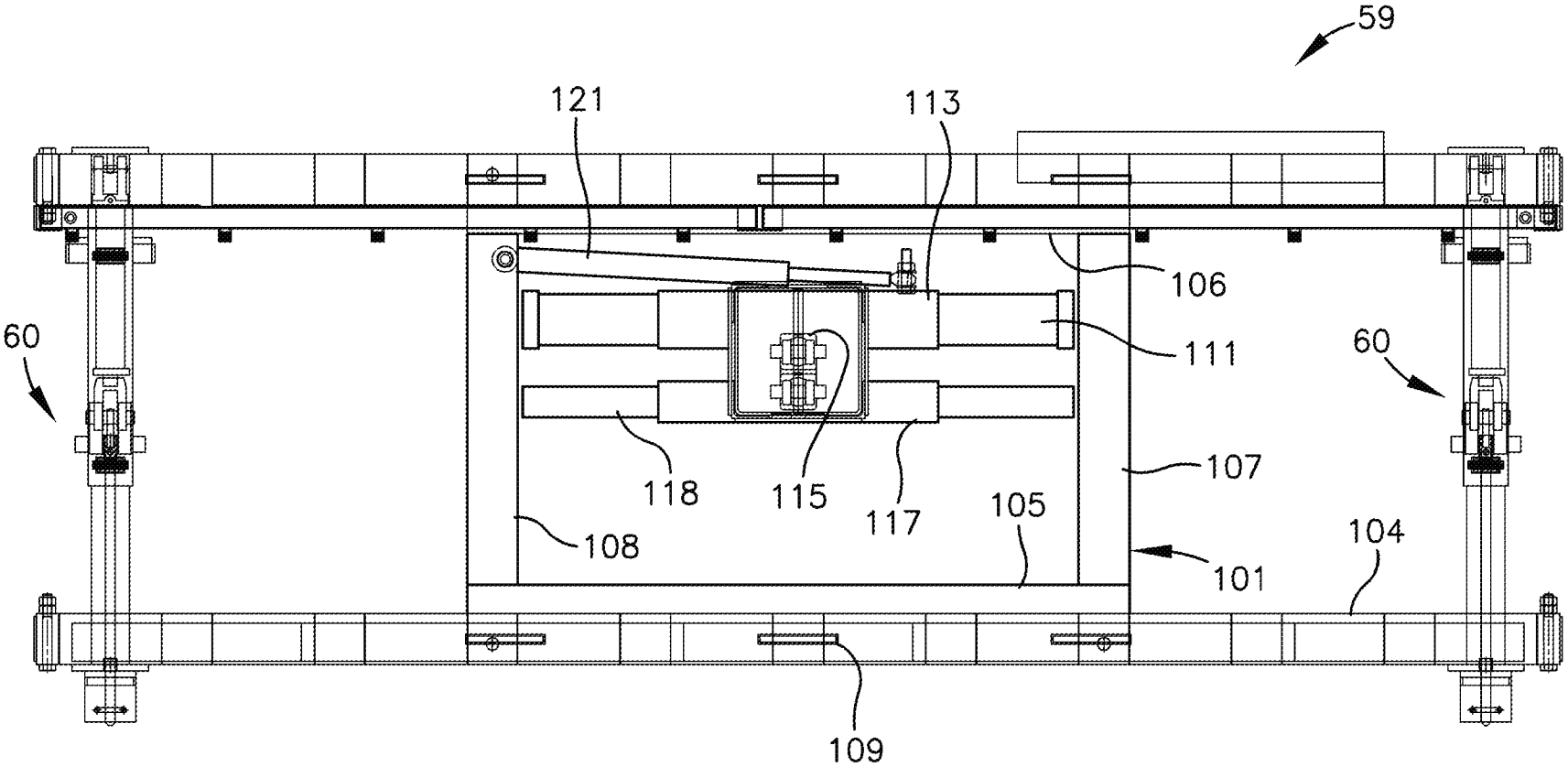
FIG. 15 is a fragmentary, cross-sectional view taken generally along line 15-15 of FIG. 11 and showing two out of ten drill assemblies mounted on the drill support frame on opposite ends thereof for purposes of clarity.
Figure 16:
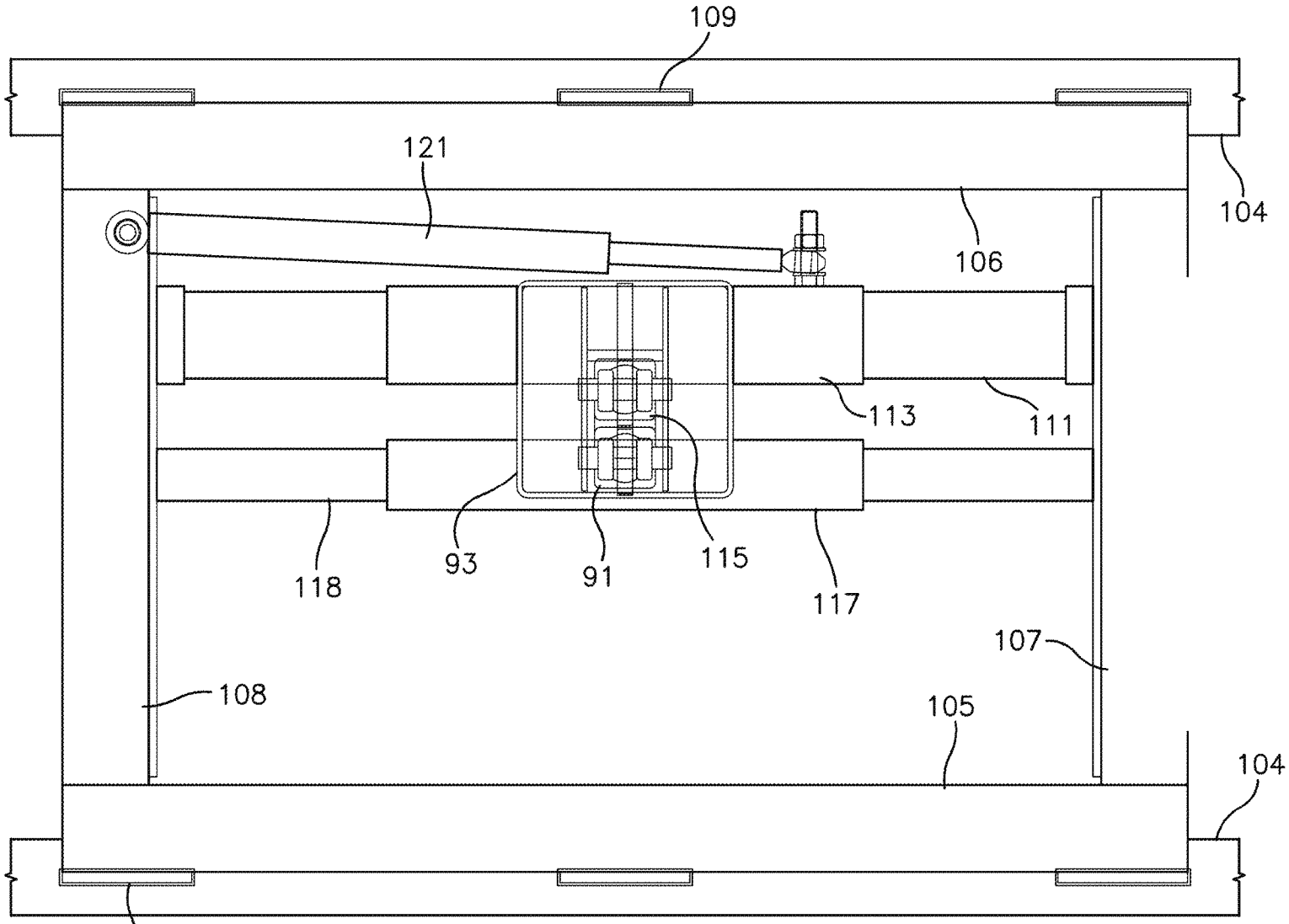
FIG. 16 is an enlarged and fragmentary view of the view as shown in FIG. 15.

As best seen in FIGS. 11, 15 and 16, the base frame 101 further includes a pivot shaft 111, which is circular in cross-section connected to and extending between side frame members 107 and 108 in parallel spaced relation between the front and rear frame members 105 and 106 but closer to rear frame member 106. A bearing sleeve 113 which is circular in cross section and shorter than pivot shaft 111 is mounted to the bottom of the mast 63. Pivot shaft 111 extends through bearing sleeve 113 and freely rotates about a horizontal axis through the bearing sleeve which connects the base frame 101 to the mast 63 while permitting the base frame 101 to pivot about a horizontal axis relative to mast 63.

A linear or hydraulic actuator 115 is connected between the bracket 93 inside of mast 63 and the base frame 101 of drill gang assembly 32 to pivot the base frame 101 and drill gang assembly 32 relative to the mast 63. An upper end of actuator 115 is pivotally connected to bracket 93 and a lower end of the actuator 115 is pivotally connected to a support tube 117 which is slidably mounted on a support bar 118 connected to and extending between side frame members 107 and 108 of the base frame 101. The support bar 118 extends in parallel spaced relation to the front and rear frame members 105 and 106 generally centrally therebetween and in spaced relation in front of pivot shaft 111. Extension of actuator 115 pivots the front of the drill gang assembly 32 downward relative to the mast 63 and retraction of actuator 115 pivots the drill gang assembly 32 upward relative to mast 63. In the embodiment shown, the support bar 118 and support tube 117 are both formed of square tubing, with the tubing forming support tube 117 being slightly larger than the tubing forming support bar 118.

Another hydraulic or linear actuator 121 is connected between one of the side frame members, member 107 in the embodiment shown, and the pivot bearing sleeve 113 which supports the pivot shaft 111. The pivot bearing sleeve 113 is shorter than the pivot shaft 111 and the support tube 117 is shorter than the support bar 118 such that extension and retraction of the actuator 121 causes the base frame 101 and attached drilling assemblies 60 to slide laterally relative to the mast 63. Lateral movement of the base frame 101 relative to the mast 63 allows lateral adjustment of the positioning of the drills 57 relative to the main frame 33 and relative to an edge of a hole 15 or sides of the slab adjacent the hole 15 for a patch in which dowel holes 21 are to be drilled.

Figure 18:
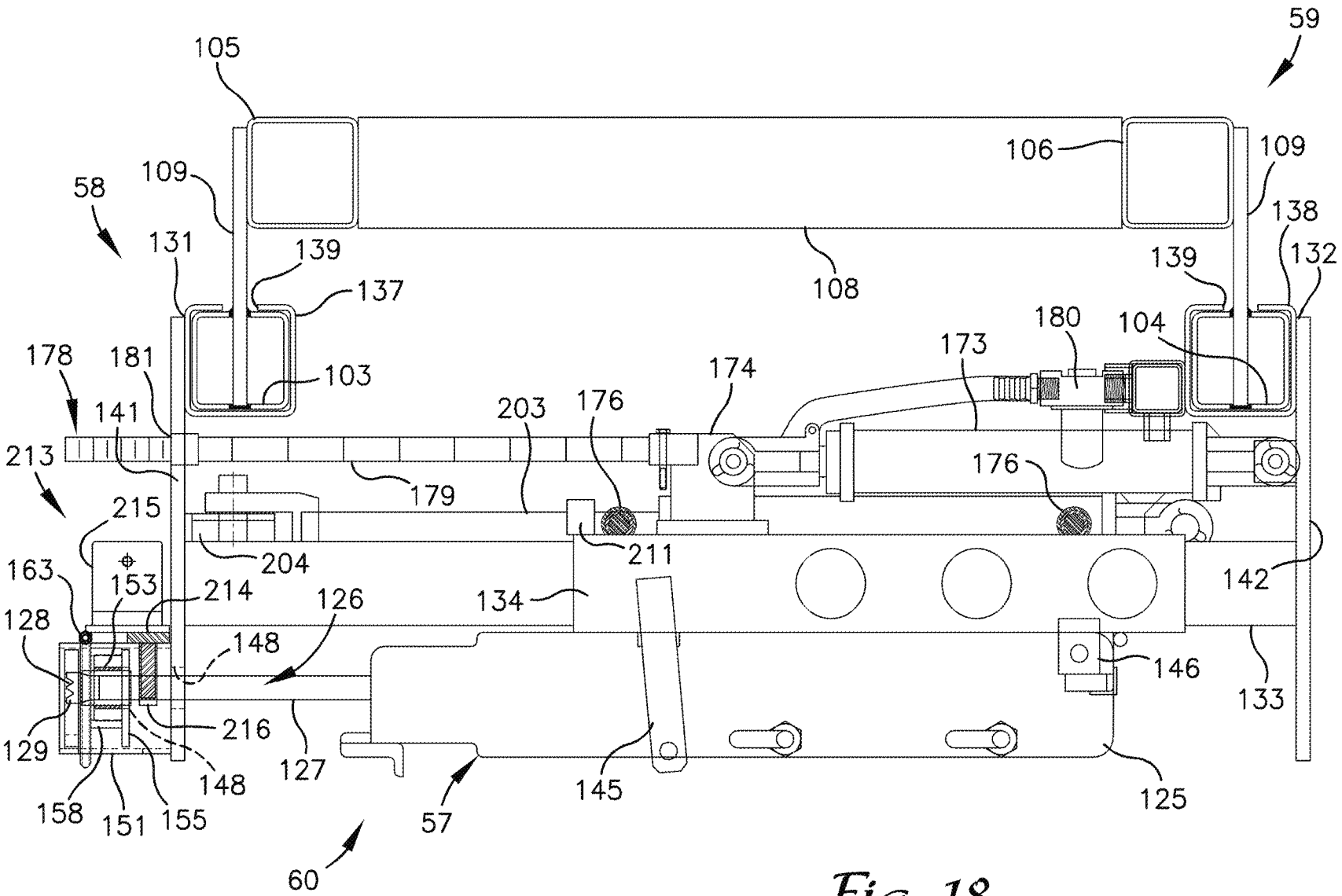
FIG. 18 is a cross-sectional view of the drill gang assembly taken generally along line 18-18 of FIG. 17.
Figure 19:
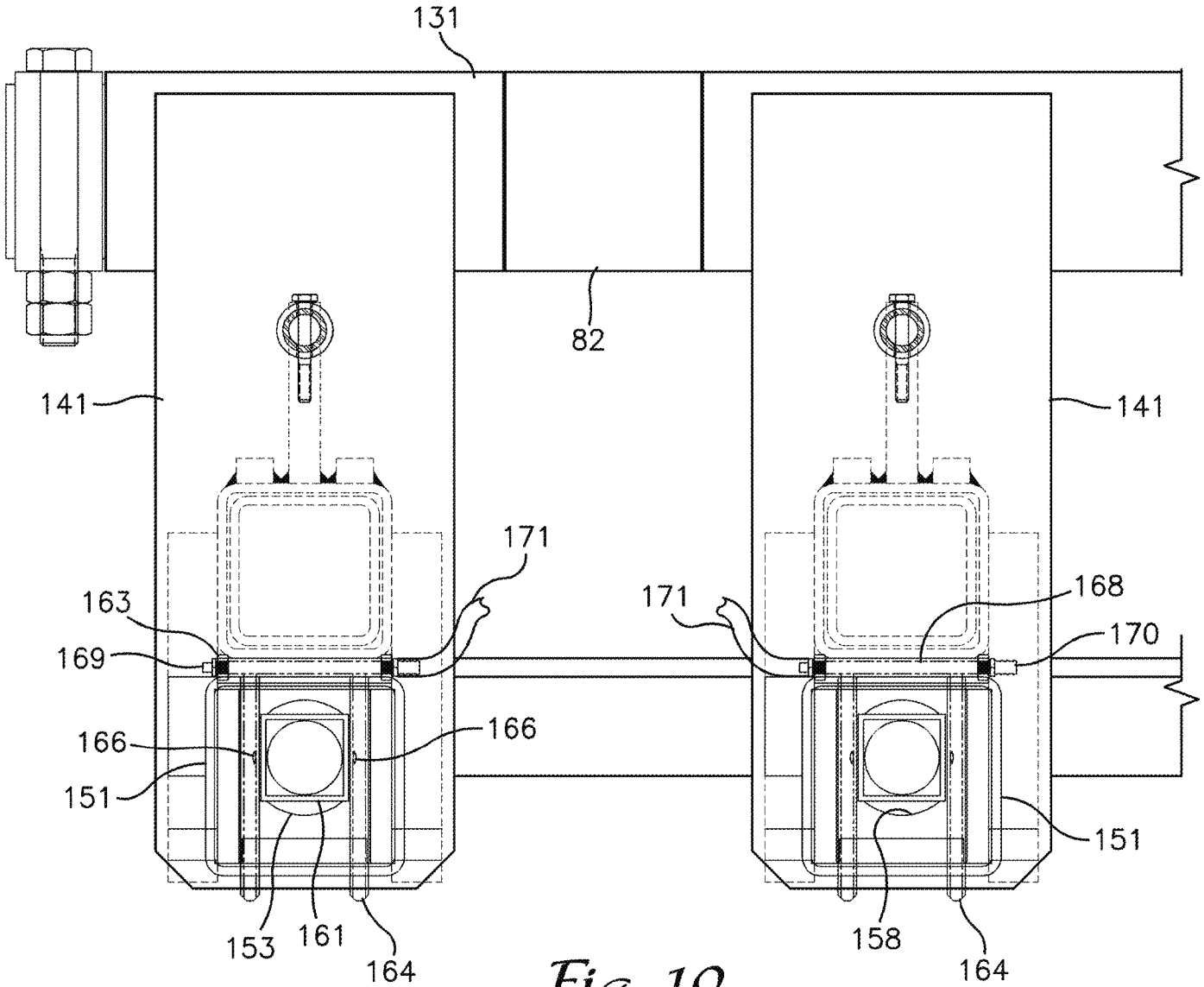
FIG. 19 is an enlarged and fragmentary, elevational view of the front of the drill gang assembly with drill bits for the drills removed.
Figure 20:
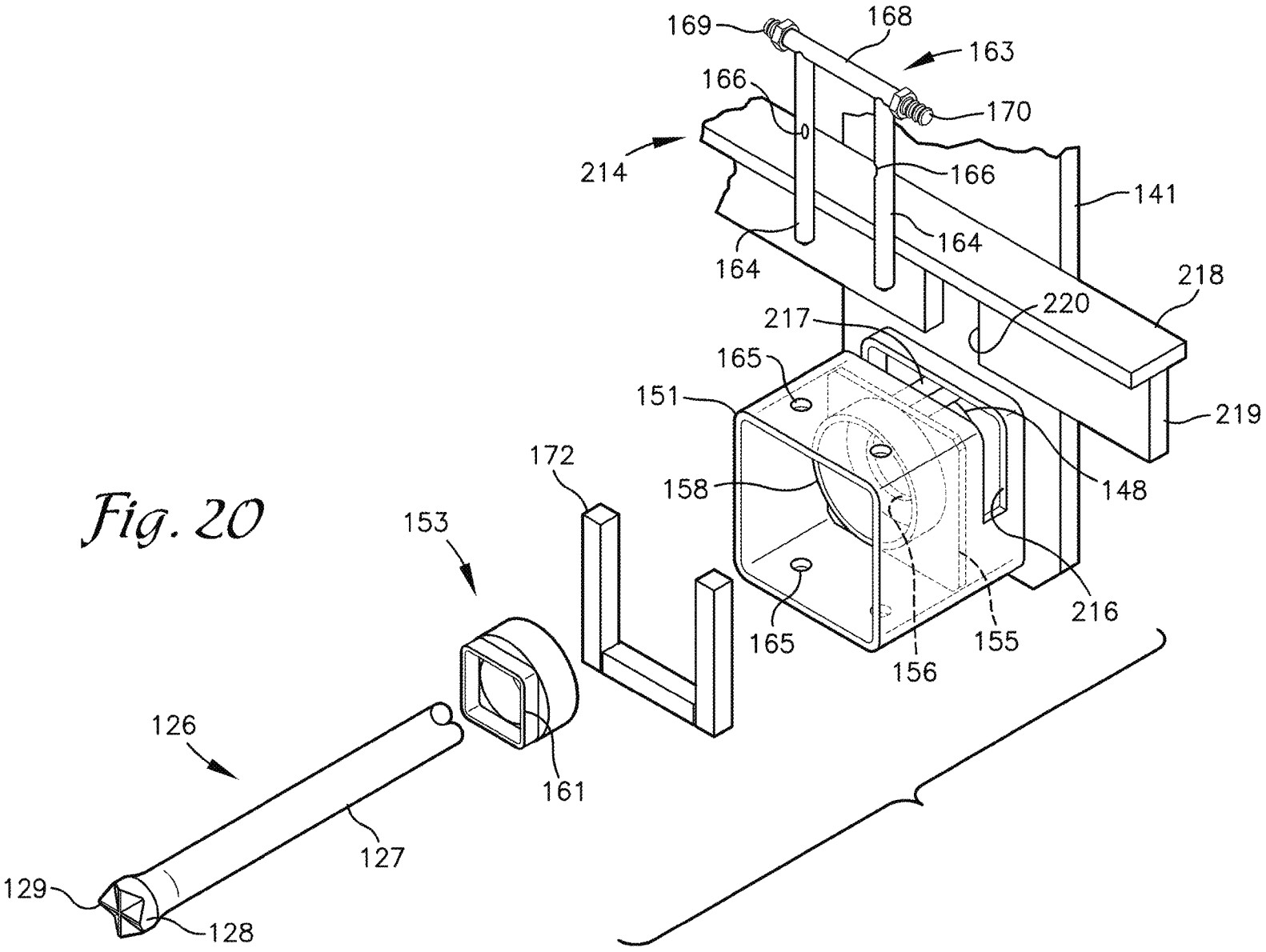
FIG. 20 is an enlarged and fragmentary, exploded, front perspective view of a drill assembly.

Referring to FIGS. 18-20, each drilling assembly 60, includes a drill 57 mounted on a drill carrier 58. As discussed previously, the drill 57 is a conventional pneumatic drill including a pneumatic actuator assembly enclosed in an actuator housing or motor housing 125 and a drill bit 126 connected to and extending outward from the housing. Drill bit 126 includes a stem 127 with an enlarged head 128 with teeth 129 at a distal end for chipping concrete as the actuator is oscillated back and forth by the actuator assembly. Compressed air to operate the drills 57 is supplied from air compressor 43 through hoses (not shown). The drill carrier 58 includes front and rear hangers 131 and 132 with a drill carrier guide rail 133 extending therebetween and a carrier tube 134 slidably mounted on the guide rail 133. As used herein, the front of the drill gang assembly 32 is the side of the drill gang assembly 32 to which the heads 128 of the drill bits 126 extend.

Hangers 131 and 132 include front and rear hanger sleeves 137 and 138 which slide over and onto the front and rear drilling assembly support bars 103 and 104 respectively. A slot 139 may be formed centrally in an upper surface of the hanger sleeves 137 and 138 to allow the hanger sleeves 137 and 138 to slide past the support straps 109. Front and rear guide rail support straps 141 and 142 depend from the front and rear hanger sleeves 137 and 138 respectively. Front and rear ends of guide rail 133 are welded to inner surfaces of front and rear guide rail support straps 141 and 142.

The actuator housing 125 for a drill 57 is supported below the carrier tube 134 by a cradle 145 supporting a front of the actuator housing 125 and a yoke 146 bolted to a rear of the actuator housing 125. A distal end of the drill bit 126 including the head 128 extends through a drill bit hole 148 formed in the front guide rail support strap 141 below the guide rail 133. A drill bit shroud or collar 151 is mounted on and projects forward of the front guide rail support strap 141 around the distal end of the drill bit 126 when the drill is retracted as discussed in more detail hereafter.

In the embodiment shown, the drill bit shroud 151 is formed from a length of square tubing welded to the front of front rail guide support strap 141 and centered around drill bit hole 148. An annular drill bit guide 153 with a guide hole 154 extending therethrough is removably mounted within the shroud 151 in a guide support assembly 152. A guide support assembly 152 includes an inner wall 155 extending transverse to an axis of the drill bit stem 126 with a hole 156 formed in the inner wall 155 to permit passage of the drill bit stem 126 therethrough. A drill bit guide support collar 158 is welded to the front of the inner wall 155 and in axial alignment around the hole 156 formed therein. The drill bit guide support collar 158 is sized slightly larger in diameter than the drill bit guide 153 such that the drill bit guide 153 fits in the collar 158 with the guide hole 154 aligned with the hole 156 in inner wall 155. A lower edge of the drill bit stem 127 or head 128 rests on an inner surface of the drill bit guide 153 to support the drill bit 126 and provide a wear surface.

A square lip 161 is formed on and projects outward from a front face of the annular drill bit guide 153. When the drill bit guide 153 is inserted in the support collar 158, the square lip 161 extends forward of a distal end of collar 158. A U-shaped locking pin or clip 163 with spaced apart legs 164 is used to hold the drill bit guide 153 in support collar 158. The drill bit guide 153 is rotatable until two sides are vertically oriented, with four different orientations of the guide 153 possible at ninety degree increments. The legs 164 of the locking pin 163 are then inserted through aligned holes 165 in top and bottom walls of the shroud 151 to extend on opposite sides of the vertically oriented sides of the square lip 161. The legs 164 of pin 163 abut against portions of the front face of guide 153 that extend radially outward from the square lip 161 to prevent removal of the guide 153 from support collar 158. Because the guide 153 can be oriented in four different orientations, four different wear surfaces are available which increases the useful life of the guide 153. It is to be understood that increasing the number of parallel sides of the lip 161 will increase the number of wear surfaces available on the inner surface of the guide 153. For example a hexagonal shaped lip will provide six wear surfaces.

In one embodiment, as shown, the clip 163 and legs 164 may be hollow with one or more outlets 166 formed in each leg 164 to extend in alignment with a horizontal diameter of the drill bit head 128. Hollow legs 164 are connected in flow communication to a hollow, tubular cross-member 168. Inlet and outlet nipples 169 and 170 are mounted on opposite ends of the cross-member for connection of tubing 171 thereto to deliver water under pressure to the clip 163 and legs 164. The outlets 166 are angled or oriented to point inward toward the drill bit head 128 and slightly outward, past the lip 161 on the guide 153 and toward the surface of the concrete in which a hole 21 is to be bored by the drill 57. Water flowing to the clip 163 is sprayed out the outlets 166 towards the drill bit head 128 to help lubricate and cool the drill bit head 128 to reduce its operating temperature and towards the concrete to help knock down dust produced in the drilling operation. A U-shaped weldment 172 may be welded into the front of drill bit shroud 151 to provide structural support.

As best seen in FIG. 18, a pneumatic cylinder or other type of linear actuator 173 is connected at a rear end to the rear guide rail support strap 142 above guide rail 133 and a front end to a collar or mount 174 projecting upward from the drill carrier tube 134. Extension of the actuator 173 slides the carrier tube 134 and attached drill 57 forward along guide rail 133 advancing the drill bit head 128 forward relative to the front of the drill carrier 58. A pair of rollers 176 are each rotatably mounted on a shaft welded to an upper surface of the carrier tube 134. The rollers 176 each extend through a slot formed in an upper wall of the carrier tube 134 and engage the guide rail 133 to facilitate sliding or rolling of the carrier tube relative thereto.

A depth gauge 178 comprising a ruled rod 179 is connected at a rear end to collar 174 projecting upward from drill carrier tube 134. The ruled rod 179 extends through a hole in the front guide rail support strap 141 in spaced relation above the guide rail 133 and the drill bit 126. The tip of the ruled rod 179 is vertically aligned with the tip of the drill bit head 128. The depth gauge 178 slides back and forth with the carrier tube 134 and attached drill 57. Markings on the ruled rod 179 provide a visual indication to an operator as to the depth that the drill bit 126 has bored into the slab 2. An adjustable sensor, not shown, may be mounted on the cylinder 173 and set to turn off an air supply valve 180, supplying air to the cylinder 173 when the drill bit 126 has extended a set distance from the cylinder 173 corresponding to the depth of the hole to be bored.

When the actuator 173 and carrier tube 134 are in a retracted position, and compressed air is not supplied for operating the drill 57, the distal end of the drill bit head 128 extends just rearward or inside of a distal end of the drill bit shroud 151. At the beginning of a drilling operation, the drill gang assembly 32 is positioned so that the distal end the shrouds 151 surrounding the drill bits 126 are positioned against the surface of the slab 2 into which holes are to be drilled. Both the tip of the drill bit head 128 and the ruled rod 179 are positioned slightly away from the surface. Controls are engaged to supply compressed air to the drill 57 causing a pounding and rotating action of the drill bit head 128 and teeth 129 in the direction of the slab 2. Actuators 173 are operated to provide pressure to and extend the actuators 173 and urge each of the carrier tubes 134 and attached drills 57 toward the slab 2 so that the drill bit 126 moves forward as it chips material away from the slab 2. The drill bit 126 is preferably of the type having a compressed air passageway or conduit 181 formed therein and exiting out the end and one or more sides of the drill bit head 127 to blow the particulate material out of the hole 121 formed by the drill bit 126. The ruled rod 179 is spaced high enough over the drill bit 126 that it advances over the top of the slab 2 as the drill bit 126 bores into the slab 2.

Figure 17:
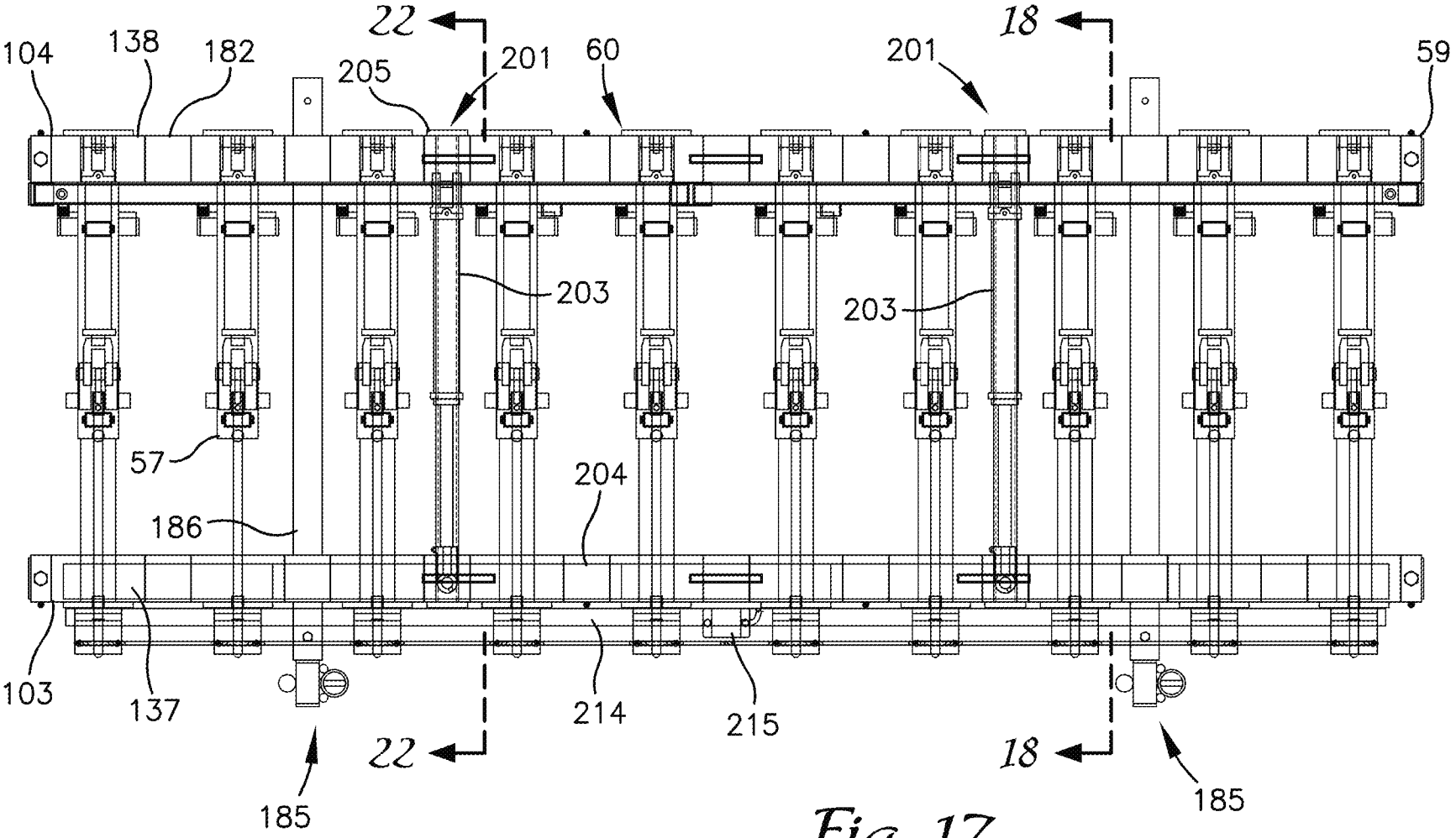
FIG. 17 is an enlarged cross-sectional view of the drill gang assembly taken generally along line 17-17 of FIG. 4 showing ten drill assemblies, a breaker bar assembly, a vibrating assembly and two vertical spacing assemblies mounted on the drill support frame.

In the embodiment shown in FIG. 17, ten drill assemblies 60 have been mounted on the front and rear drilling member support bars 103 and 104 by sliding the front and rear hanger sleeves 137 and 138 onto the front and rear support bars 103 and 104 respectively. Spacer sleeves 182 are slid onto the support bars 103 and 104 between the hanger sleeves 137 and 138 to obtain the desired spacing between drills 57 supported on the support bars 103 and 104. In one embodiment for example, the hanger sleeves 137 and 138 may be eight inches wide with the drill 57 suspended centrally therebelow and the spacer sleeves 182 are four inches wide such that the spacing of adjacent drills 57 supported from pairs of hanger sleeves 137 and 138 with a single spacer sleeve 182 therebetween is twelve inches. It is understood that the number of drill assemblies 60 and the spacing between drill assemblies 60 supported on the drill support frame 59 can be varied in part by varying the number of spacer sleeves 182 used. Spacer sleeves 182 may include a slot extending across an upper wall thereof to allow the spacer sleeve 182 to slide past the support straps 109 suspending front and rear support bars 103 and 104 below front and rear frame members 105 and 106.

Figure 21:
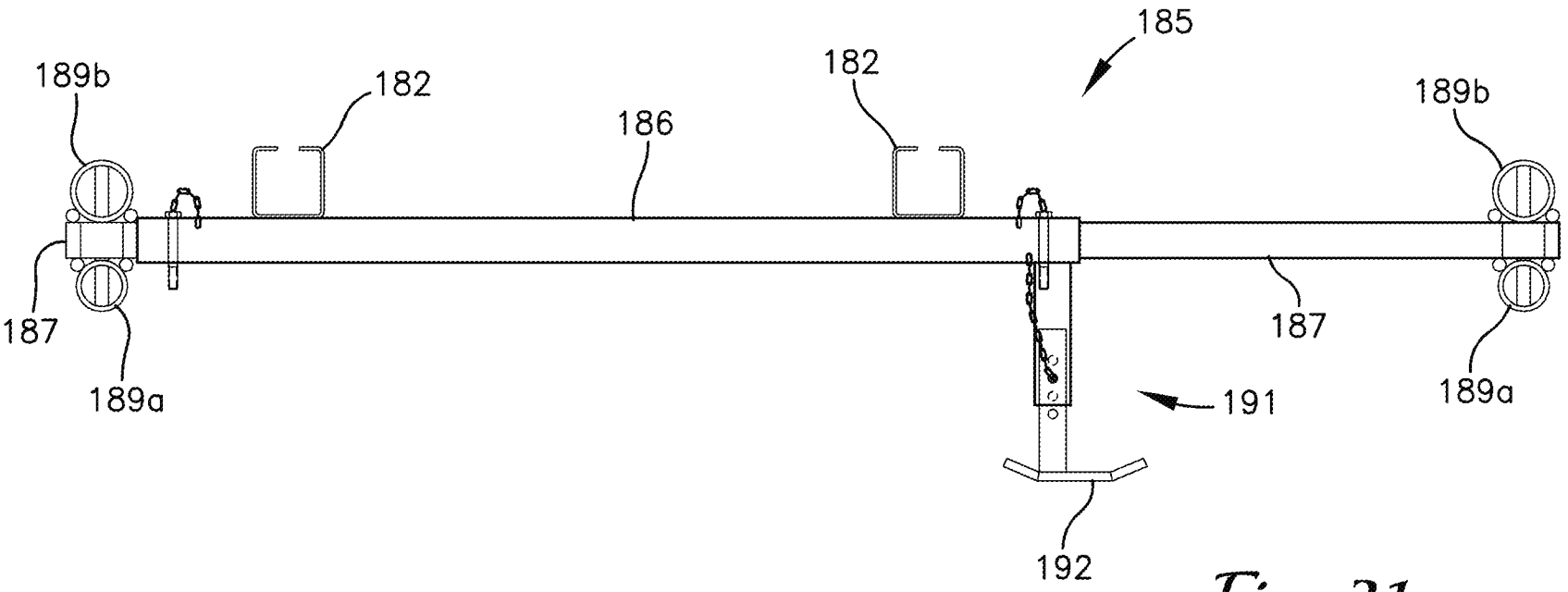
FIG. 21 is a side view of one of the vertical spacing assemblies.

Accessories may be mounted to the spacer sleeves 182. For example, as shown in FIGS. 17 and 21, vertical spacing assemblies 185 may be mounted on and suspended below spacer sleeves 182 supported from the front and rear drilling member support bars 103 and 104. Two vertical spacing assemblies 185 are shown supported from support bars 103 and 104 in FIG. 17. Each vertical spacing assembly 185 includes an outer tube 186 welded to the bottom of a pair of spacer sleeves 182. When the spacer sleeves 182 with outer tube 186 mounted thereon are slid onto the front and rear support bars 103 and 104, the outer tube 186 extends generally parallel to the orientation of the drills 57 supported on the drill support frame 59. Front and rear inner telescoping tubes 187 are telescopingly mounted within outer tube 186.

Figure 5:
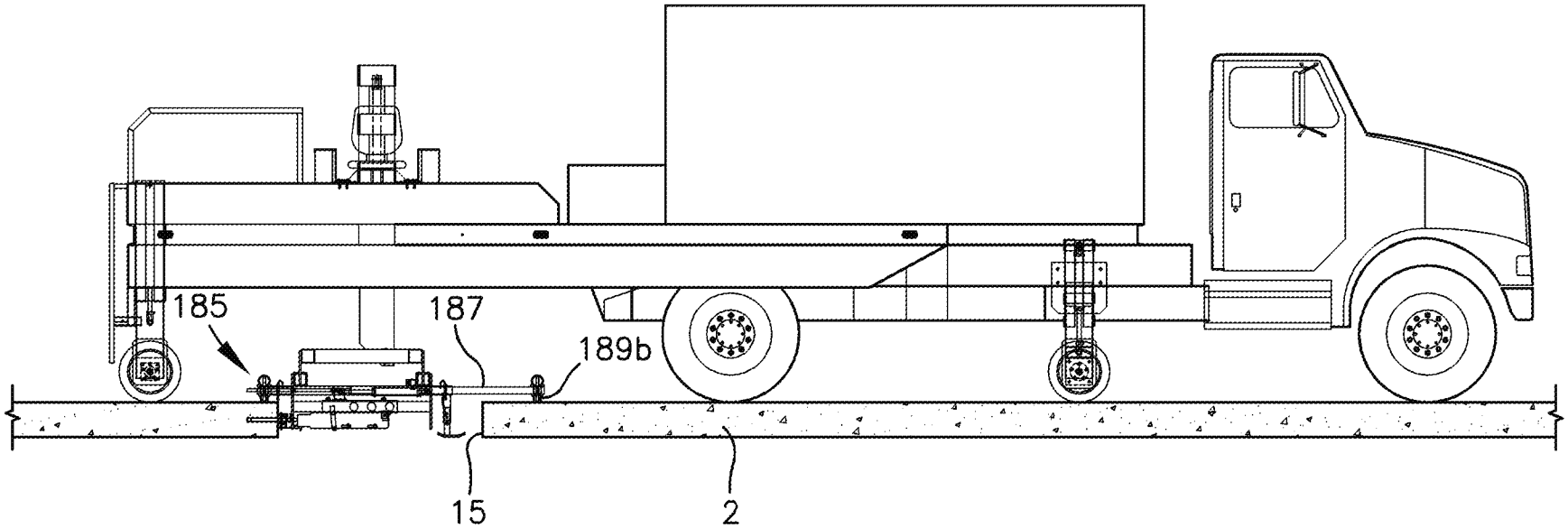
FIG. 5 is a view similar to FIG. 4, showing the drill gang assembly lowered into the hole in the slab and the drills boring dowel holes into a rear face of the slab adjacent the hole formed therein.
Figure 6:
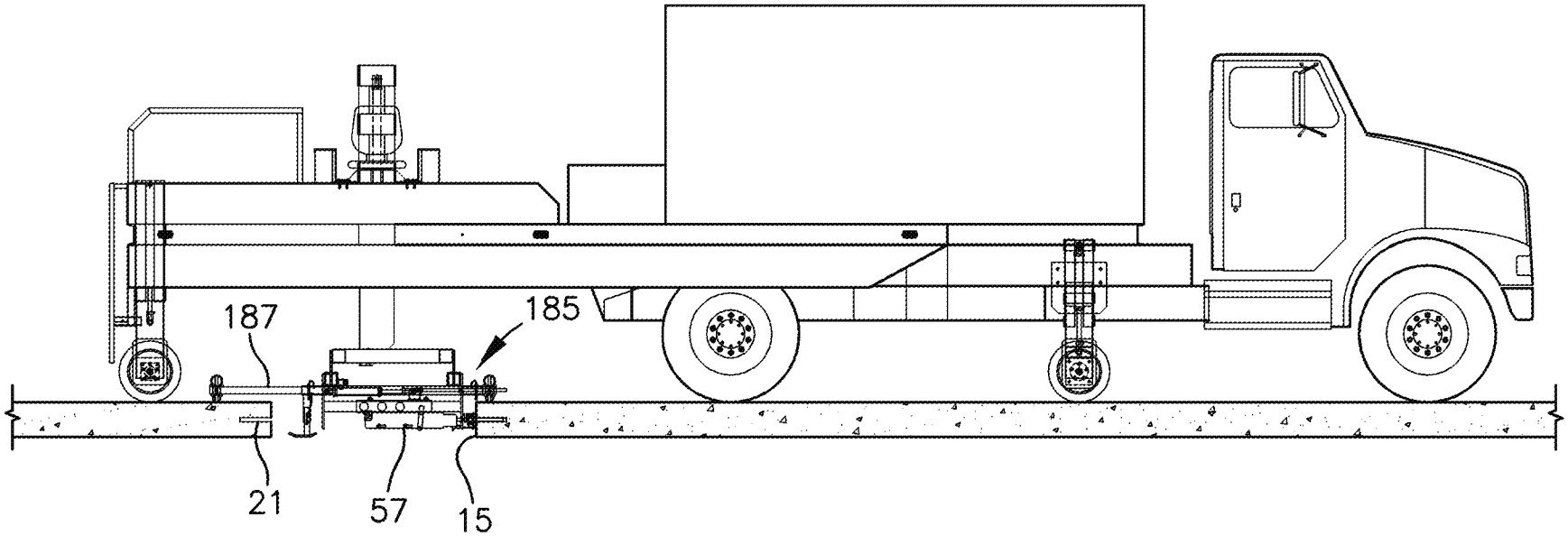
FIG. 6 is a view similar to FIG. 5 showing the drill gang assembly rotated one hundred and eighty degrees and the drills boring dowel holes into a front face of the slab adjacent the hole formed therein.
Figure 7:
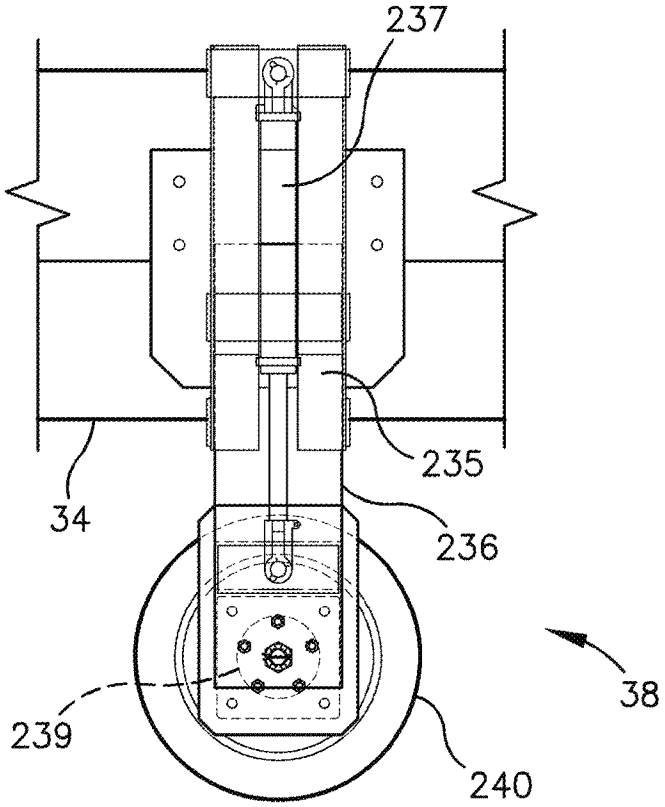
FIG. 7 is an enlarged and fragmentary, side elevational view showing one of the front telescoping wheel assemblies.
Figure 8:
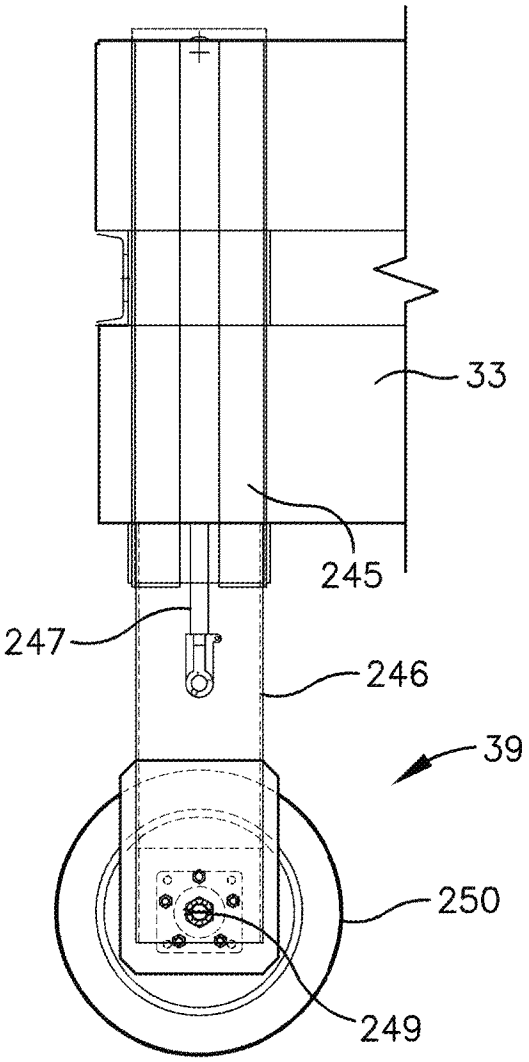
FIG. 8 is an enlarged and fragmentary, side elevational view showing one of the rear telescoping wheel assemblies.

Different sized spacer blocks or feet 189*a* and 189*b* are mounted on opposite sides of the telescoping tubes 187. The foot 189*a* on one side of each tube 187 is smaller than the foot 189*b* on the opposite side of each tube 189*b*. As best seen in FIGS. 5 and 6, when the drill gang assembly 132 is lowered into a hole 15 to drill holes 21 into edges of a slab 2, the telescoping tubes 187 are extended outward and oriented such that either feet 189*a* or 189*b* will engage an upper surface of the slab 2 on opposite sides of the hole 15 and prevent drill gang assembly 132 from being lowered further into the hole 15. The diameter or height of the feet 189*a* and 189*b* therefore determine how far below the upper surface of the slab 2 the drill bit 126 will be spaced.

Engagement of feet 189*a* or 189*b* on the upper surface of the slab 2 on opposite sides of the hole 15 also maintains the longitudinal axis of drill bit 126 in generally parallel alignment with the upper surface or the slab 2. Two vertical spacing assemblies 185 are attached to and suspended from support bars 103 and 104 to provide four points of contact with the upper surface of the slab 2 and maintain the drill support frame 59 in generally parallel alignment with an upper surface of the slab 2 adjacent the hole 15 in which the drills 57 are positioned to maintain each drill 57 at a consistent height relative to the edge or side of the slab 2. A vertically telescoping support leg assembly 191 with a foot 192 at a lower end thereof may also be mounted on and depend from each outer tube 186 of each vertical spacing assembly 185. Foot 192 may be extended downward to engage the ground at the bottom of the hole 15 in which the drill gang assembly 32 is positioned to provide further support for the drill gang assembly 32.

During a drilling operation, one or more of the bits 126 may get stuck in the hole 21 the bit 126 is boring in the slab 2. A drill bit release assembly 201 adapted for releasing a stuck drill bit 126, may also be mounted on spacer sleeves 182 which are then mounted on the drilling assembly support bars 103 and 104 of drill support frame 59. The release assembly 201 includes a pair of hydraulic actuators 203 each connected to a breaker bar 204 and supported on an actuator hanger assembly 205 as best seen in FIG. 22. Each actuator hanger assembly 205 includes front and rear support straps or brackets 207 and 208 depending from front and rear spacer sleeves 182. A support tube or bar 209 is connected between the support straps 207 and 208 at lower ends thereof to maintain the spacing between the support straps 207 and 208. A clevis 210 is mounted on an inner surface of rear support strap 208. A rear end of actuator 203 is connected to a clevis 210 and a front end is connected to breaker bar 204.

The breaker bar 204 shown is an elongate metal bar of rectangular cross-section. The breaker bar 204 is supported on top of the guide rail 33 of each drill carrier 58. The breaker bar 204 is sized to extend across all of the guide rails 33 in the drill gang assembly 32. Extension of the two hydraulic actuators 203 connected to the breaker bar 204 extends the breaker bar 204 in closely spaced relation from the front guide rail support straps 141. As best seen in FIG. 18, a stop or strike plate 211 is formed on or welded to an upper surface of the carrier tube 134 along a front edge thereof.

To attempt to release a stuck drill bit 126, the flow of pressurized air to the carrier tube actuators 173 is reversed to urge the carrier tubes 134 rearward. Then hydraulic pressure is supplied to the breaker bar hydraulic actuators 203 to retract the pistons of the actuators 203 to draw the breaker bar 204 against the stop 211. The actuators 203 apply additional, relatively high pressure rearward against the stop 211 and the carrier tube 134 to force the carrier tube 134 and attached drill 57 rearward along guide rail 33 pulling the drill bits 126 out of the holes 21 they have formed. The actuators 203 are preferably sized such that when they can be retracted far enough to draw the carrier tubes 134 to a fully retracted position on guide rail 133. The hydraulic actuators 203 may be replaced with hybrid actuators having hydraulic fluid supplied to and flowing into a front end of the actuator cylinder and acting rearwardly on the piston and having compressed air supplied to and flowing into a rear end of the actuator cylinder. Once the drill bits 126 are unstuck by driving the breaker bar 204 rearward against stop 211, hydraulic pressure acting on the pistons is released and the forward acting pressure of the compressed air acting on the pistons rapidly returns the breaker bar 204 to an extended position, allowing prompt reengagement of the slab by the drill bits 126.

Referring to FIGS. 17-20, a vibrating drill release assembly 213 including a shaker bar 214 with a vibrator 215 attached thereto may also be utilized with the drill gang assembly 132 to vibrate or shake loose a drill bit 126 that is stuck in a hole 21. A slot 216 is formed in each drill bit shroud 151 transverse to its central axis and extending downward from an upper wall thereof to receive a portion of the shaker bar 214 for selectively engaging and vibrating the drill bit 126 extending into the shroud 151. The slot 215 extends below the height of the drill bit 126 extending through the shroud 151 and is formed between the front guide rail support strap 141 and the inner wall 155 of the drill bit guide support assembly 152. A reinforcing bar (not shown) may be welded to the shroud 151 to extend across the slot 215 to prevent the shroud 215 from collapsing along the slot 215 when the shroud is pressed against a face of the slab 2. Reinforcing bar 217 is sized narrower than and positioned directly above the drill bit stem 127 so that the sides of the drill bit stem 127 extend outward relative to the reinforcing bar 217.

The shaker bar 214 is generally T-shaped with a horizontally extending top bar and a depending leg. Notches are formed in the depending leg which are sized slightly wider than the width of the drill bit stem 127. The number and spacing of the notches corresponds to the number and spacing of the drills 57 supported on the drill support frame 59. The shaker bar 214 is installed to extend across the shrouds 151 of each of the drills carriers 58 with a portion of the depending leg 219 adjacent each notch 221 extending into each slot 216 and each notch 221 positioned over and surrounding the drill bit stem 127 of the drill bit 126 in the shroud 151. The notches 221 are preferably slightly wider than the drill bit stems 127 over which the notches 221 are positioned so that the depending leg 219 does not normally interfere with the operation of the drill bit 126.

In the embodiment shown, the vibrator 215 is a pneumatic or hydraulically powered eccentric type vibrator that is bolted or otherwise connected to the top bar 218. When the vibrator 215 is activated it causes shaker bar 214 to vibrate or oscillate back and forth such that the portions of the depending leg 219 adjacent each notch 221 oscillate or vibrate back and forth against the drill bit stems 127 to help release the drill bit 126 from the hole 21 in which it is stuck. It is to be understood that a wide variety of vibrating, shaking or oscillating means other than the vibrator 215 could be used including a pneumatically operated reciprocating shaker similar to a jackhammer.

The hoses for supplying compressed air and pressurized hydraulic fluid to the various pneumatically or hydraulically operated components incorporated into the drill gang assembly 32 are routed through the center of the mast 63 and outer support tube 64. The system of hoses, manifolds, fittings, valves and related control equipment for delivering compressed air and pressurized hydraulic fluid to the operating components of the drill gang assembly 32 are not shown in detail in the drawings, but one of ordinary skill in the art can readily develop an acceptable layout for such systems.

Figure 23:
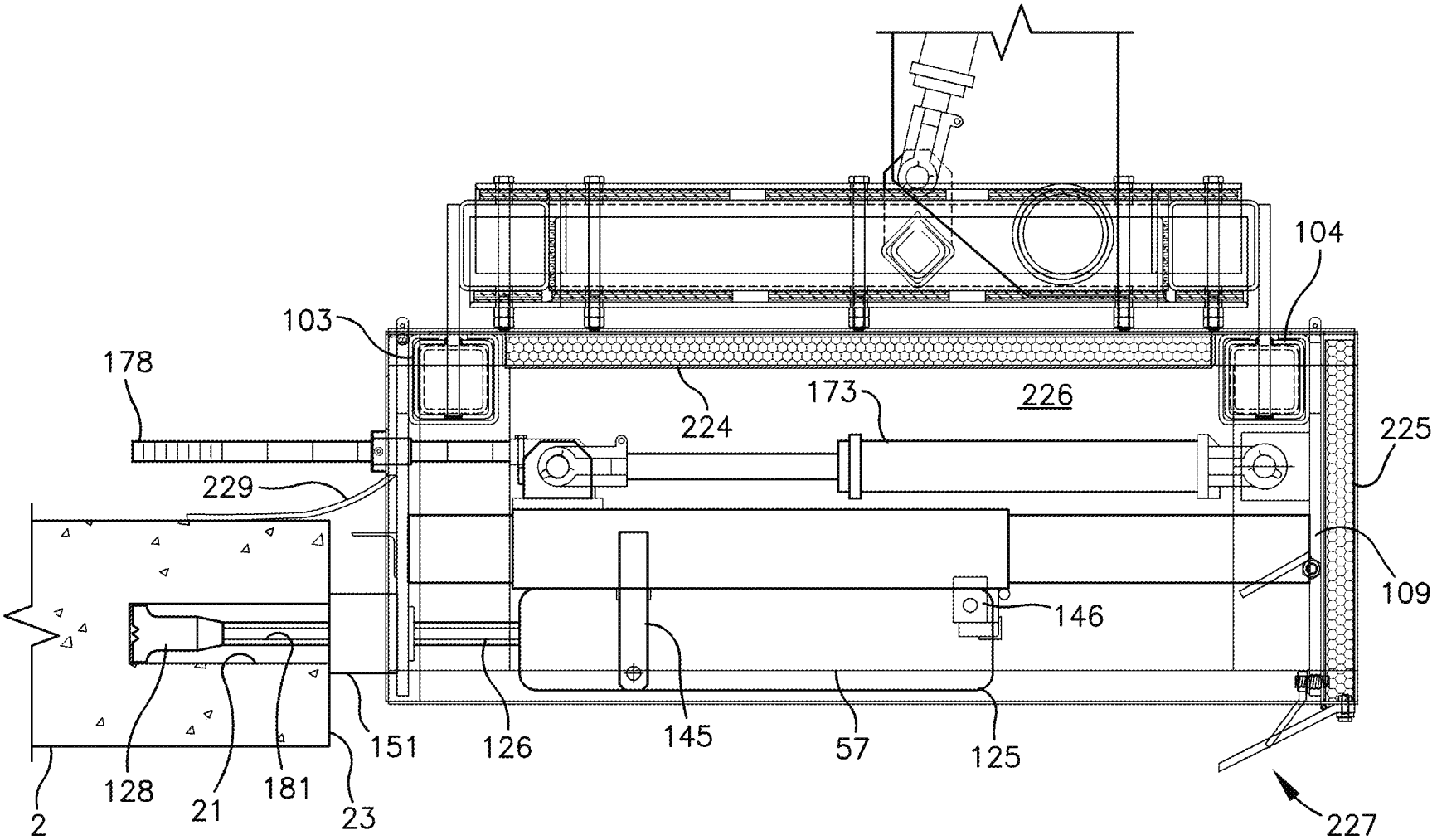
FIG. 23 is a cross-sectional view similar to FIG. 18 showing a drill of the drill gang assembly boring into the slab.

Operation of the drills 57 produces a considerable amount of dust and noise. Referring to FIG. 23, appropriately sized foam boards 224, 225 and 226 may be mounted on the drill support frame 59 to provide insulation against the noise generated by the drills 57 and prevent dust from escaping past the covered areas. For example, as shown in FIG. 23, a foam board 224 may be positioned and secured between the front and rear drilling assembly support bars 103 and 104 on brackets mounted on support bars 103 and 104. Another foam board 225 may be mounted on the back of the drill support frame 59 and connected at an upper end to a bracket on rear drilling assembly support bar 104 and connected at a lower end to lower ends of the support straps 109. A foam board 226 may be mounted to each side of the drill support frame 59. A flexible skirt or flange 227 may be mounted across lower edges of the support straps 109. The flexible skirt 227 is sized to engage the ground when the drill gang assembly 32 is lowered into position for drilling. The flexible skirt 227 may also extend around a bottom of the drill support frame 59 along the sides thereof. An additional flexible skirt or flange 229 may be mounted to the front of the drill gang assembly 32. A preferred attachment point, may be across the front surface of the front guide rail support straps 141 just below the hole ruled rod 179. Flexible flange 229 so mounted to extend forward and on top of the upper surface of the slab 2 adjacent hole 15 in which the drill gang assembly 32 is positioned.

The mobile drilling machine 31 may be maneuvered short distances relative to the hole 15 using the front and rear pairs of telescoping wheel assemblies 38 and 39. The front wheel assemblies 38 each include an outer tube 235 mounted to the truck frame 34 and an inner tube 236 telescopingly mounted within outer tube 235 and interconnected therewith by hydraulic actuator 237. A hydraulically powered drive motor 239 is mounted to and supported at a lower end of inner tube 236 with a drive wheel 240 rotatably mounted on drive motor 239. The inner tube 236 is retractable and extendable within outer tube 235 to raise and lower drive wheel 241 relative to the truck frame 34. In the embodiment shown, the outer tube 235 of each telescoping wheel assembly 38 and 39 is mounted to truck frame 34 between the front and rear wheels 36 and 37.

Rear telescoping wheel assemblies 39 each include an outer tube 245 mounted a rear end of the drilling machine main frame 33 and an inner tube 246 telescopingly mounted within outer tube 245 and interconnected therewith by hydraulic actuator 247. A hydraulically powered drive motor 249 is mounted to and supported at a lower end of inner tube 246 with a drive wheel 250 rotatably mounted on drive motor 249. The inner tube 246 is retractable and extendable within outer tube 245 to raise and lower drive wheel 250 relative to the main frame 33.

Figure 9:
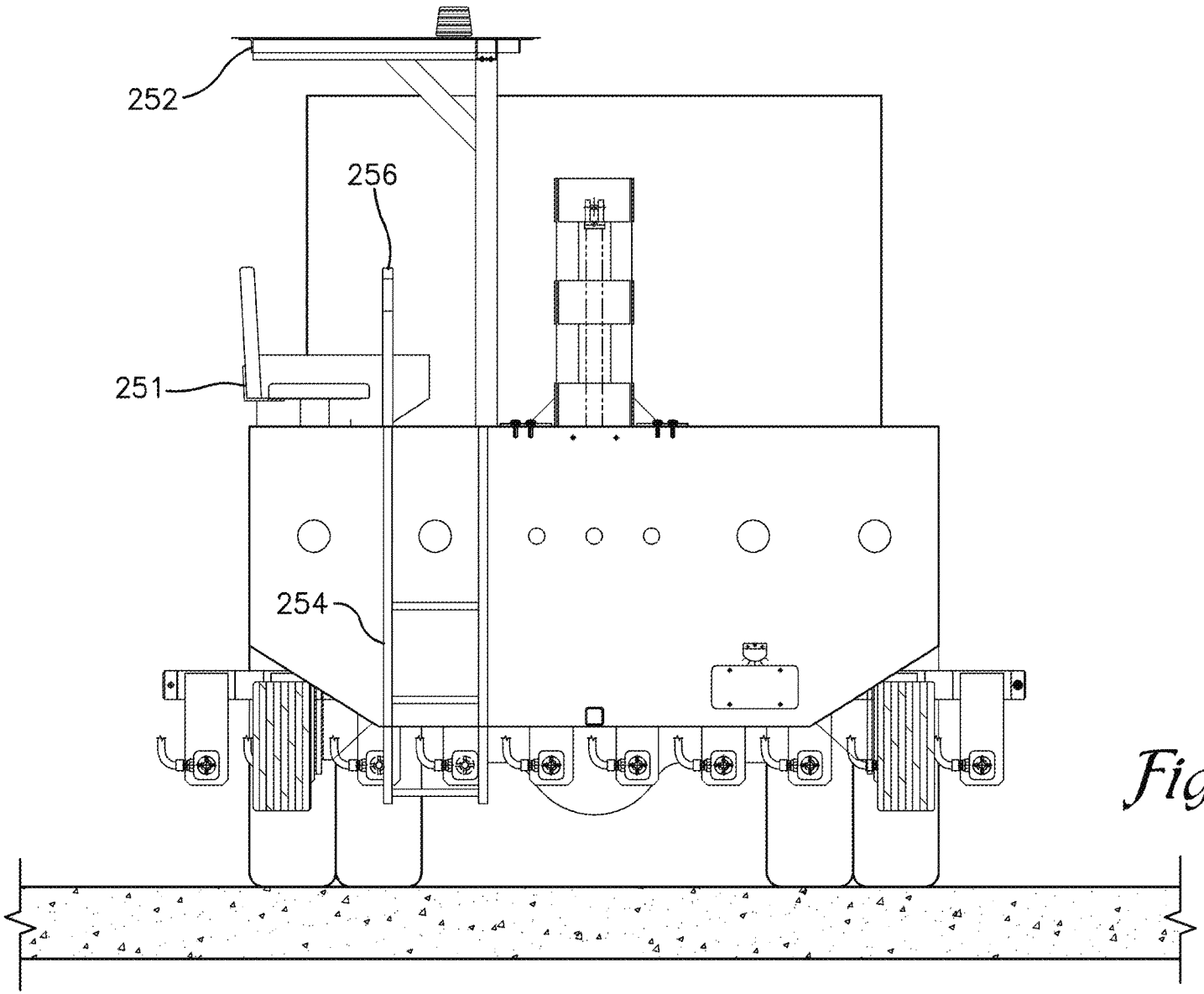
FIG. 9 is a rear view of the drilling machine mounted on the truck frame.

Referring to FIGS. 9 and 10, a seat 251 for an operator is mounted on the main frame 33 and in the embodiment shown is mounted adjacent and to the side of the drill gang assembly 32. A canopy 252 may be connected to the main frame 33 to extend over the seat 251. A ladder 254 mounted on the back of the main frame 33 provides access to a gangway 255 and hand rails 256 on main frame 33 which lead to the seat 251. Controls (not shown) are mounted proximate the seat 251 to allow an operator to selectively control the flow of compressed air to the drills 57 individually or as a group. Similarly, the operator can control the flow of pressurized hydraulic fluid to the hydraulic actuators 173 connected to each drill carrier tube 134. The controls preferably allow an operator to separately extend and retract each actuator 173 and selectively operate various groupings or all of the actuators 173 simultaneously. For example, to prevent damage to the slab 2 due to too many drills 57 operating simultaneously, the operator may elect to only advance every other drill 57 into engagement with slab 2 using selected actuators 173 or successively advance only one drill 57 at a time into engagement with the slab 2.

The process of using the drilling machine 31 to drill holes 21 for dowels 20 in the laterally extending faces or edges 23 and 24 of a hole 15 formed in a slab 2 are generally shown in FIGS. 2-6. Prior to traveling to a worksite and as shown in FIG. 2, the mast 63 and attached drill gang assembly 32 are raised to a retracted position and rotated so that the drill gang assembly 32 is oriented lengthwise relative to a longitudinal axis of the truck 35 with the drill bits 126 pointing to one side of the truck 35. In addition, the front and rear telescoping wheel assemblies or jacks 38 and 39 are retracted so that the drilling machine 31 is supported on the front and rear wheels 36 and 37 of truck 35. In the preferred embodiment, the drill gang assembly 32 is oriented lengthwise relative to the longitudinal axis of the truck 35 because the drill gang assembly 32 is approximately twelve feet wide which is the same width as most lanes 3 of a road 1 and therefore too wide to safely travel down the road 1 with normal traffic.

Figure 3:
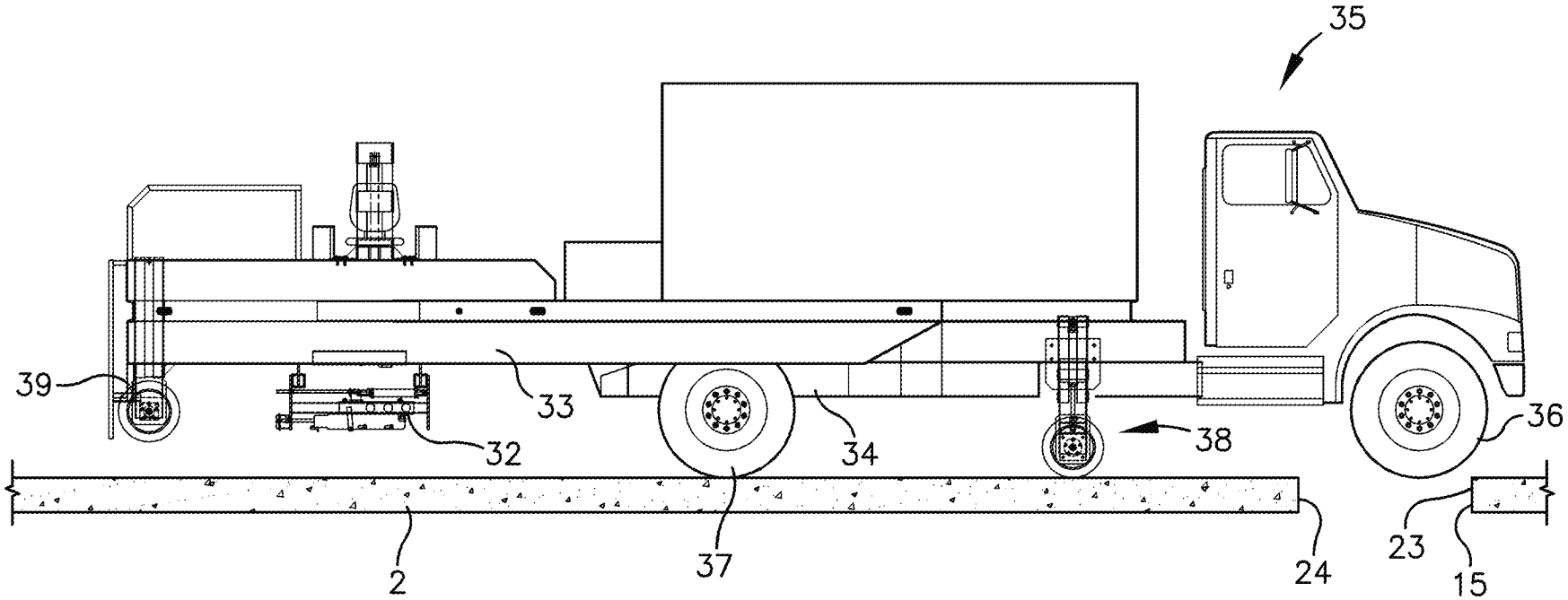
FIG. 3 is a view similar to FIG. 2, showing a front telescoping wheel lowered to support the front of the truck frame as a front wheel of the truck traverses a hole in the slab and showing the drill gang assembly rotated ninety degrees so that drill bits of the drills forming the drill gang assembly are pointed rearwards.

As shown in FIG. 3, when the truck 35 reaches a work zone and approaches a laterally extending hole 15 in the slab 2 from which a section of concrete has been removed, the operator initially uses a controller to engage motor 75 driving sprocket 78, chain 79 and sprocket 74 on outer support tube 64 to rotate the outer support tube 64 and mast 63 approximately ninety degrees relative to main frame 33 to orient the front of the drill gang assembly 32 to face forwardly or rearwardly relative to the direction of travel of the truck 35. In FIG. 3, the drill gang assembly 32 and drill bits 126 incorporated therein are shown facing rearward.

Figure 4:
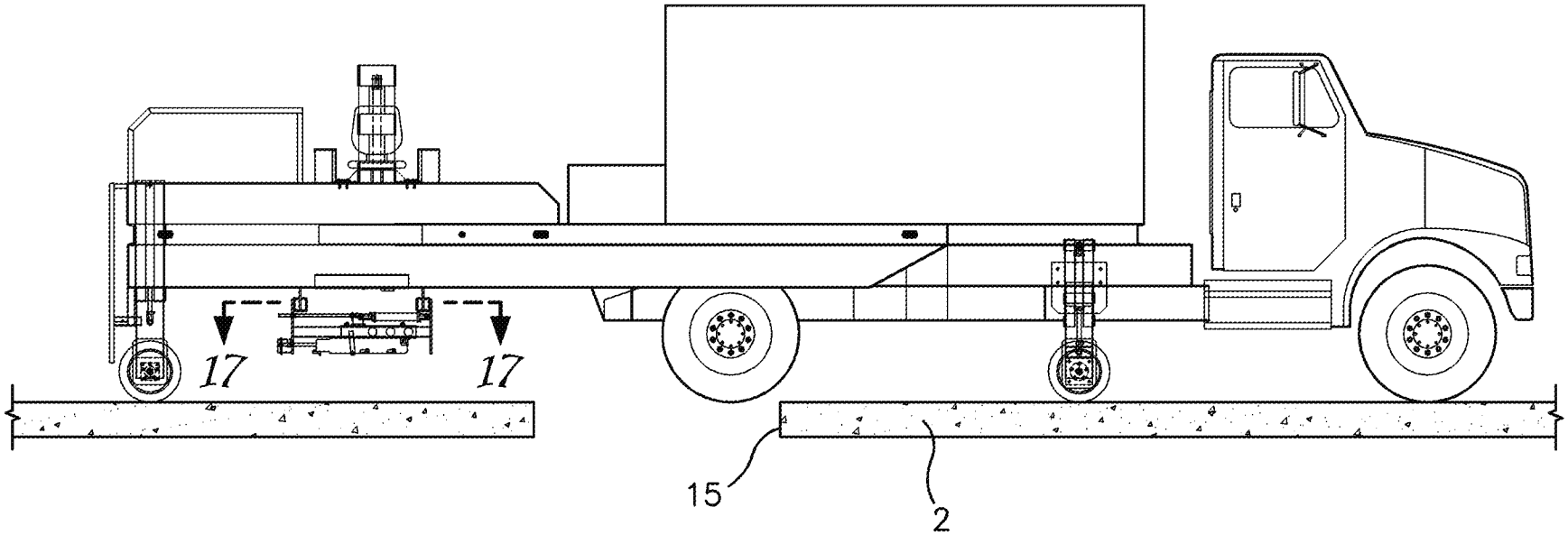
FIG. 4, is a view similar to FIG. 3, showing a rear telescoping wheel assembly lowered to support the rear of the truck frame as a rear wheel of the truck traverses the hole in the slab.

Just before the truck 35 reaches a repair hole 15 from which dowel holes 21 are to be drilled into the sides 23 and 24 of the slab 2, the actuators 237 for the front jacks 38 are extended to lower the wheels 240 of the front jacks 38 into engagement with the slab 2 and apply sufficient downward pressure to support the front of the truck 35 as the front wheels 36 subsequently pass over hole 15. Truck 35 is advanced forward until the front wheels 36 of truck 35 pass over hole 15 and onto the slab 2 on an opposite side of hole 15. The actuators 247 of rear jacks 39 are then extended to lower the wheels 250 of rear jacks 39 into engagement with the slab 2 and apply sufficient downward pressure to support the rear of the truck 35 as the rear wheels 37 of truck 35 pass over the hole 15 as shown in FIG. 4. It is to be understood that the rear jacks 39 could be extended to engage the slab 2 simultaneously with the front jacks 38.

Controlling drive motors 239 and 249 for drive wheels 240 and 250, the operator then moves the truck 35 and attached drilling machine 31 until the drill gang assembly 32 is positioned over hole 15. Actuator 91 connecting the mast 63 to outer support tube 64 is then extended to lower the drill gang assembly 32 into hole 15 as shown in FIG. 5. Prior to lowering the drill gang assembly 32, the operator may adjust which set of spacer blocks or feet 189 of vertical spacing assemblies 185 face downward to engage the upper surface of the slab 2. Slide actuator 121 may be extended or retracted to slide the base frame 101 of the drill gang assembly 32 and the attached drills 57 laterally relative to hole 15 to adjust the lateral positioning of the drill bits 126 relative to rear laterally extending face 24. Pivot actuator 115 may be extended or retracted to adjust the angular orientation of the base frame 101 of drill gang assembly 32 and the attached drills 57 relative to mast 63 and relative to the laterally extending face 24. Typically the specification will require the holes 21 to be formed to extend horizontally into slab 2. The drill gang assembly 32 is lowered until the spacer blocks 189 of vertical spacing assemblies 185 engage the upper surface of the slab 2 setting the position of the drill bits 126 at the desired spacing below the upper surface of the slab 2.

With the drill carrier tube 34 retracted and the drill bit heads 128 slightly recessed in the drill bit shrouds 151, drive wheels 240 and 250 are then engaged to move the drill gang assembly 32 toward the rear laterally extending face 24 until the outer ends of the drill bit shrouds 151 engage face 24. During the drilling process as described hereafter, pressurized hydraulic fluid may continually be supplied to the wheel drive motors 239 or 240 or both to hold the shrouds 151 against the face 24.

Once the drill gang assembly 32 is positioned in the desired position for drilling, the operator opens one or more valves to supply compressed air and activate the drills 57. The operator then selectively extends one or more actuators 173 to advance the carrier tube 134 supporting selected drills 57 forward to initiate the drilling or boring process. The operator can monitor the progress of each drill 57 by observing how far the ruled rod 179 associated with each drill 57 extends over the slab 2 from the face 24. If a drill bit 126 becomes stuck, the operator can activate vibrator 215 to vibrate shaker bar 214 to try to shake drill bit 126 loose. The operator might also retract actuators 173 to pull the carrier tubes 134 rearward and engage and retract hydraulic actuators 203 connected to breaker bar 204 to draw breaker bar rearward against the strike plates 211 on carrier tubes 134 to apply additional pressure to pull the drills 57 and drill bits 126 rearward to attempt to release the stuck drill bit 126. Once the drill bit 126 is released, the breaker bar actuators are extended and the carrier tube actuators 173 associated with the drills 57 to be utilized are again extended to advance the drill bits 126 back into the respective holes 21 being bored in the slab 2.

The operator engages and operates additional drills 57 as necessary to drill the desired number of holes 21 into the face 24 of slab 2 as set forth in the specification. Once all of the required holes 21 are bored into face 24, the drill carriers 34 and attached drills 57 are retracted and the flow of compressed air to the drills 57 is shut off. The drive motors 239 and 249 for drive wheels 240 and 250 may be operated to move the drill gang assembly 32 away from face 24. The drill gang assembly 32 is then raised out of the hole 15 by retracting mast 63 relative to outer support tube 64 by retracting actuator 91. Once the bottom of drill gang assembly 32 is raised above the slab 2, turntable drive motor 75 is actuated to rotate the outer support tube 64, mast 63 and attached drill gang assembly 32 one hundred and eighty degrees relative to main frame 33 and hole 15. The process described above is then repeated to lower the drill gang assembly 32 and position front edges of the drill bit shrouds 151 against the front laterally extending face 23 of the slab 2 adjacent repair hole 15 and to then bore holes in face 23 as generally shown in FIG. 6.

Once the specified holes 21 are bored in both the rear and front faces 24 and 23, the drill gang assembly is raised out of the hole 15 and the truck 35 is moved forward to the next hole 15 in the slab 2. If the distance between holes 15 is small, the telescoping wheel assemblies or jacks 38 and 39 are left extended to support the truck 35 as the wheels 36 and 37 of truck 35 pass over the next hole 15. In addition, the drill gang assembly 32 can be maintained extending transverse to the direction of travel of the truck 35 while traveling short distances. If the distances between holes 15 is large, the operator my rotate the drill gang assembly 32 back to longitudinal orientation with respect to the truck frame 34 and the front and rear jacks 38 and 39 are retracted so that the weight of the truck 35 is supported on its wheels 36 and 37.

Referring to FIGS. 24 and 25, there is shown an alternative configuration of the drilling machine 31 where the drill gang assembly 32 and mast 63 have been removed from their connection with outer support tube 64 and are connected to an auxiliary outer support tube 264. Auxiliary outer support tube 264 and an auxiliary turntable assembly 266 are mounted to an outer end of an auxiliary support frame 267 which may be secured to the main frame 33 to support auxiliary outer support tube 264 to the side of main frame 33, just past the outer longitudinal beam 51*a* and adjacent seat 251. Seat 251 is preferably rotatably mounted on main frame 33 to permit the operator to rotate at least one hundred and eighty degrees to face the drill gang assembly 32 when mounted on either outer support tube 64 or auxiliary outer support tube 264.

Auxiliary outer support tube 264 and auxiliary turntable assembly 266 are preferably constructed similar to outer support tube 64 and turntable assembly 266. Mast 63 may be telescopingly mounted within auxiliary outer support tube 264 and connected thereto by actuator 91. Auxiliary support frame 267 generally comprises a pair of laterally extending tubular frame members 55 bolted to or otherwise connected to cross members 52 of main frame 33 on opposite sides of the primary outer support tube 64 and seat 251.

The drill gang assembly 32 and mast 63 may be connected to auxiliary outer support tube 264 to drill dowel holes 21 in a longitudinally extending hole 15' formed by removing portions of adjacent slabs 2 extending along a longitudinal joint 6. Such longitudinally extending holes 15' tend to be narrower than holes 15 formed to repair a slab 2 around a lateral control joint 5. The specifications for drilling dowel holes 21 in the longitudinally extending faces 25 and 26 forming such holes 15' often require the dowel hole 21 to be bored at an angle as shown in FIG. 24. As discussed previously, pivot actuator 115 may be extended or retracted to adjust the angle of the drill support frame 59 relative to the mast 63 to adjust the angle of drills 57 and drill bits 126 relative to faces 25 and 26. Auxiliary outer support tube 264 may be rotated to orient the drill gang assembly longitudinally relative to main frame 33 for drilling holes in either face 25 or face 26. The functionality of the drill gang assembly 34 is generally the same when mounted on either outer support tube 64 or 264.

Figure 31:
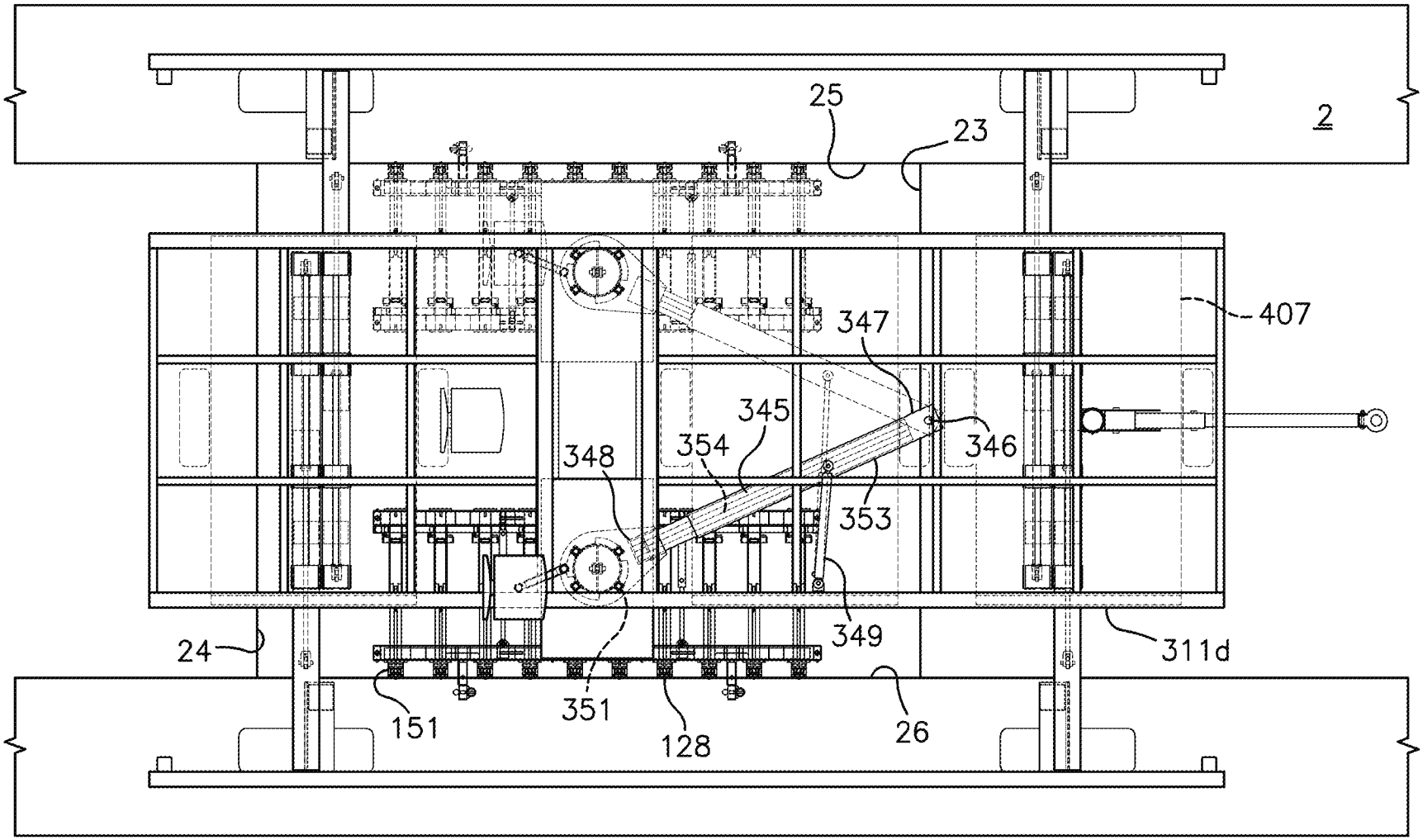
FIG. 31 is a view similar to FIG. 30 showing the mast and support tube for the mast in solid lines slid to one side of the main frame with the drill gang assembly rotated ninety degrees to face a side surface running along a side of the slab in which the hole is formed and showing the mast and support tube for the mast in dashed lines slid to the other side of the main frame and rotated in an opposite direction.
Figure 33:
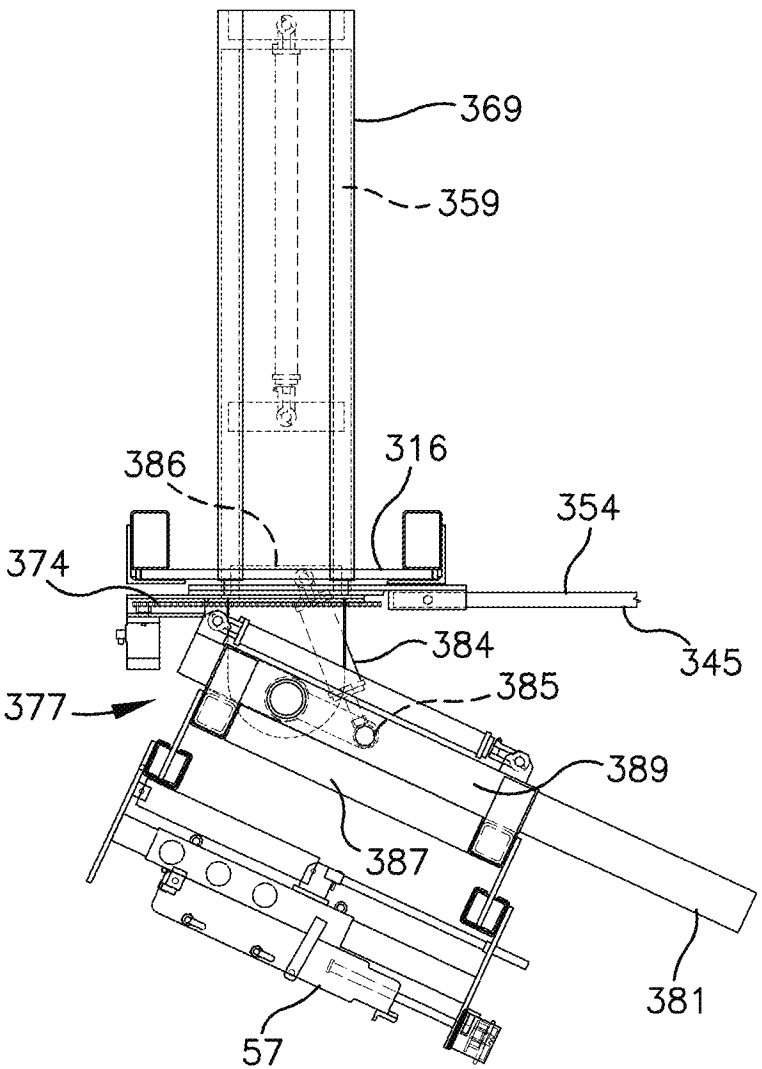
FIG. 33 is a view similar to FIG. 32 showing the support arms and drill gang assembly rotated downward relative to the mast.
Figure 32:
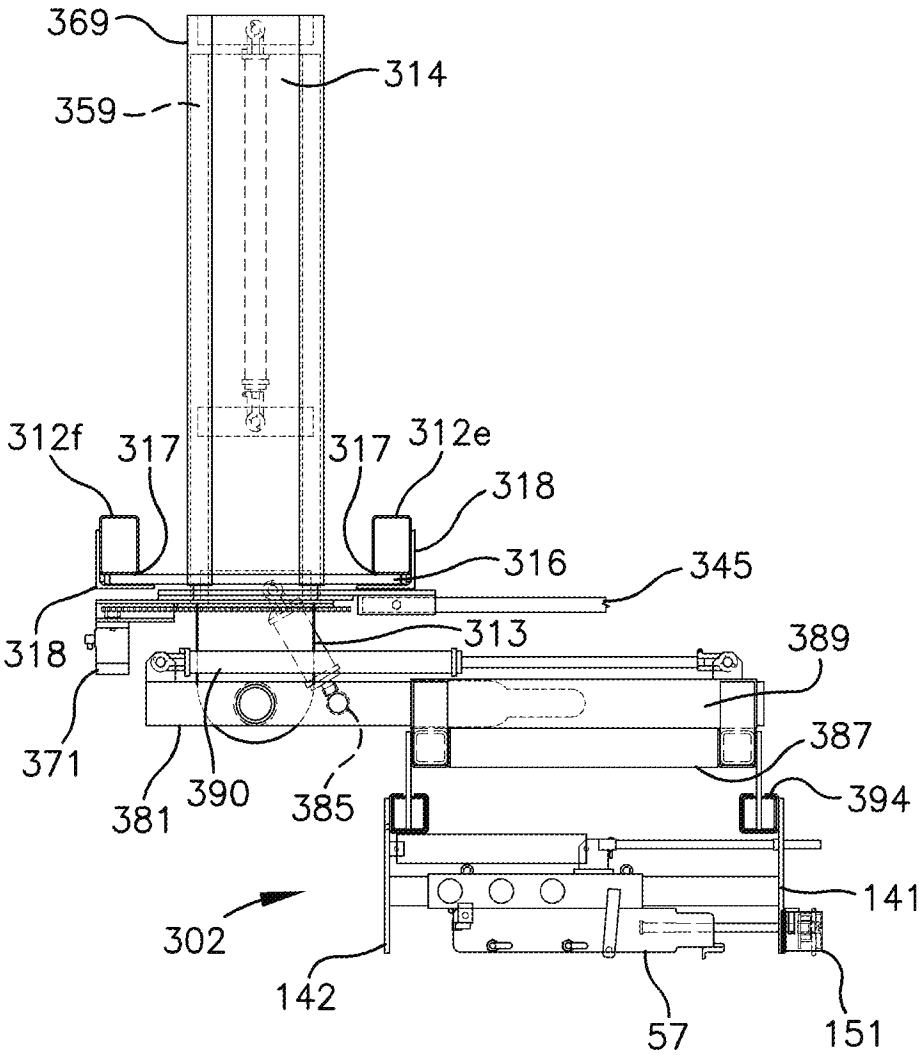
FIG. 32 is an enlarged and fragmentary, side view of the drilling machine showing the drill gang assembly connected to the mast on horizontally extending support arms and extended relative to the support arms.
Figure 34:
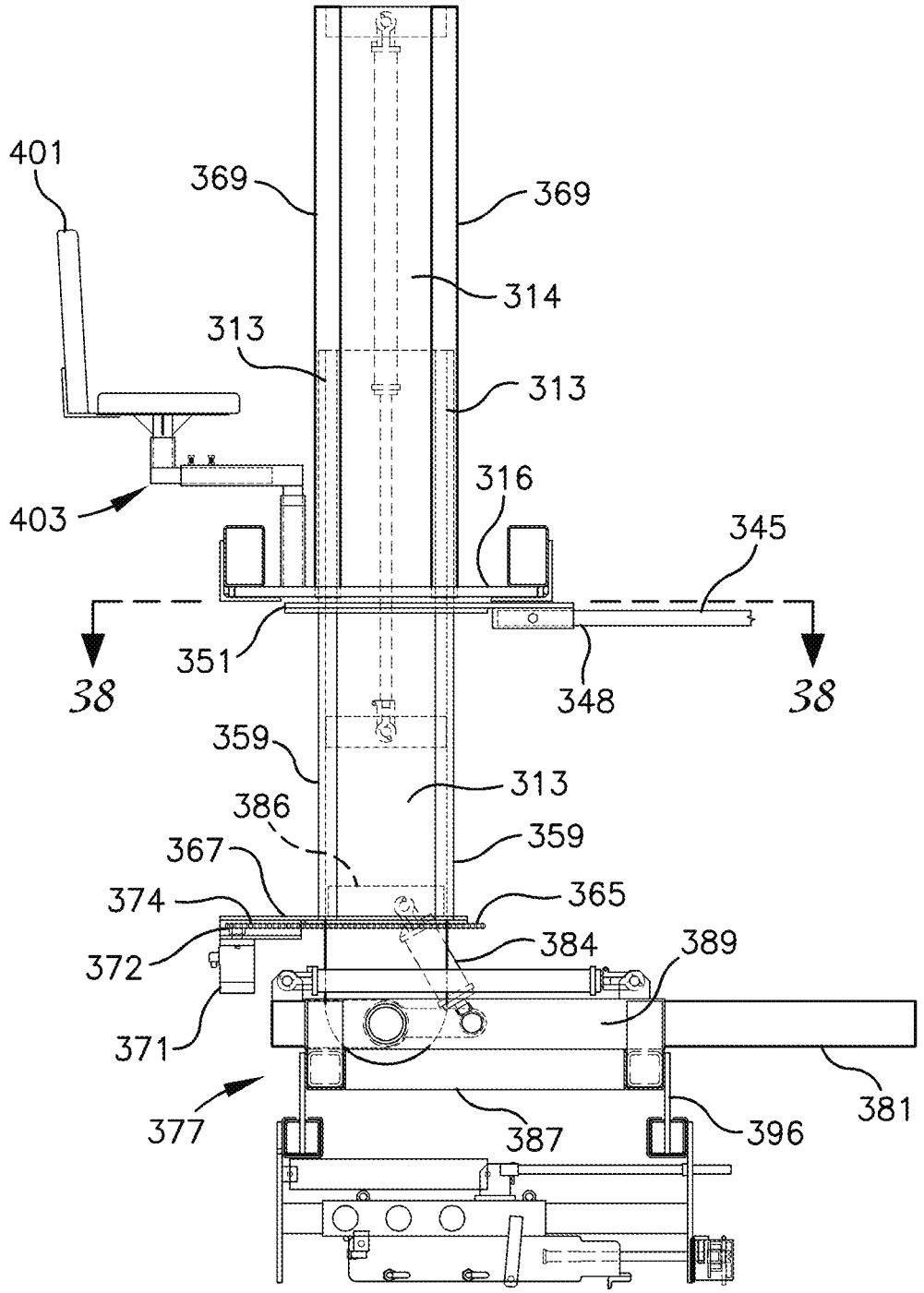
FIG. 34 is a view similar to FIG. 32 with the drill gang assembly retracted relative to the mast and the mast extended downward relative to a support tube for the mast.

An alternative embodiment of a mobile drilling machine 301 is shown in FIGS. 26-38. In the mobile drilling machine 301, a drill gang assembly 302, similar to drill gang assembly 32, is mounted on a carriage 303 so that the drill gang assembly rotates 360 degrees about a vertical axis of rotation, telescopes vertically along the axis of rotation and is slidable laterally relative to the carriage 303. Vertical telescoping of the drill gang assembly 302 allows the drill gang assembly 302 to be raised and lowered relative to a hole 15 formed in a slab 2. Rotation of the drill gang assembly 302 allows the drills 57 to be oriented to face either of the laterally extending edges 23 or 24 or either of the longitudinally extending edges 25 and 26 of the slab 2 surrounding the hole 15. As best seen in FIG. 31, lateral movement of the drill gang assembly 302 allows the drill bit heads 128 to be advanced against the longitudinal edges 25 and 26 of the slab 2 surrounding the hole 15.

The carriage 303 comprises a main frame 305 supported by a plurality of wheels 307. In the embodiment shown, the main frame 305 is supported on four wheels 307. It is foreseen that the main frame may be supported on continuous tracks, each track including a continuous band of treads driven by two or more wheels, in which case only two sets of tracks would be required, one on each side of the frame 305. The wheels 307 are telescopingly mounted relative to the main frame 305 so that the wheels 307 may be extended and retracted laterally relative to the frame 305. Extension of the wheels 307 allows the frame 305 to pass over a lane 3 of a road and over a hole 15 extending across the entire lane 3 of a slab 2 while the wheels 307 travel over the adjacent lanes 3 or shoulder 7.

Figure 26:
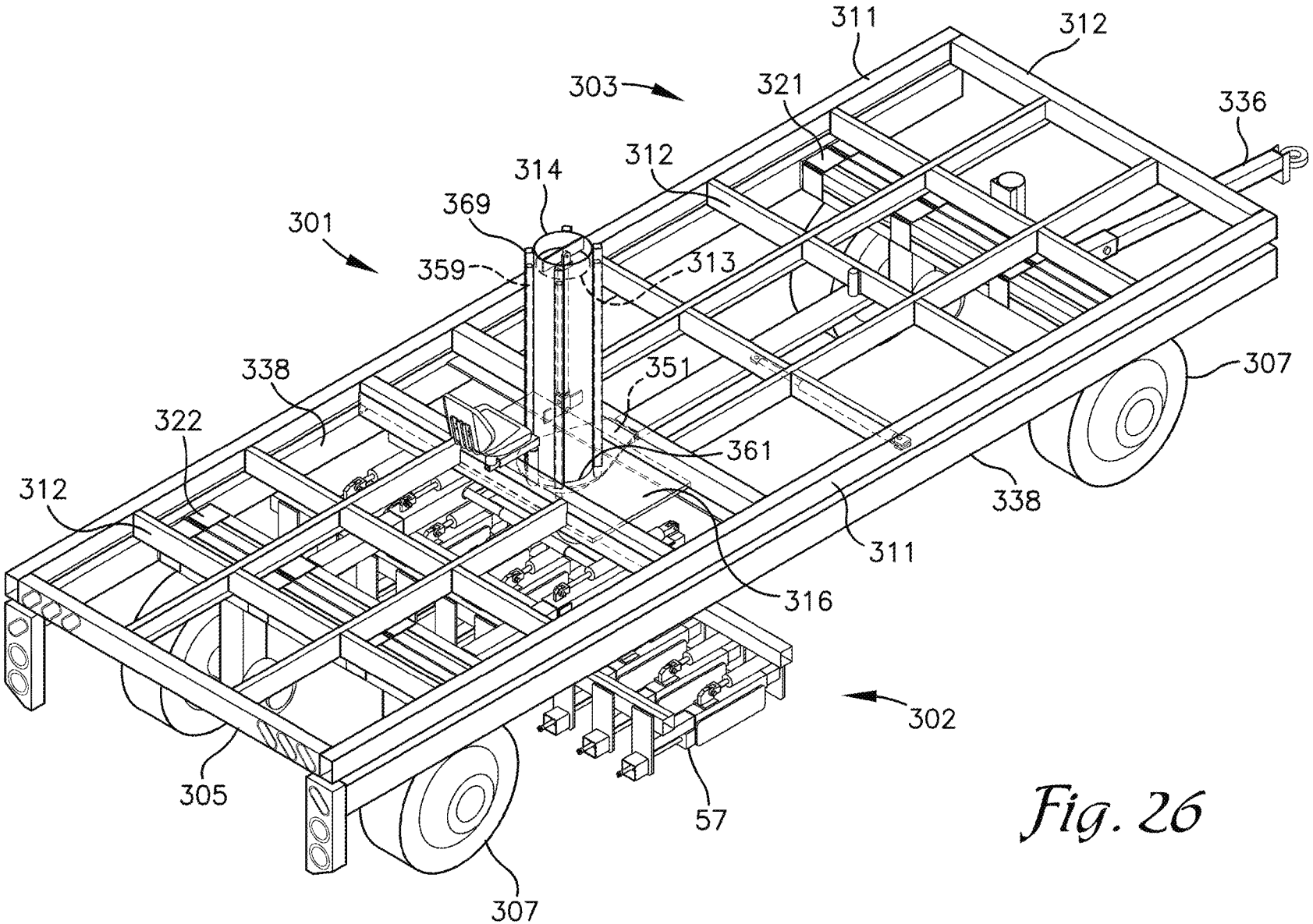
FIG. 26 is a perspective view of an alternative embodiment of the drilling machine which can be self-propelled or towed behind a towing vehicle.
Figure 27:
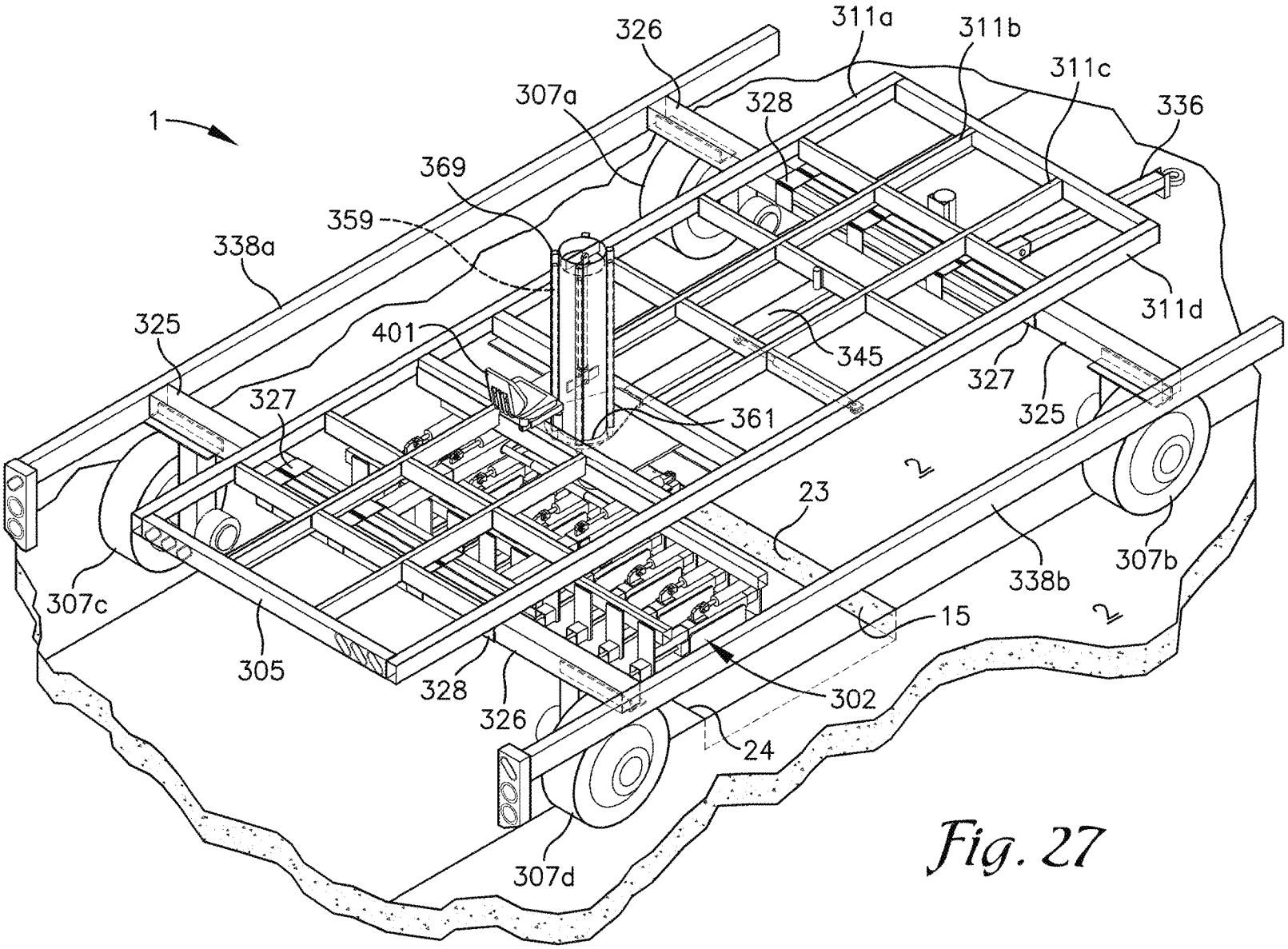
FIG. 27 is a perspective view of the drilling machine as in FIG. 27 with front and rear wheels of the drilling machine extended so that the wheels are supported in lanes of a road adjacent to a lane in which a hole is formed and with a drill gang assembly supported below the frame of the drilling machine over the hole.

As seen in FIGS. 26 and 27 for the embodiment show, main frame 305 is formed from four longitudinal beams 311 interconnected in parallel spaced relationship by a plurality of cross-members or lateral beams 312 extending in parallel spaced relation along the length of the main frame 305. The drill gang assembly 302 is supported on a vertically telescoping tube or mast 313 which is telescopingly and rotatably received within an outer support tube 314. The outer support tube 314 is fixedly mounted on a lateral slide plate or panel 316 which slides laterally within opposingly facing channels 317 formed beneath interior cross-members 312*e* and 312*f* extending between a front pair of wheels 7*a* and 7*b* and a rear pair of wheels 7*c* and 7*d*. Each channel 317 is formed by welding an angle iron 318 to an outer face of the respective interior cross-member 312*e* and 312*f* with a gap formed between the bottom of the cross-member 312 and a horizontal leg of the angle iron 318.

The main frame 305 is supported on front and rear wheel and axle assemblies or trucks 321 and 322 respectively. Each truck 321 and 322 includes front and rear laterally telescoping wheel support beams 325 and 326 slidably secured within front and rear support tubes 327 and 328 respectively. The support tubes 327*a* and *b* and 328*a* and *b* are secured to the main frame 305 and extend laterally between and below the outer longitudinal beams 311*a* and 311*d*. Hydraulic actuators 329 connected between each wheel support beam 325 and 326 and a respective support tube 327 and 328 are operable to extend and retract the support beams 325 and 326 relative to a respective support tube 327 and 328.

Figure 28:
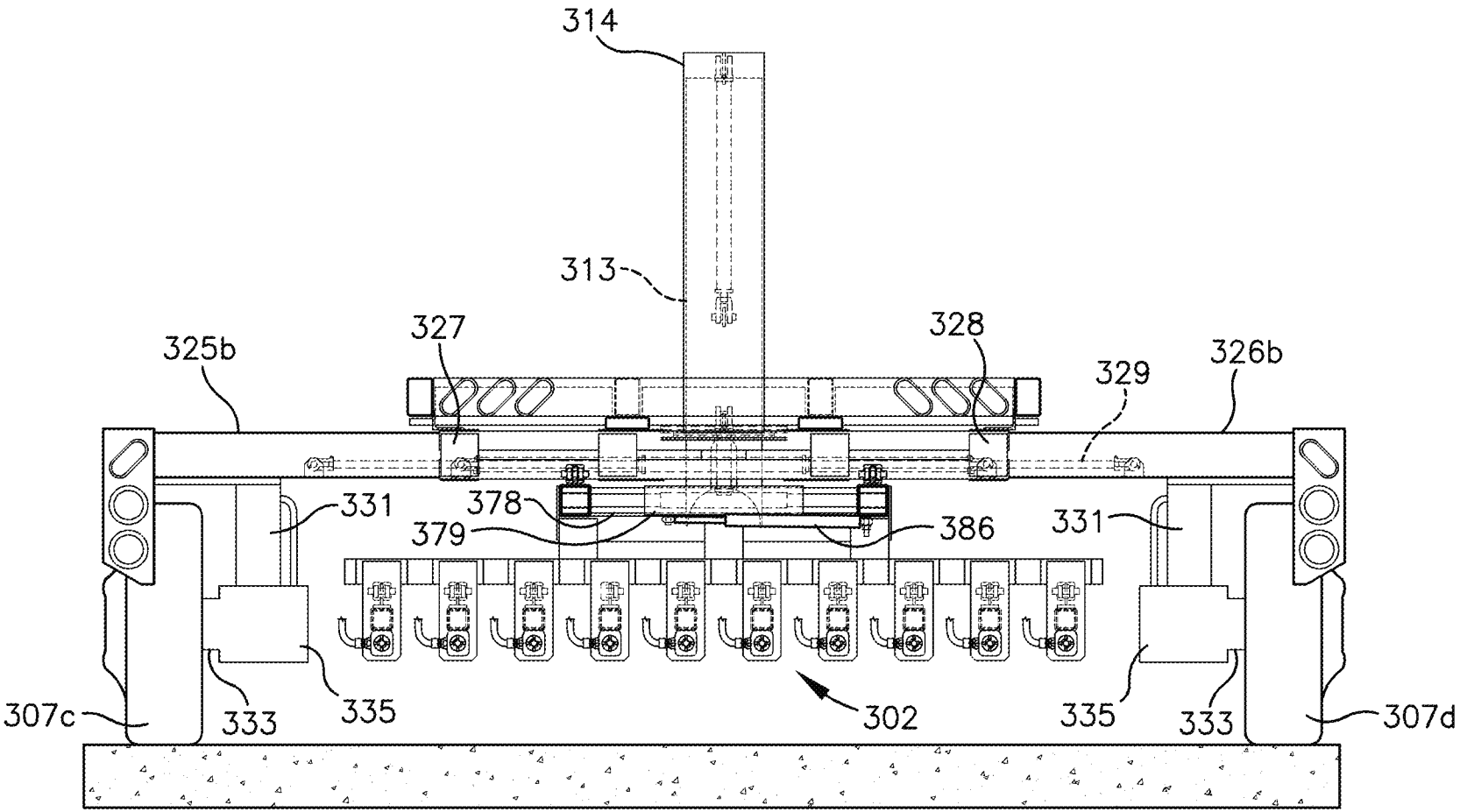
FIG. 28 is a rear end view of the drilling machine as shown in FIG. 27
Figure 36:
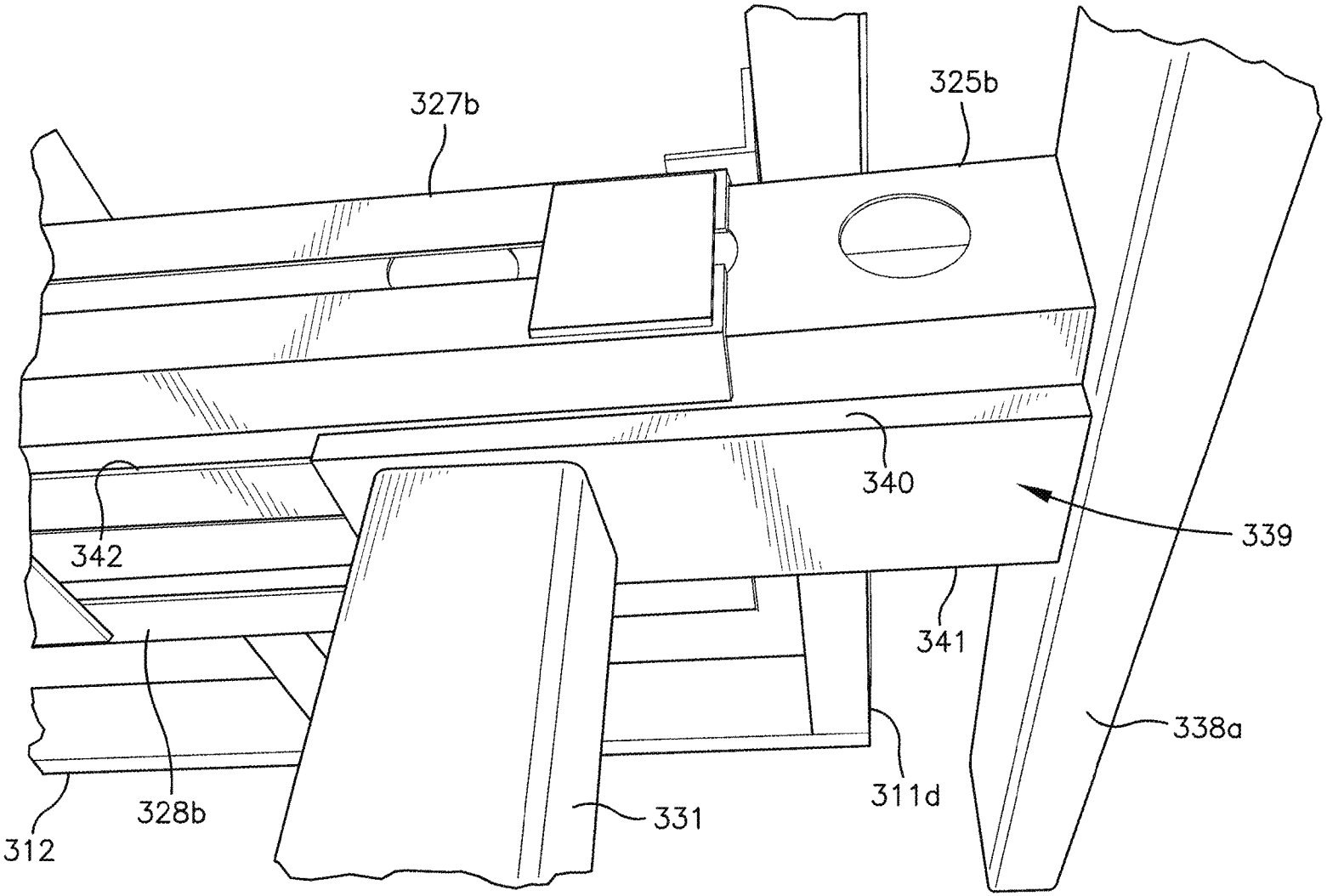
FIG. 36 is a greatly enlarged and bottom perspective view of a telescoping wheel support beam for telescopingly connecting one of the wheels to the main frame.
Figure 37:
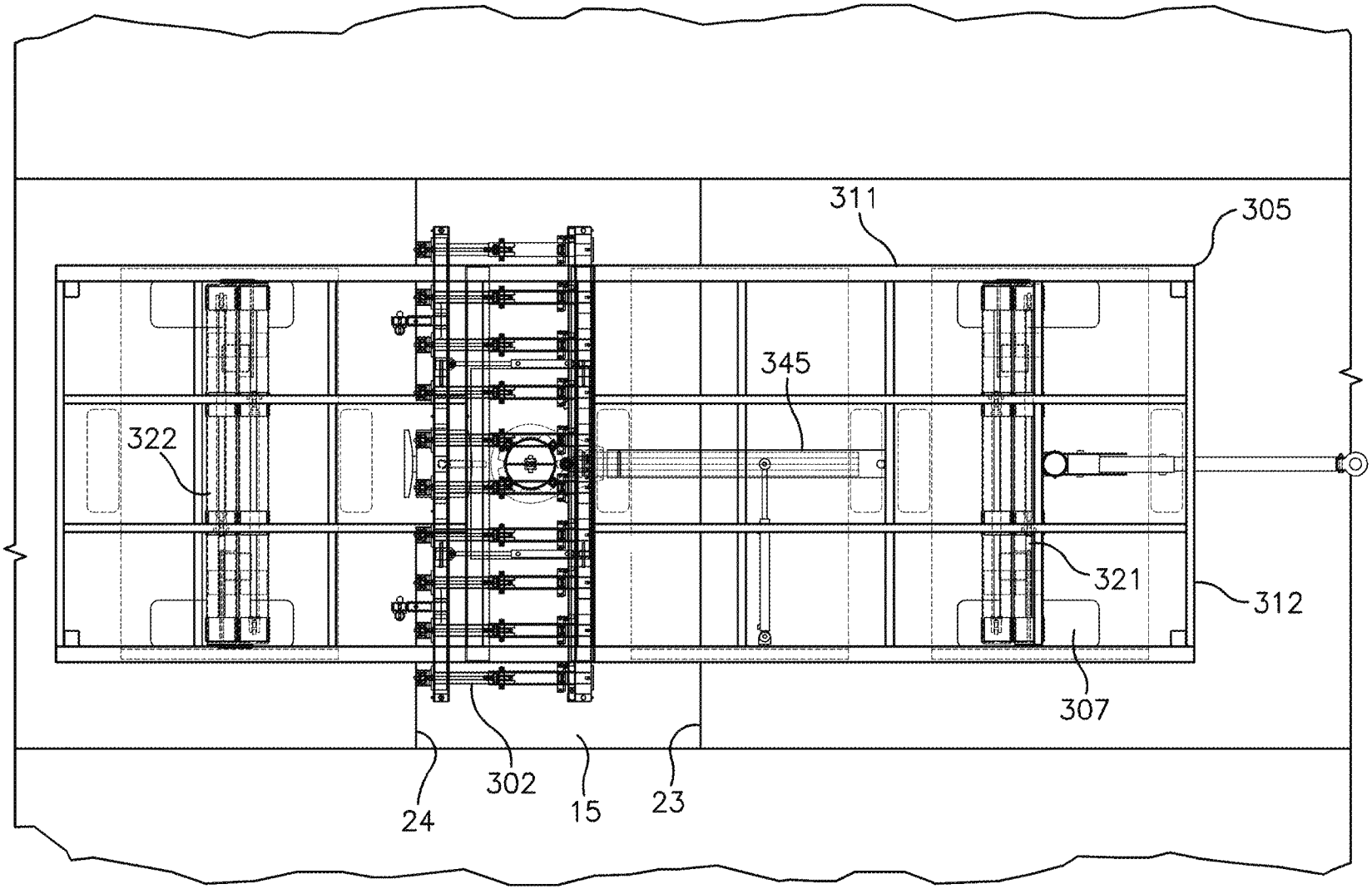
FIG. 37 is a view similar to FIG. 30 but showing the wheels retracted relative to the main frame.
Figure 38:
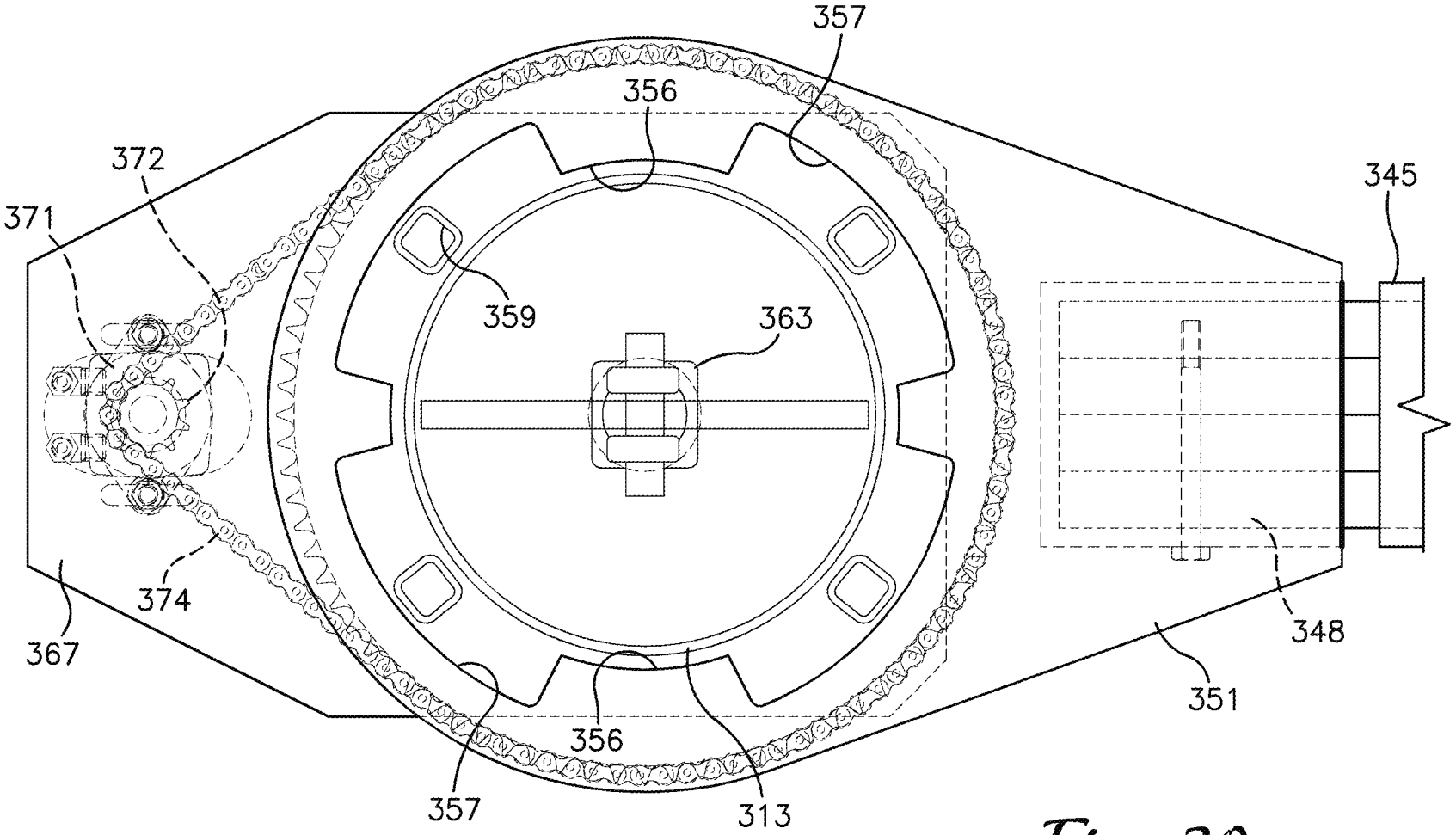
FIG. 38 is a cross-sectional view taken along line 38-38 of FIG. 34.

With reference to FIGS. 27, 28 and 36, each of the wheels 307 is connected to and supported below a respective one of the support beams 325 or 326 by a vertical support leg 331 and a stub axle assembly 333. As shown diagrammatically in FIG. 28, the stub axle assembly 333 of one or more of the wheels 307 may include a hydraulic motor 335 for rotating the associated wheel 307. Hydraulic motors 335 are shown connected to the rear wheels 307*c* and 307*d* in FIG. 28 and are used for driving the carriage 303 relative to a section of a slab 2 in which holes are to be bored after the carriage has been towed to the section. A tow bar 336 connected to the main frame 305 near a front end thereof is provided for towing the carriage 303 behind a truck (not shown).

In the embodiment shown, longitudinal stabilizing beams or side rails 338 are connected across the ends of front and rear wheel support beams 325 and 326. Left side rail 338*a* is connected across the ends of the left, front and rear wheel support beams 326*a* and 325*b*. Right side rail 338*b* is connected across the ends of the right front and rear wheel support beams 325*b* and 326*b*. The vertical support legs 331 extend vertically between respective stub axle assemblies 333 and the telescoping wheel support beams 325 and 326 a distance sufficient to space the main frame 305 high enough off of the ground to suspend the drill gang assembly 302 below the main frame 305 and above a slab 2 on which the carriage 303 is supported by wheels 307.

The vertical support legs 331 are connected to respective wheel support beams 326 and 327 by offset flanges 339 projecting below the outer end of each wheel support beam 325 and 326. The offset flanges 339 are L-shaped and each includes a depending leg 340 and a horizontal leg 341. Each vertical support leg 331 is welded to and depends from a respective horizontal leg 341. The depending leg 340 of each offset flange 339 is welded to the bottom and outer end of each wheel support beam 325 and depends therefrom. On each front wheel support beam 325, the horizontal leg 341 extends rearward and on each rear wheel support beam 326, the horizontal leg 341 extends forward so that the vertical support legs 331 for each set of front and rear wheel support beams 326 and 327, and the wheels connected thereto, are axially aligned.

A slot 342 is formed in the outer end and bottom of each front and rear support tube 327 and 328 and extends parallel to a longitudinal axis of the respective support tube 327 and 328 a distance slightly longer than the offset flanges 339. When the front and rear wheel support beams 325 and 326 are retracted relative to the respective front and rear support tubes 327 and 328, the depending leg 340 of each offset flange 339 extends into the associated slot 342 in the respective front or rear support tubes 327 and 328.

When the wheels 307 are fully retracted relative to the main frame, the retracted wheel base of the carriage 303, the distance between the outer edges of aligned pairs of wheels 307*a* and 307*b* and wheels 307*c* and 307*d*, is smaller than the width of a standard sized lane 3 of a road. When the front and rear wheel support beams 325 and 326 are extended, the extended wheel base, the spacing between the inner edges of pairs of front wheels 307*a* and 307*b* and rear wheels 307*c* and 307*d*, exceeds the width of the lane 3. With the wheels 307 extended, the carriage 303 can advance over a lane 3 with a hole 15 extending the entire width of the lane 3 with the wheels 307 traveling on the adjacent lanes 3 and/or shoulder 7. In one embodiment, the retracted wheel base of the carriage 303 is approximately 8 feet and the extended wheel base of the carriage 303 greater than 12 feet and approximately 13 feet.

Side to side movement of the mast 313 and the lateral slide plate 316 is imparted by a telescoping pivot arm or lever 345. The pivot arm 345 is pivotally connected to the main frame 305, by a pivot pin or hinge 346, at a first end 347 and around the mast 313 at a second end 348. A hydraulic actuator 349 connected between the pivot arm 345 and an outer longitudinal beam 311*d* of the main frame 305 is used to pivot the pivot arm 345 laterally relative to the main frame 305 and about the pivot pion 346. A collar or flattened collar 351 is connected to the second end 348 of the telescoping pivot arm 345. In the embodiment shown, the telescoping pivot arm 345 is formed from an outer tube 353 and an inner member 354. The outer end of the outer tube 353 opposite the mast 313 comprises the first end 347 of the pivot arm 345 which is pivotally connected to the main frame 305 and the outer end of the inner member 354 forms the second end 348 of the pivot arm 345 connected to the collar 351.

The collar 351 extends under the lateral slide plate 316 and includes a central opening 356 through which the mast 313 extends so that the collar 351 rotates around and relative to the mast 313. Four arcuate channels 357 are also formed in the collar 351 and extend radially outward from the central opening 356. Stabilizing rods 359, the function of which will be described hereafter pass through the channels 357. The channels 357 permit rotation of the collar 351 relative to the stabilizing rods 359.

Figure 29:
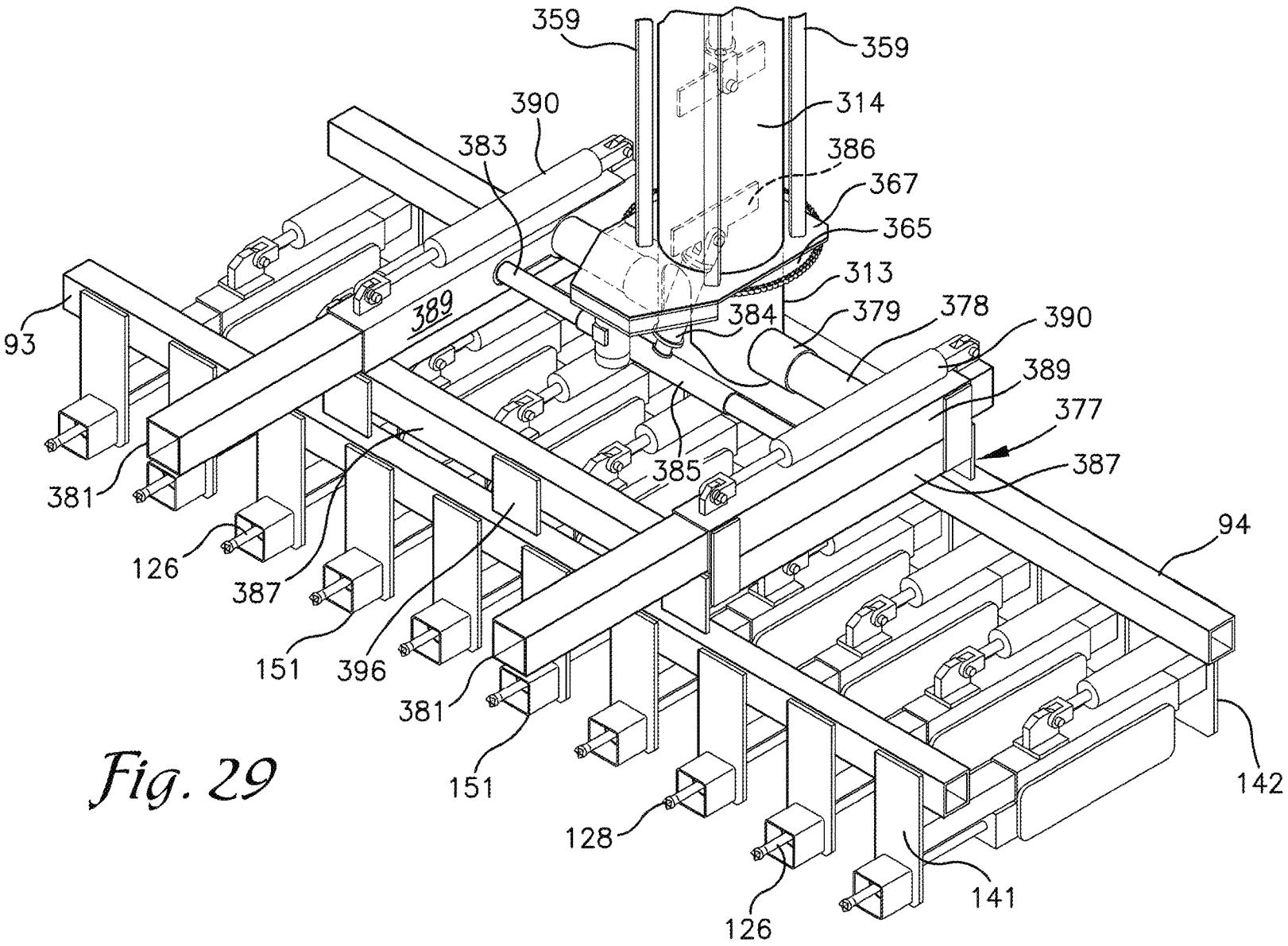
FIG. 29 is an enlarged and fragmentary view of the drill gang assembly supported on the end of a mast in a telescoping support tube.
Figure 30:
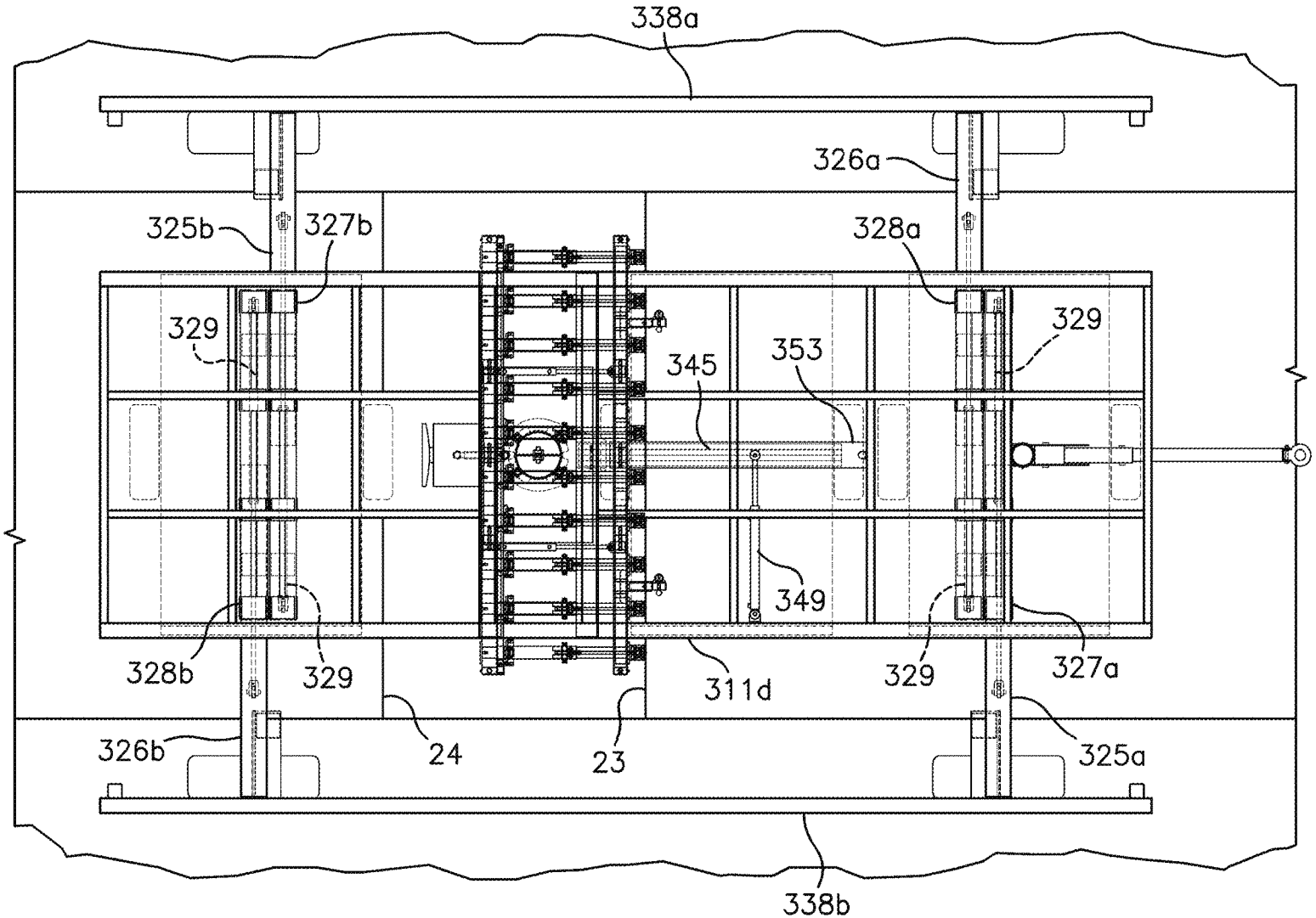
FIG. 30 is a top plan view of the drilling machine as shown in FIG. 27 with the drill gang assembly rotated one hundred and eighty degrees and extending in the hole.

The support tube 314, for mast 313, is fixedly secured to and extends upward from the lateral slide plate 316 around an opening 361 through the slide plate 316. The mast 313, which is formed from a cylindrical tube in the embodiment shown, is connected to the support tube 314 by a hydraulic actuator 363. The mast 313 extends through the opening 361 in the slide plate 316 and through the central opening 356 in the collar 351 connected to pivot arm 345. As best seen in FIGS. 29 and 32-34, a driven sprocket 365 is welded to or otherwise fixedly secured around the mast 313 proximate a lower end thereof. Positioned in closely spaced relation above the sprocket 365 is an annular motor mounting plate 367. Lower ends of the stabilizing rods 359 are connected to the motor mounting plate 367 in equally spaced relation around the outer periphery of the mast 313. As best seen in FIG. 29, a gap is formed between each of the stabilizing rods 359 and the outer surface of the mast 313. The stabilizing rods extend upward, through the arcuate channels 357 in the collar 351, through aligned holes (not shown) in the slide plate 316 and into aligned tubular receivers 369 welded to the outer surface of support tube 314. With upper ends of the stabilizing rods 359 secured within the receivers 369 on support tube 314, the motor mounting plate 367 is prevented from rotating.

A hydraulic motor 371, with a drive sprocket 372 mounted on an output shaft, is mounted on a bracket 372 connected to the motor mounting plate 367. A drive chain 374 extends around the drive sprocket 372 and driven sprocket 365 for rotation of the mast 313 about a vertical axis upon activation of the motor 371.

The drill gang assembly 302 includes a drill support frame 377 pivotally connected to a lower end of the mast 313. The drill support frame 377 includes a pivot shaft 378 pivotally secured within a bearing sleeve 379 which extends transversely through a lower end of the mast 313. Laterally spaced, support arms or beams 381 are secured on opposite ends of the pivot shaft 378 and extend perpendicular thereto. The pivot shaft 378 is connected to inner surfaces of each of the support arms 381 closer to rear ends thereof. A cylindrical support bar 383 is connected to and extends between the support arms 381 in spaced relation from the pivot shaft 378 towards front ends of each support arm 381. A linear or hydraulic actuator 384 is pivotally connected at a lower end to a support tube 385 surrounding the support bar 383 and at an upper end to a bracket 386 mounted within a lower end of the mast and above the pivot shaft 378. Actuator 384 is operable to pivot the drill support frame 377 and drill gang assembly 302 downward and upward relative to the mast 313 with the pivot shaft 378 rotating within bearing sleeve 379.

The bearing sleeve 379 and the support tube 385 are shorter than the pivot shaft 378 and support bar 383 respectively, such that the drill support frame 377 can slide sideways relative to the mast 313. As best seen in FIG. 28, a hydraulic actuator 386, connected between one of the support arms 381 and the bearing sleeve 379 is operable to slide the drill support frame 377 and the drill gang assembly 302 laterally relative to the mast on the pivot shaft 378.

Drill support frame 377 further includes a rectangular frame 387 connected to and extending below support tubes 389 slidably mounted on and surrounding the support arms 381. A hydraulic actuator 390 is connected at one end to the rear end of each support arm 381 and at an opposite end to a front end of the associated support tube 389. The actuators 390 are operable to slide the support tubes 389 relative to the support arms 381 for sliding the drill support frame 377 and drill gang assembly 302 fore and aft relative to the mast 313.

Front and rear drilling assembly support beams 93 and 94 are suspended from the rectangular frame 387 in parallel spaced relation by straps 396. In the embodiment shown in FIGS. 26-38, the drill assemblies 60 are shown fixedly connected to the front and rear drilling assembly support beams 93 and 94 such as by welding the front and rear guide rail support straps 141 and 142 to the front and rear drilling assembly support beams 93 and 94 respectively.

In some circumstances, the faces 23, 24, 25 and 26 of the slab 2 surrounding the hole 15 do not extend perpendicular or parallel to the longitudinal axis of the lane 3 of the road in which the hole is formed. Therefore, it is foreseen that the front and rear drilling assembly support beams 93 and 94 could be mounted to shift longitudinally relative to each other such as in a parallelogram assembly. In addition, the drill assembles 60 then could be pivotally connected at their front and rear ends by pivotal support rods (not shown) suspended from the front and rear drilling assembly support beams 93 and 94 respectively and replacing the straps 141 and 142. The pivotal connection of the drill assemblies 60 to the support beams 93 and 94 which in turn move longitudinally relative to each other allows the positioning of the drill bit heads 128 to be skewed to align with a skewed face 23, 24, 25 or 26 surrounding the hole 15 in the slab 2.

A seat 401 for an operator, is mounted to the slide plate 316 surrounding mast 313 by a pivoting offset base assembly 403 which spaces the seat away from the mast 313 and includes two vertical pivots to allow the seat 401 to pivot relative to two vertical axes. A hand-held controller (not shown) can be used by the operator to control the operation of the mobile drilling machine 301 including the operation of the hydraulic motors and actuators for moving the carriage 303, extending and retracting the wheels 307 relative to the main frame 303, extending, retracting, and rotating the mast 313, pivoting or sliding the drill gang assembly 302 relative to the mast 313 and operating the pneumatic drills 57.

Figure 35:
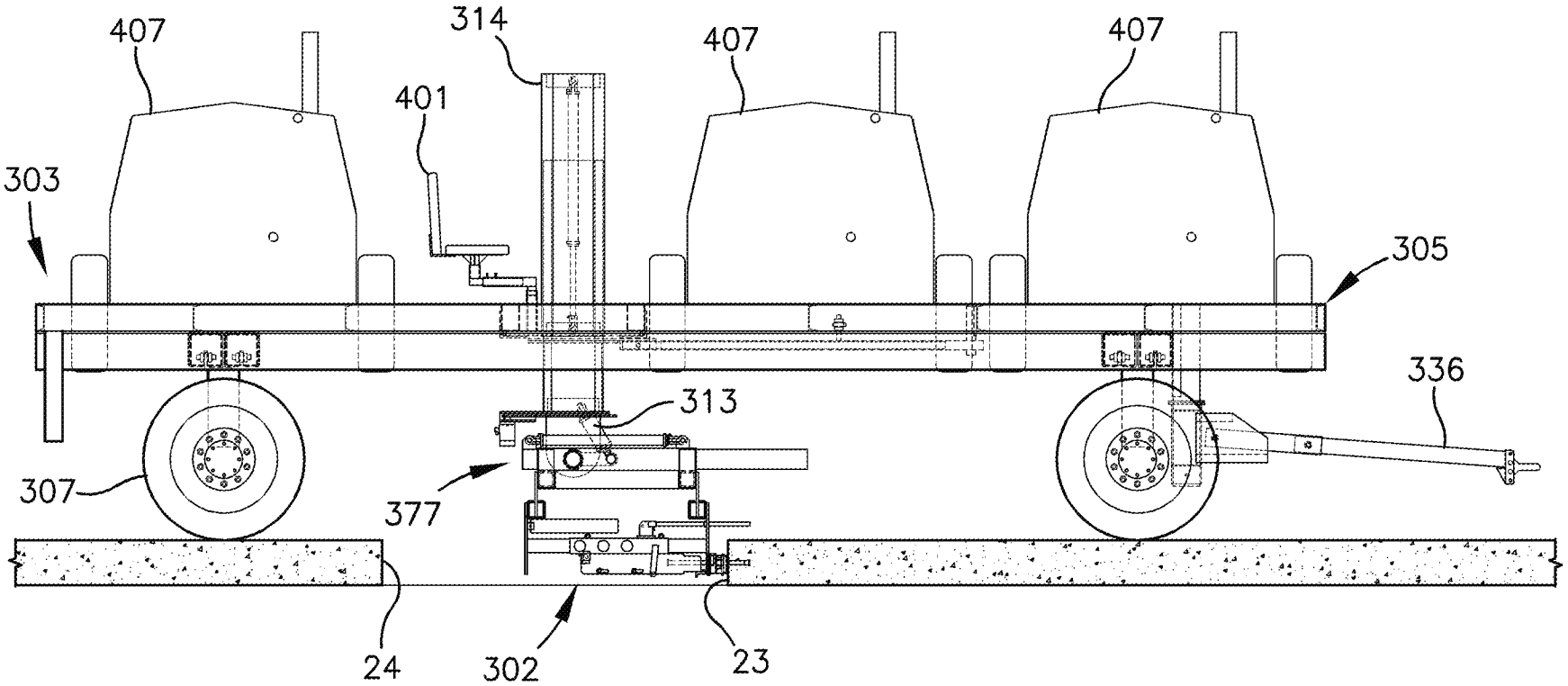
FIG. 35 is a side elevational view of the drilling machine showing the drill gang assembly lowered into a hole in a slab and showing air compressors supported on the main frame for supplying compressed air for the operation of the drills.

Referring to FIG. 35, three conventional, trailer type, air compressors 407 are shown supported on the main frame 305 for use in supplying pressurized air for operation of the drills 57. A reservoir for hydraulic fluid and a hydraulic pump for supplying pressurized hydraulic fluid to the hydraulic actuators and motors included in the mobile drilling machine 301 can also be mounted on the main frame 305 but are not shown. Although not shown in the embodiment shown in FIGS. 26-35, the drill gang assembly 302 preferably includes a drill bit release assembly 201 or a vibrating drill release assembly 213 or both. Although not shown, the drill gang assembly 302 also uses clips 163 connected to water supply conduits 171 as shown in FIG. 19, to supply water to the drill bit heads 128 for cooling the drill bit heads 128 during use and for controlling the dust generated during use. It is foreseen that the water could be supplied by nozzles connected to the water supply conduits 171 and mounted on each shroud 151. Insulating panels, such as panels 224 and 225 as shown in FIG. 23 are also preferably used with the drill gang assembly 302 for controlling dust and noise.

Prior to towing the mobile drilling machine 301 to a worksite, the wheels 307 are retracted relative to the main frame 305 and the mast 313 and drill gang assembly 302 are rotated until the drill gang assembly 302 is oriented lengthwise relative to a longitudinal axis of the carriage 303. The mast 313 and drill gang assembly 302 connected thereto are also raised to a retracted position relative to the main frame 305. The tow bar 36 is connected to a towing vehicle (not shown) for towing the mobile drilling machine 301 to a section of a slab 2 or road on which it is to be used. At the site, the tow bar 36 is disconnected from the towing vehicle short of a hole 15 in the slab 2 from which a section of concrete has been removed. The operator then operates the hydraulic motors 335 connected to rear wheels 307*c* and 307*d* to drive the machine 301 toward the hole 15.

Prior to reaching the hole 15, the actuators 329 are operated to extend the front and rear wheel support beams 325 and 326 of each truck 321 and 322 so that the spacing between the front and rear sets of wheels 307 exceeds the width of the hole 15 in the slab 2. Extension of the front and rear wheel support beams 325 and 326 of each truck 321 and 322 may be facilitated by using the drill gang assembly 302 and the mast 316 as a jack for jacking up one side of the carriage main frame 305 to extend the wheel support beams 325*a* and 326*b* and associated wheels 307 on one side and then wheel support beams 326*a* and 325*b* wheels 307 on the other side. To raise a side of the frame 305 to lift the wheels 307 on that side of the frame 305 off of the ground, the slide plate 316 and attached mast 313 and drill gang assembly 302 are pivoted to that side of the frame 305 and then the mast is extended until the bottom of the drills on the drill gang assembly 320 abut against the slab 2. Further extension of the mast 313 relative to the outer support tube 314 then raises that side of the main frame 305 relative to the slab. The drill gang assembly 302 is preferably rotated until it is oriented longitudinally relative to the carriage 303 as shown in FIG. 31 prior to extension of the mast 313.

Once both sets of wheels 307 are extended as desired and the mast 313 raised far enough to raise the drill gang assembly 302 off of the slab 2, the hydraulic motors 335 for drive wheels 307*c* and 307*d* are operated to drive the carriage 303 over the hole 15. The hydraulic motor 371 for rotating the mast 313 is then operated to rotate the mast 313 and drill gang assembly 302 until the heads 128 of the drills 57 are facing the wall of the slab 2 surrounding the hole 15 in which the drills 57 are to be used to drill dowel receiving holes. The mast actuator 363 is operated to extend the mast 313 relative to outer support tube 314 and lower the drill gang assembly 302 into the hole 15.

The drill gang assembly 302 may be slid laterally in the hole 15 and relative to the slab 2 by extending or retracting actuator 386 to push or pull the drill gang assembly 302 relative to the mast 313 with the bearing sleeve 379 sliding over the pivot shaft 378. Lateral shifting of the drill gang assembly 302 relative to the drilling machine 301 may also be accomplished by pivoting of the pivot arm 345 through actuation of actuator 349 to move the lateral slide plate, on which the mast 313 is mounted, laterally relative to the main frame 305.

If the drill heads 128 do not abut or extend in closely spaced relation to the surface into which holes are to be bored, the actuators 390 may be operated to slide the drill gang assembly 302 forward on the support arms 381. The angle of the drill bits 126 relative to the wall of the slab 2 in which bore holes are to be drilled is adjustable by pivoting the drill support frame 377 relative to the mast 313 through operation of pivot actuator 384.

Dowel holes will typically be bored in the rear face 24 first. Once the dowel holes are bored in the first face of the slab surrounding the hole 15, and the drill bits 126 are retracted and then the mast 313 is retracted until the drill gang assembly 302 is withdrawn from the hole 15. The mast 313 and the drill gang assembly 302 are then rotated until the drill bit heads 128 are directed towards the next face of the slab 2 surrounding the hole 15 in which the operator wants to drill the dowel holes. Depending on the width of the hole 15 in the longitudinal direction, when dowel holes are to be bored in the front and rear faces 23 and 24, the operator may not have to move the carriage 305 to be able to position the drill bit heads against the front face 23 after first drilling holes in the rear face 24. Rather the carriage 303 may originally be positioned so that the drill gang assembly 302 is centered over the hole 15. When the drill gang assembly 302 is lowered back into the hole 15 after drilling holes in the rear face 24, if the heads 128 of the drill bits 126 do not extend in closely space relation to front face 23, then the drill gang assembly 302 can be advanced toward the front face 23 by extending actuators 389 connected between the support arms 381 and support tubes 385 supporting the drill gang assembly 302 on the support arms 381.

If the hole 15 in the slab 2 is long enough and requires dowel holes to be bored into the longitudinally extending faces or side faces 25 and 26, the drill gang assembly 302, after being raised out of the hole 15, can be rotated so that the heads 128 of the drill bits 126 face toward either the left or right longitudinal faces 25 or 26 of the slab 2 surrounding the hole 15. The drill gang assembly 302 is then advancable laterally relative to a longitudinal axis of the main frame 5, either to the left or right thereof, through extension or retraction of the actuator 349 to pivot the pivot arm 345. Pivoting of the pivot arm 345 advances the lateral slide plate 316, mast 313 and drill gang assembly 302 laterally relative to the main frame 305 of the carriage 303. As the drill gang assembly 302 is pivoted laterally to the left or right side of the carriage using pivot arm 345, further adjustments to the rotational orientation of the drill gang assembly 302 relative to the main frame 305 can be made by further rotation of the mast 313 to maintain the drill bit heads 128 facing toward the selected face 25 or 26 of the slab 2 surrounding hole 15.

In the embodiment shown, the slide plate 316 can be slid laterally to the left or right until the outer support tube 314 for mast 313 abuts against the left or right, outer longitudinal beam 311*a* or 311*d* respectively of main frame 305. As shown in FIG. 31, with the outer support tube 314 abutting against either of the left or right, outer longitudinal beams 311*a* or 311*d*, a portion of the slide plate 316 will extend past the respective longitudinal beam 311*a* or 311*d*. The drill bit heads 128, when oriented facing outward from the main frame 305, also extend past the respective, outer longitudinal beam 311*a* or 311*d* both when the drill support frame 377 is retracted or extended on the support arms 381.

In one embodiment, the main frame 305 of the carriage 303 is approximately 8 feet wide. When the outer support tube 314 for mast 313 is slid all the way to one side, and with the drill support frame 377 extended on the support arms 381 with the drill gang assembly 302 oriented with the drill bit heads 128 facing outward and to the side of the main frame 305, the outer edges of the drill bit shrouds 151 extend approximately two feet or more past the main frame 305. The drill gang assembly 302 can therefore be used to drill dowel holes in longitudinal faces 25 and 26 of a slab 2 spaced 12 or more feet apart.

It is to be understood that while certain forms of the present invention have been illustrated and described herein, it is not to be limited to the specific forms or arrangement of parts described and shown. As used in the claims, identification of an element with an indefinite article "a" or "an" or the phrase "at least one" is intended to cover any device assembly including one or more of the elements at issue. Similarly, references to first and second elements is not intended to limit the claims to such assemblies including only two of the elements, but rather is intended to cover two or more of the elements at issue. Only where limiting language such as "a single" or "only one" with reference to an element, is the language intended to be limited to one of the elements specified, or any other similarly limited number of elements. With respect to any method claims included herein, the order of the steps listed is not intended to be limiting and the order may vary unless clearly specified otherwise.

What is claimed and desired to be secured by Letters Patent is as follows:

1. A drilling machine for boring holes in a vertically oriented surface of a slab, the drilling machine comprising:

a drilling machine frame supported on left and right front wheels telescopingly connected to the drilling machine frame and left and right rear wheels telescopingly mounted to said drilling machine frame;

a drill gang assembly connected at a lower end of a mast which is telescopingly mounted relative to said drilling machine frame and rotatable relative to said drilling machine frame three hundred and sixty degrees about a mast axis extending vertically through said mast;

said drill gang assembly including a drill support frame supporting a plurality of drills in parallel spaced alignment; and said left and right front wheels and said left and right rear wheels are extendable and retractable laterally relative to said drilling machine frame.

2. The drilling machine as in claim 1 wherein, a spacing between outer edges of said left and right front wheels and between outer edges of said left and right rear wheels is less than the width of a lane of a road on which said drilling machine is advanced when said left and right front wheels and said left and right rear wheels are retracted laterally relative to said drilling machine frame and a spacing between inner edges of said left and right front wheels and between inner edges of said left and right rear wheels exceeds the width of the lane of the road on which said drilling machine is advanced when said left and right front wheels and said left and right rear wheels are extended laterally relative to said drilling machine frame.

3. The drilling machine as in claim 1 wherein said mast is slidable laterally relative to said drilling machine frame.

4. The drilling machine as in claim 1 further comprising means for driving at least one of the left and right front wheels or the left and right rear wheels.

5. The drilling machine as in claim 4 further comprising a tow bar connected to the drilling machine frame.

6. The drilling machine as in claim 1 wherein said mast is telescopingly mounted within a mast support tube and the mast support tube is fixedly mounted on and extends vertically relative to a slide plate that is slidably mounted on the drilling machine frame with the mast extending through a hole in the slide plate surrounded by the mast support tube.

7. The drilling machine as in claim 6 wherein said mast is rotatably three hundred and sixty degrees relative to said mast support tube.

8. The drilling machine as in claim 6 further comprising a seat for an operator connected to and sliding laterally with the mast support tube.

9. The drilling machine as in claim 6 further comprising a collar surrounding the mast support tube and a telescoping pivot arm connected between said collar and a pivot on said drilling machine frame, said drilling machine further comprising a linear actuator connected between the drilling machine frame and the pivot arm for pivoting the pivot arm laterally relative to the drilling machine frame causing the slide plate to slide laterally relative to said drilling machine frame.

10. The drilling machine as in claim 9 further comprising a chair for an operator connected to said collar or said slide plate.

11. A drilling machine for boring holes in a vertically oriented surface of a slab, the drilling machine comprising:

a drilling machine frame supported on a plurality of wheels;

a drill gang assembly connected at a lower end of a mast which is telescopingly mounted relative to said drilling machine frame and rotatable relative to said drilling machine frame three hundred and sixty degrees about a mast axis extending vertically through said mast;

said drill gang assembly including a drill support frame supporting a plurality of drills in parallel spaced alignment; and said mast is slidable laterally relative to said drilling machine frame.

12. The drilling machine as in claim 11 wherein said drilling machine frame is supported on front and rear laterally telescoping wheel assemblies and said drilling machine further comprises means for driving at least one wheel of said front or rear telescoping wheel assemblies.

13. The drilling machine as in claim 11 wherein said drill support frame is pivotally mounted to a lower end of said mast and pivotal about an axis extending transverse to said mast axis and transverse to the plurality of drills supported on said drill support frame.

14. The drilling machine as in claim 11 wherein said drill gang assembly includes a plurality of drill support rails mounted on the drill support frame in parallel spaced relation; a drill carrier is slidably mounted on each drill support rail and a drill, including a drill body and a drill bit, is connected to a respective drill carrier with the drill bits of said drills projecting forward from said respective drill body in parallel spaced relation; a linear actuator is connected between each drill carrier and the drill support rail rearward of said drill carrier; said linear actuator operable to urge said drill forward relative to said drill support rail.

15. The drilling machine as in claim 11 wherein said mast is telescopingly mounted within a mast support tube and the mast support tube is fixedly mounted on and extends vertically relative to a slide plate that is slidably mounted on the drilling machine frame with the mast extending through a hole in the slide plate surrounded by the mast support tube.

16. The drilling machine as in claim 15 wherein said mast is rotatably three hundred and sixty degrees relative to said mast support tube.

17. The drilling machine as in claim 15 further comprising a seat for an operator connected to and sliding laterally with the mast support tube.

18. The drilling machine as in claim 15 further comprising a collar surrounding the mast support tube and a telescoping pivot arm connected between said collar and a pivot on said drilling machine frame, said drilling machine further comprising a linear actuator connected between the drilling machine frame and the pivot arm for pivoting the pivot arm laterally relative to the drilling machine frame causing the slide plate to slide laterally relative to said drilling machine frame.

19. The drilling machine as in claim 18 further comprising a chair for an operator connected to said collar or said slide plate.

20. The drilling machine as in claim 11 further comprising a pair of support arms pivotally connected to a lower end of said mast and extending in parallel spaced relation away from said mast; said drill support frame including a pair of sleeves connected thereto and slidably supported on said support arms; an actuator connected between at least one of said support arms and a respective sleeve operable to extend said drill support frame away from or retract said drill support frame towards said mast.

* * * * *